US007886508B2

(12) United States Patent
Yuyama et al.

(10) Patent No.: US 7,886,508 B2
(45) Date of Patent: Feb. 15, 2011

(54) MEDICINE PACKAGING APPARATUS

(75) Inventors: Shoji Yuyama, Toyonaka (JP); Nakaji Takeda, Toyonaka (JP); Hiromichi Tsuda, Toyonaka (JP)

(73) Assignee: Yuyama Mfg. Co., Ltd, Osaka (JP)

( * ) Notice: Subject to any disclaimer, the term of this patent is extended or adjusted under 35 U.S.C. 154(b) by 0 days.

(21) Appl. No.: 12/531,643

(22) PCT Filed: Mar. 27, 2008

(86) PCT No.: PCT/JP2008/055844

§ 371 (c)(1),
(2), (4) Date: Sep. 16, 2009

(87) PCT Pub. No.: WO2008/120657

PCT Pub. Date: Oct. 9, 2008

(65) Prior Publication Data

US 2010/0107555 A1 May 6, 2010

(30) Foreign Application Priority Data

Apr. 2, 2007 (JP) ..... 2007-096925
Nov. 2, 2007 (JP) ..... 2007-286186

(51) Int. Cl.
*B65B 9/06* (2006.01)

(52) U.S. Cl. ..... 53/568; 53/450; 53/459; 53/558; 53/563

(58) Field of Classification Search ..... 53/452, 53/455–457, 459, 450–451, 558, 562, 563, 53/564, 567, 568, 574–576, 578
See application file for complete search history.

(56) References Cited

U.S. PATENT DOCUMENTS 4,566,505 A 1/1986 Ruf et al.

FOREIGN PATENT DOCUMENTS

| | | |
|---|---|---|
| CN | 1760081 | 4/2006 |
| JP | 2002-19737 | 1/2002 |
| JP | 2004-189336 | 7/2004 |
| JP | 2004-238026 | 8/2004 |
| JP | 2004-284663 | 10/2004 |
| JP | 2006-110107 | 4/2006 |

OTHER PUBLICATIONS

Patent Cooperation Treaty (PCT) International Preliminary Report on Patentability issued Mar. 27, 2008 in corresponding to International Application No. PCT/JP2008/055844.
International Search Report issued May 13, 2008 in International (PCT) Application No. PCT/JP2008/055844.

*Primary Examiner*—Christopher Harmon
(74) *Attorney, Agent, or Firm*—Wenderoth, Lind & Ponack, L.L.P.

(57) ABSTRACT

A distance from a printing section to a heat sealing section of a medicine packaging apparatus is shortened without generating wrinkles on a package sheet. A unfolding guide included in a packaging unit for unfolding and opening a package sheet has a main ridge extending along with the fold of the package sheet, and a pair of unfolding guide surfaces, which are convex curved surfaces stretching from the main ridge and which are symmetrical to each other with respect to the main ridge.

9 Claims, 40 Drawing Sheets

Fig. 31

| 1st Pack | 2nd Pack | 3rd Pack | 4th Pack | 5th Pack | 6th Pack | 7th Pack | 8th Pack | 9th Pack |
|---|---|---|---|---|---|---|---|---|
| Morning Solid Med. | Afternoon Solid Med. | Evening Powdred Med. | Morning Solid Med. | Afternoon Solid Med. | Evening Solid Med. | Morning Solid Med. | Afternoon Solid Med. | Evening Solid Med. |
| ○ | ○ | ○ | × | × | ○ | × | × | ○ |

215

MEDICINE PACKAGING APPARATUS

TECHNICAL FIELD

The present invention relates to a medicine packaging apparatus for packaging medicine such as tablet medicine including capsule medicine and powdered medicine.

BACKGROUND ART

Various medicine packaging apparatuses have been provided which prepare continuous medicine bags or dose packages by packaging medicine such as tablet and powdered medicines per dose (as one medicine bags) based on prescriptions. Some of these devices use package sheet rolls on which long and narrow package sheets previously folded into two in the longitudinal direction is wound. Generally, in a packaging section of this kind of medicine packaging apparatus, a package sheet is fed from the roll, and required information is printed thereon by a printing section. The package sheet is then developed or unfolded from the folded state to be opened, and a nozzle section of a hopper is inserted into the opening to introduce one dose of medicine therein. Next, the package sheet is sealed (heat-sealed) in a heat sealing section so that the medicine is enclosed (see, e.g., JP 2004-189336 A, JP 2004-284663, JP 2004-238026 A and JP 2002-19737 A).

Upon first startup of the medicine packaging apparatus or at the time of roll replacement, it is necessary to routing a package sheet unrolled from the roll to the heat sealing section through the nozzle section of the hopper and the printing section before starting medicine packaging operation. In other words, in the roll replacement operation and the like, a length of the package sheet from the printing section to the heat sealing section (the length generally equivalent to 5 to 6 packages) functions only for the routing, i.e., the length is not used for medicine packaging and therefore should be discarded, which is not desirable in view of cost. Moreover, the long path of the package sheet from the printing section to the heat sealing section hinders downsizing of the medicine packaging apparatus. Accordingly, reduction in path length from the printing section to the heat sealing section can eliminate a waste of the package sheet caused by the roll replacement and the like and achieve downsizing of the apparatus. However, merely shortening the path cannot prevent generation of wrinkles on the package sheet in the heat sealing section. Generation of the wrinkles is particularly notable when the heat sealing section employs a method of heat-sealing the package sheet by passing the package sheet between a pair of heater rollers.

With reference to FIGS. 45 and 46, a two-folded package sheet 1100 is expanded into V shape by a unfolding guide 1106, and reaches a heating roller 1102 of a heat sealing section via a nozzle section 1101 of a hopper. The heater roller 102 has a horizontal seal 1103 which seals an opening edge of the package sheet 1100 in the longitudinal direction, and a vertical seal 1104 which seals the package sheet 1100 crosswise from the opening edge to the fold of the package sheet 1100. If the tension applied to both the sides of the two-folded sheet 1100 is unbalanced during application of the vertical seal 1104, one side of the two-folded sheets 1100 sags against the other side, which tends to generate wrinkles 1105 extending in the longitudinal direction near the horizontal seal 1103. The wrinkles 1105 are assumed to be attributed to such causes as a bulge of the package sheet 1100 generated in putting medicine therein and a difference of tension between the portions of the package sheet 1100 where the horizontal seal 1103 is formed and where the vertical seal 1104 is formed. Such wrinkles 1105 result in poor airtightness due to sealing and thereby causes mixture (contamination) of medicine between adjacent prescriptions.

JP 2004-189336 A and JP 2004-284663 A disclose a unfolding guide 1106 in the shape of a triangular plate with a constant thickness and a unfolding guide 1106 constituted of a plurality of flat planes and having an outline of a generally triangular pyramid shape. However, if the unfolding guides 1106 in such shapes are employed and placed in the vicinity of the printing section to shorten the path length from the printing section to the heat sealing section, then the above-mentioned wrinkles 1105 are unavoidably generated on the package sheet 1100.

The medicine packaging apparatus of this kind also has a problem in which medicine (powdered medicine in particular) fed from a powdered medicine supply unit or a tablet supply unit to the packaging unit adheres to the hopper and remains there to cause contamination. As a solution to the residual medicine, a technique is known which smoothes the movement of the medicine within the hopper by a solenoid driving mechanism intermittently striking the hopper so as to apply impact thereto. However, the intermittent striking of the hopper cannot necessarily achieve effective prevention of adhesion of the medicine to the hopper. Moreover, the sound generated when a striking mechanism strikes the hopper is unpleasant for operators, and the striking sound may be misunderstood by the operators to be caused by failure of the apparatus. For example, in small-scale dispensing pharmacies, the striking sound of the hopper may resound through the room and may make not only the operators but also patients unpleasant. In order to minimize the striking time of the hopper in consideration of the displeasure given to the patients, striking by the solenoid mechanism is generally performed for a short period of time after the medicine is discharged from the nozzle section on the lower side of the hopper. However, the striking for such a very short time is not desirable in view of effective prevention of the residual medicine. Thus, the conventionally known medicine devices of this kind cannot achieve effective prevention of the residual medicine in the hopper while reducing the displeasure given to operators and patients.

DISCLOSURE OF THE INVENTION

Problems to be Solved by the Invention

An object of the present invention is to provide a medicine packaging apparatus having a shortened distance from a printing section to a heat sealing section without generating wrinkles on package sheets. Another object of the invention is to reliably prevent the residual medicine in a hopper without causing displeasure and false detection of failure.

Means for Solving the Problems

The present invention provides a medicine packaging apparatus, comprising: a sheet supply section for unrolling and feeding an elongated package sheet from a roll on which the package sheet is wound, the package sheet previously being folded along its longitudinal direction into two parts; a unfolding guide for unfolding and opening the package sheet fed by the sheet supply section; a medicine introducing section for introducing a medicine into an opening of the package sheet;

a heat sealing section for sealing the package sheet so as to enclose the introduced medicine; and a printing section for making a print on the package sheet arranged between the sheet supply section and the unfolding guide along a path of the package sheet, wherein the unfolding guide comprises: a main ridge extending along with a crease of the package sheet; and a pair of unfolding guide surfaces which are convex curved surfaces stretching from the main ridge and which are symmetrical to each other with respect to the main ridge.

Since the unfolding guide includes a pair of the unfolding guide surfaces constituted of convex curved surfaces, the two-folded package sheet is guided with the curved surfaces and thereby gently deformed to be unfolded or developed so that an opening can be formed. Therefore, even if the printing section is placed in the vicinity of the unfolding guide and the heat sealing section, it becomes possible to reliably prevent wrinkles from being generated on the package sheet in the heat sealing section. In other words, the shape of the unfolding guide can reduce the distance from the printing section to the heat sealing section without generating wrinkles on the package sheet. As a result, the length of the useless package sheet used only for routing upon the initial startup of the medicine packaging apparatus or in roll replacement and not for packing of the medicine (package sheet from the printing section to the heat sealing section) can be reduced to the minimum, and thereby running cost reduction can be achieved. Moreover, downsizing of the apparatus can be attained by reducing the distance from the printing section to the heat sealing section.

Specifically, as seen from a conveying direction of the package sheet, outlines of the unfolding guide surfaces are convex curves and a distance between the pair of the unfolding guide surfaces increases as the unfolding guide surfaces are farther away from the main ridge, and as seen from a direction orthogonal to the conveying direction of the package sheet and facing the main ridge, the outlines of the unfolding guide surfaces are straight and a distance between the unfolding guide surfaces become narrower from an upstream to a downstream of the conveying direction of the package sheet.

Preferably, the unfolding guide surface of the unfolding guide has a rear end edge extending from an end section of the main ridge on a downstream side of the conveying direction of the package sheet, and the rear end edge forms a first angle which is an acute angle with the main ridge at a joining position with the main ridge and a second angle which is larger than the first angle with the main ridge at regions other than the joining position with the main ridge.

With this configuration, it becomes possible to achieve both the prevention of stagnation of medicine, and reliable prevention of wrinkles from generated on the package sheet. The first angle formed by the rear end edge and the main ridge at their joining position is set as small as possible, so that it becomes possible to prevent medicine (powdered medicine in particular) introduced from the medicine introducing section from being stagnated in the end section of the unfolding guide surface on the downstream side of the conveying direction of the package sheet. Since the angle between the rear end edge and the main ridge at the regions other than their joining position forms the second angle which is larger than the first angle, the area of the unfolding guide surface can be set wide enough to prevent wrinkles from being generated on the package sheet.

Preferably, a portion of the unfolding guide on an upstream side of the conveying direction of the package sheet comprises a sub ridge extending continuously from the main ridge and a pair of top surfaces which are convex curved surfaces stretching symmetrically with respect to the sub ridge and which are joined to the unfolding guide surfaces, and a pair of shoulder sections joining the unfolding guide surfaces and the top surfaces and constituted of curved surfaces continuing to the unfolding guide surfaces and the top surfaces.

Even when medicine (powdered medicine in particular) introduced from the medicine introducing section descends to the top surface of the unfolding guide due to blowing-up and the like, the medicine falls to the package sheet without remaining on the top surface since the top surface is a curved surface.

Moreover, it is preferable that the sheet supply section has a curved guide for curving the conveying direction of the package sheet immediately before the unfolding guide, and that the unfolding guide is formed so that one shoulder section on an inner side of a curvature of the conveying direction with respect to the main ridge is more bulged with respect to the main ridge than the other shoulder section on an outer side of the curve with respect to the main ridge. With this configuration, it becomes possible to apply uniform tension to the package sheet, and to further ensure that the two-folded package sheet is unfolded without gaining wrinkles.

The heat sealing section is of a roller type which seals the package sheet by passing the package sheet between a pair of rotatable heater rollers. Alternatively, the heat sealing section may be of a pack type which has a pair of heating plates intermittently moving between a position where the package sheet is held to be sealed and other position where the plates are detached from the package sheet.

More preferably, the medicine introducing section is provided with a hopper having an inlet opening on an upper side and a nozzle section inserted into the opening of the two-folded package sheet for introducing the medicine into the package sheet on a lower side and the medicine packaging apparatus further comprises a first vibration applying mechanism for applying vibration to the hopper.

The first vibration applying mechanism applies vibration to the hopper, so that it becomes possible to effectively prevent medicine (powdered medicine in particular) from adhering to and remaining on the hopper, and to eliminate contamination thereby. As compared with the sound generated upon striking of the hopper, the sound caused by application of vibration is small in volume and does not make operators uncomfortable nor cause false detection of failure by the operators.

Specifically, the first vibration applying mechanism is provided with a first vibration source and a holding structure for holding the first vibration source and the hopper.

Preferably, the hopper has at least one inclined surface extending slantingly downward from the inlet opening toward the nozzle section for conveying a powdered medicine supplied from the powdered medicine supply section via the inlet opening toward the nozzle section, and the holding section transmits vibration of the first vibration source to the hopper so that the hopper vibrates along an elliptical orbit which is farther away from the inclined surface toward an upper side in a plane including a moving direction of the powdered medicine on the inclined surface by a gravity and a direction of the gravity.

Application of the vibration with such orbit makes it possible to reliably prevent the residual medicine generated by adhesion while increasing the movement speed of the medicine on the inclined surface of the hopper so that the medicine can be introduced from the nozzle section to the opening of the package sheet more efficiently.

In order to implement the orbit, the holding structure comprises: a hopper holding section for holding the hopper; a vibration source holding section for holding the first vibration source provided on one end side of the hopper holding section; and a leaf spring section with an upper end side coupled to the holding section and a lower end side being fixed extending slantingly downward from the hopper holding section so as to be closer to the vibration source holding section toward the lower end side.

Preferably, the medicine packaging apparatus further comprises a second vibration applying mechanism for applying vibration to the unfolding guide. Specifically, the second vibration applying mechanism comprises a second vibration source fixed within the unfolding guide.

Since applying vibration to the unfolding guide by the second vibration applying mechanism smoothes the movement or flow of the medicine (powdered medicine in particular) within the two-folded package sheet, it becomes possible to reliably prevent the medicine from adhering to and remaining in the hopper.

Preferably, the heat sealing section comprises a heat seal member for holding the package sheet from both sides, and the medicine packaging apparatus further comprises a controller for operating the first and second vibration sources for a predetermined time when the heat sealing section is put in a predetermined state.

Particularly, the controller determines whether the medicine of a medicine bag in preparation is the powdered medicine or the tablet based on inputted prescription data, and if the medicine bag in preparation is for the powdered medicine, a time for operating the first and second vibration sources is set to be longer than that in a case of the tablet.

With this configuration, the powdered medicine which tends to adhere to the hopper more than the tablet can be introduced into the package sheet more reliably.

The controller determines whether or not medicine bags in an identical prescription include a medicine bag containing only the tablet after a medicine bag containing the powdered medicine based on inputted prescription data, and while the medicine bag containing only the tablet is in preparation, the first and second vibration sources are maintained in a stopped state.

With this configuration, the contamination caused by the powdered medicine remaining in the hopper can be prevented more reliably.

If the medicine is mixed into a so-called loss bag, the medicine flows out into the apparatus when the loss bag is cut away in the downstream from the heat sealing section, and causes contamination. Accordingly, if the controller determines that an empty medicine bag containing no medicine is in preparation based on inputted prescription data, the first and second vibration sources are preferably maintained in a stopped state.

Preferably, the medicine packaging apparatus further comprises a holding frame accommodated in a housing space within an apparatus main frame and having a front holding section stretching to a front side of the apparatus main frame, a side holding section extending from one lateral edge side of the front holding section to a rear side, and a rotatable coupling section for rotatably coupling the other lateral edge side of the front holding section to the apparatus main frame. The sheet supply section comprises a sheet guide mechanism for guiding the package sheet unrolled from the roll, wherein the roll, the printing section, and a part of the sheet guide mechanism are arranged on the side holding section of the holding frame. Remaining parts of the sheet guide mechanism, the unfolding guide, the medicine introducing section, and the heat sealing section are arranged on the front holding section of the holding frame.

Since the holding frame includes the front holding section and the side holding section extending from the front side holding section to the rear side, the sheet supply section, the unfolding guide, the heat sealing section and the printing section may be placed compactly and the space in the housing space may be utilized. In other words, downsizing of the device can be achieved. If the holding frame is rotated around the rotatable coupling section, the roll of the packing sheet and the printing section can be moved to the front side of the apparatus main frame to allow easy access from the outside of the apparatus main frame, so that the workability of various works such as replacement of rolls and maintenance of the printing section is enhanced.

EFFECTS OF THE INVENTION

In the medicine packaging apparatus of the invention, the unfolding guide includes a pair of the unfolding guide surfaces constituted of convex curved surfaces, so that the distance from the printing section to the heat sealing section can be reduced without generating wrinkles on the package sheet. This makes it possible to eliminate waste losses of the package sheet due to roll replacement and the like so as to achieve running cost reduction while achieving downsizing of the device. Moreover, the vibration applying mechanism is provided for applying vibration to the hopper and the unfolding guide, so that the residual medicine in the hopper can be prevented without causing displeasure and false detection of failure.

BRIEF DESCRIPTION OF THE DRAWINGS

FIG. 31 is a schematic view showing an example of the presence/absence of operation of the vibration applying mechanism for every medicine bag;

DETAILED DESCRIPTION OF THE PREFERRED EMBODIMENTS

First Embodiment

Figure 1:
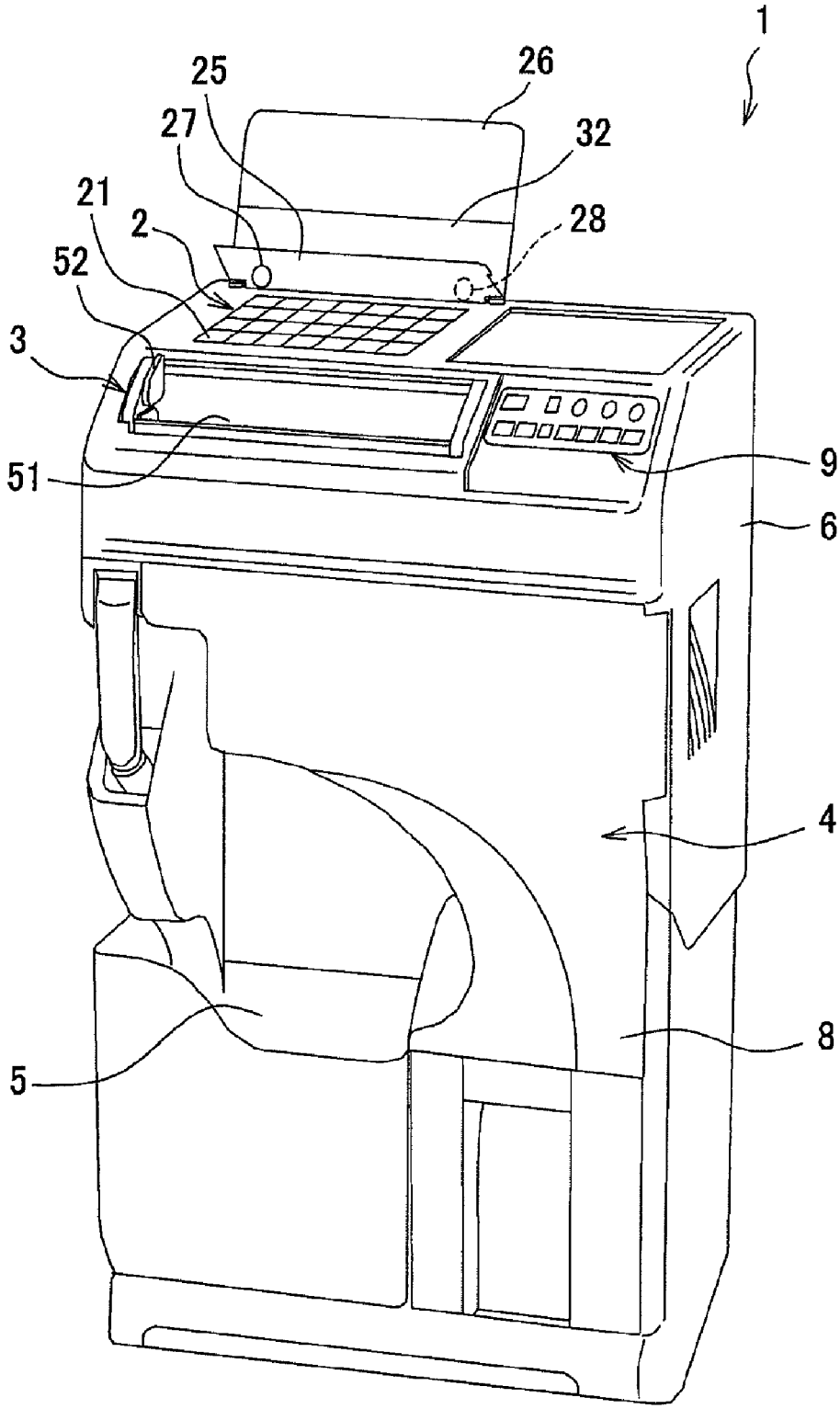
FIG. 1 is a perspective view (with a closing cover at a mid position between a closed position and an open position) for showing the appearance of a medicine packaging apparatus according to a first embodiment of the invention from the front side.
Figure 2:
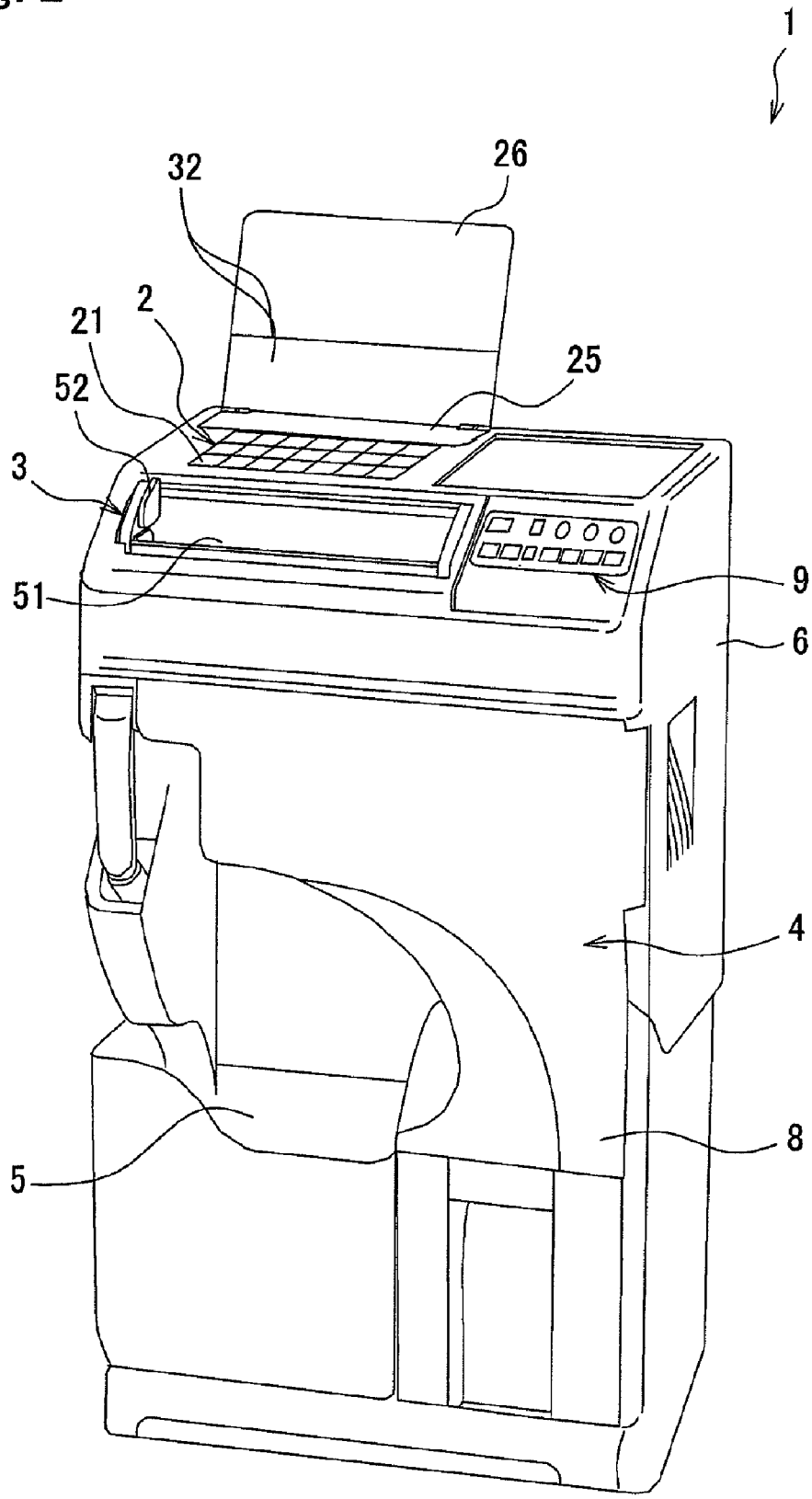
FIG. 2 is a perspective view (with a closing cover in a closed position) for showing the appearance of the medicine packaging apparatus according the first embodiment of the invention from the front side.

FIGS. 1 and 2 show a medicine packaging apparatus 1 according to an embodiment of the present invention.

(Entire Configuration)

The medicine packaging apparatus 1 includes a tablet supply unit 2, a powdered medicine supply unit 3, a packaging unit 4, and a medicine discharge section 5 from which packaged medicines are discharged. The tablet supply unit 2 and the powdered medicine supply unit 3 are provided on an upper side of a housing 6. Meanwhile, the packaging unit 4 is arranged in the housing space 7 inside the housing 6. An opening on the front surface of the housing 6 is covered by an openable and closable cover 8 in the shape of a single swinging door except for the medicine discharge section 5. When opening this cover 8, an operator can access the packaging unit 4 inside the housing space 7. The form of the cover 8 is not particularly limited, and another form such as a double leaf form may be employed.

Figure 3:
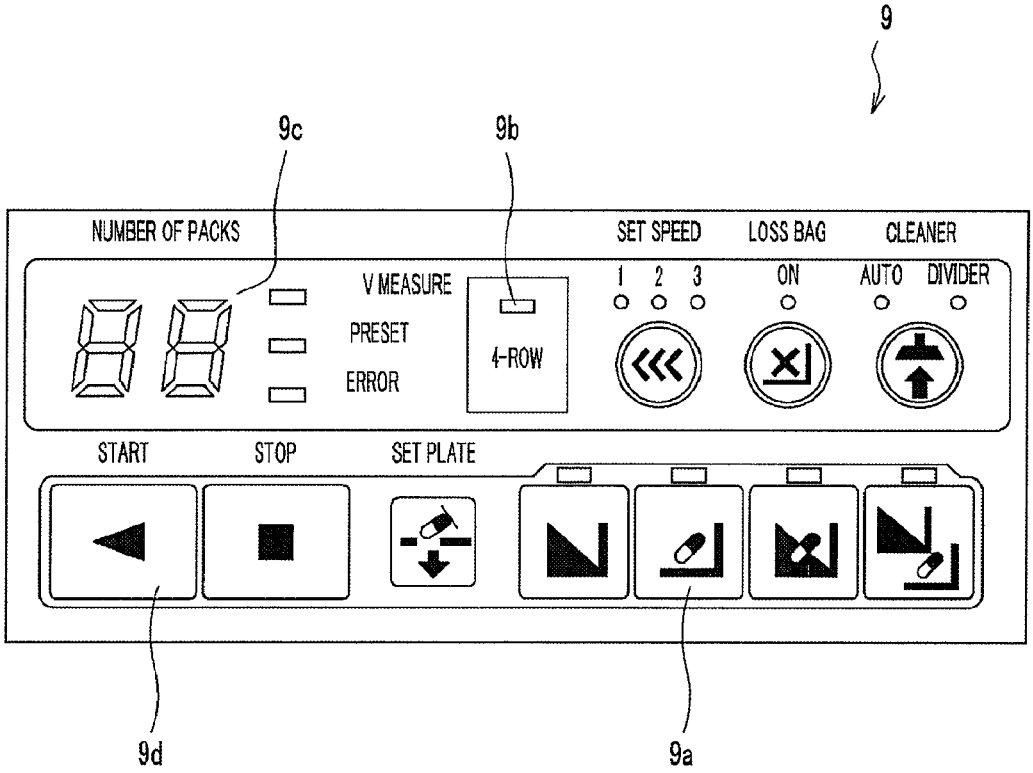
FIG. 3 is a front view of a control panel.
Figure 4:
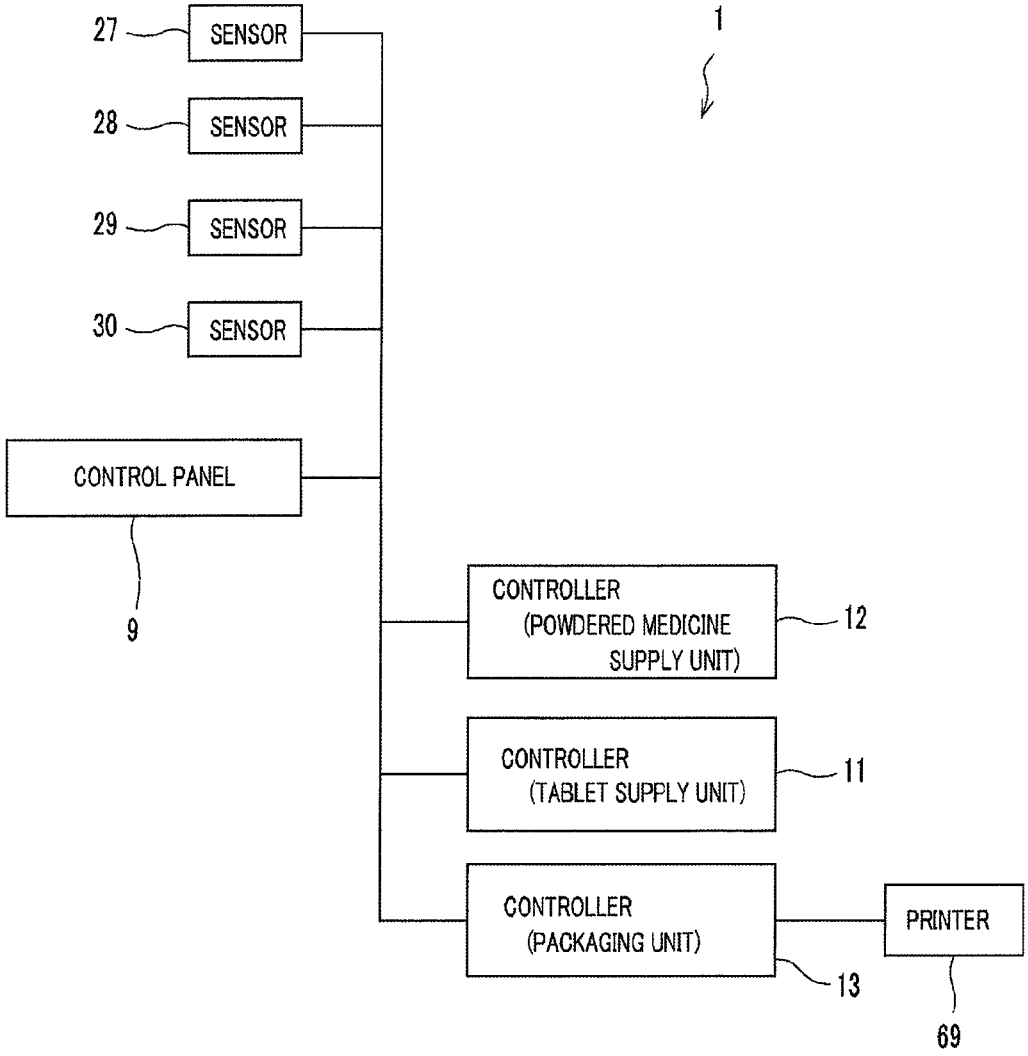
FIG. 4 is a block diagram showing the configuration of the medicine packaging apparatus according to the first embodiment of the invention.

A control panel 9 shown in FIG. 3 is provided on the upper surface of the housing 6. Also with reference to FIG. 4, the operation of the tablet supply unit 2, the powdered medicine supply unit 3 and the packaging unit 4 are controlled by controllers 11, 12, 13 based on the inputs from the control panel 9, the inputs from sensors 27, 28 of a later-described closing cover (manual distribution support member) 25 and from other sensors 29, 30, and the prescription data inputted from the outside. In the present embodiment, the tablet supply unit 2 is controlled by the controller 11, the powdered medicine supply unit 3 is controlled by the controller 12, and the packaging unit 4 is controlled by the controller 13. However, two or more units among the tablet supply unit 2, the powdered medicine supply unit 3, and the packaging unit 4 may be controlled by a common controller.

(Tablet Supply Unit)

In the following, the tablet supply unit 2 is described with reference to FIGS. 1 to 11. First, with reference to FIGS. 5A to 5C, the tablet supply unit 2 includes a fixed tablet housing section 22 in which a plurality of tablet housing chambers 21 are provided in matrix form (and which constitutes part of the upper side of the housing 6 in the present embodiment) and a tablet discharging section 23 that automatically and sequentially takes out tablets for each dose which were supplied by manual distribution into the respective tablet housing chamber 21, and supplies the tablets to the packaging unit 4.

With reference to FIGS. 1, 2, 6 and 7, the tablet housing section 22 in the present embodiment is provided with a total of 28 tablet housing chambers 21 in an identical shape in four rows in an anteroposterior direction (row direction) and seven columns in a lateral direction (column direction). The tablet housing section 22 includes a plurality of first partition walls 24*a* for partitioning the tablet housing chambers 21 adjacent in the column direction and a plurality of second partition walls 24*b* for partitioning the tablet housing chambers 21 adjacent in the row direction. The respective tablet housing chambers 21 are defined by these first and second partition walls 24*a*, 24*b*. Both the upper and lower ends of the respective tablet housing chambers 21 are open. An upper end opening 21*a* functions as an opening for the operator to manually feed tablets into the tablet housing chambers 21. A lower end opening located on the opposite side to the upper end opening 21*a* functions as an opening through which the tablets housed inside the tablet housing chambers 21 pass to the tablet discharging section 23.

Figure 6:
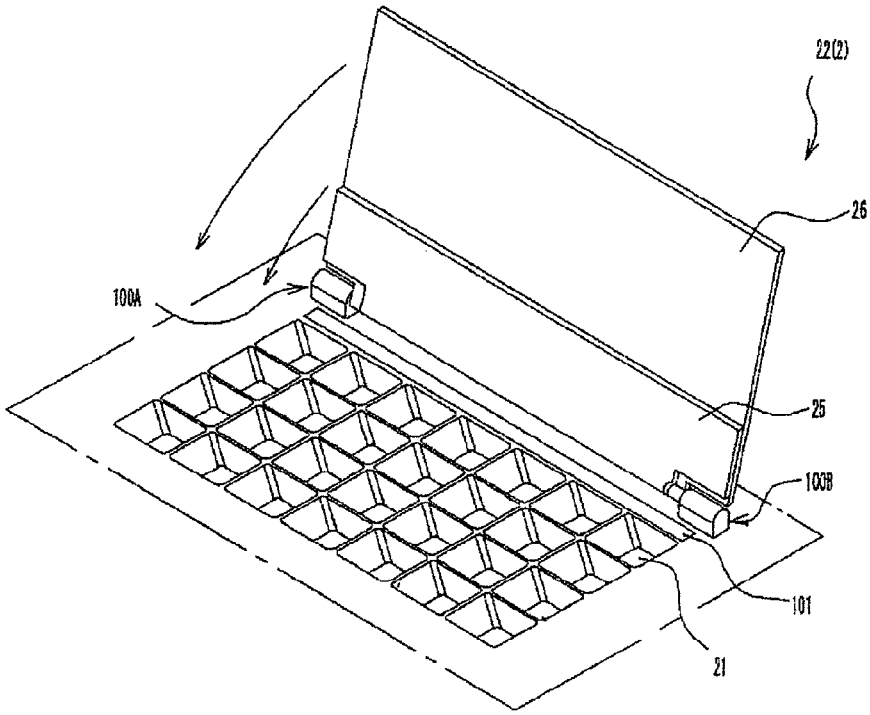
FIG. 6 is a perspective view showing a tablet housing section.
Figure 7:
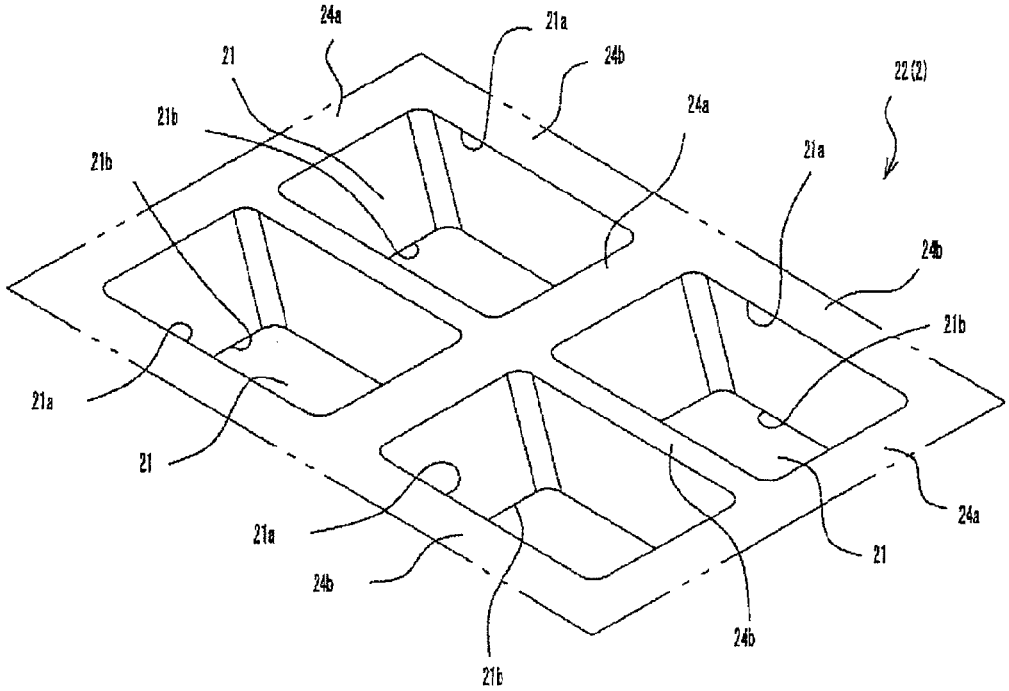
FIG. 7 is a partially enlarged view of FIG. 6.

With reference to FIGS. 1, 2 and 6, the tablet housing section 22 includes a closing cover 25 generally in sheet shape or plate shape (manual distribution supporting member) and a protection cover 26 also having generally sheet shape or plate shape. The closing cover 25 and the protection cover 26 are rotatably fixed to the upper surface of the tablet housing section 22. Specifically, two pin mechanisms (rotation supporting mechanisms) 100A, 100B are provided on the further rear side of the rearmost-side tablet housing chambers 21, and base end sides of the closing cover 25 and the protection cover 26 are rotatably supported by these pin mechanisms 100A, 100B. The closing cover 25 is arranged on the nearer side than the protection cover 26 so as to be located below the protection cover when both the closing cover 25 and the protection cover 26 are closed (refer to FIG. 8A).

When the protection cover 26 is at an open position, the closing cover 25 is movable to an open position (FIGS. 8B and 9A) where the closing cover 25 is receded from the tablet housing section 22 and to a closed position (FIGS. 8C, 9B) where the closing cover 25 is placed on the tablet housing section 22. As shown in FIGS. 8B and 9A, when the closing cover 25 is at the open position, the upper end openings 21*a* of all of the 28 tablet housing chambers 21 are opened so that the tablets can be fed into all of the tablet housing chambers 21. On the other hand, as shown in FIGS. 8C and 9B, when the closing cover 25 is at the closed position, the upper end openings 21*a* of the seven tablet housing chambers 21 constituting the rearmost-side one row among the four rows and seven columns of the tablet housing chambers 21 are closed by the closing cover 25. As a result, the tablets can be fed only into a total of 21 tablet housing chambers 21 in three rows and seven rows. In other words, the width of the closing cover 25 is set so as to close the tablet housing chambers 21 in the rearmost-side row at the closed position.

When the closing cover 25 is set at the closed position (FIGS. 8C and 9B), the tablets can be housed in the tablet housing chambers 21 in three rows and seven columns (21 chambers in total), and thereby in a case of dosaging times being a multiple number of three, namely in the case of three times daily (morning, afternoon, evening) dosage, it is possible to execute the operation of manually distributing the tablets into the respective tablet housing chambers 21 in efficient and reliable manner without causing feeding error. On the other hand, when the closing cover 25 is set at the open position (FIGS. 8B and 9A), the tablets can be housed in the tablet housing chambers 21 in four rows and seven columns (28 chambers in total), and thereby in a case of the dosaging times being a multiple number of two, namely in the case of two times daily (morning, evening) dosage or four times daily (morning, afternoon, evening, bed time) dosage, it is possible to execute the operation of manually distributing the tablets into the respective tablet housing chambers 21 in efficient and reliable manner without causing feeding error.

With reference to FIG. 9A, on the upper surface of the tablet housing section 22, a first number-of-packs indicating section 101 is provided on the rear side of the rearmost-side row of the tablet housing chambers 21 (the front sides of the pin mechanisms 100A, 100B). Further, with reference to FIG. 9B, on the upper surface of the closing cover 25, a second number-of-packs indicating section 102 is provided in the vicinity of the front end thereof. As conceptually indicated by chain double-dashed lines in FIGS. 9A and 9B, in the operation of manually distributing the tablets, the tablets are typically fed sequentially in the row direction from the tablet housing chamber 21 in the rightmost-side column and the front-side (nearest-side) row toward the rear side (back side). When the tablets are fed into the tablet housing chambers 21 in this order, the number of packs in a case of feeding the tablets into all of the tablet housing chambers 21 (four chambers in FIG. 9A, and three chambers in FIG. 9B) constituting each of the columns is indicated in the number-of-packs indicating sections 101, 102. Specifically, multiple numbers of four, from 4 to 28, are indicated in the number-of-packs indicating section 101 on the upper surface of the tablet housing section 22, and multiple numbers of three, from 3 to 21, are indicated in the number-of-packs indicating section 102 on the upper surface of the closing cover 25. Referring to these number-of-packs indicating sections 101, 102 can further enhance efficiency of the manual distribution operation, and further reduce the possibility for the feeding error.

Along with the number-of-packs indicating sections 101, 102, or in place of the number-of-packs indicating sections 101, 102, serial numbers corresponding to the order of feeding the tablets may be indicated adjacently to the respective tablet housing chambers 21 on the upper surface of the tablet housing section 22.

With reference to FIG. 1 and FIGS. 8A to 8C, two sensors 27, 28 for detecting the opening/closing of the closing cover 25 are provided. The respective sensors 27, 28 are arranged at the base end of the closing cover 25. The sensors 27, 28 include magnetic bodies 27*a*, 28*a* that rotate around the pin mechanisms 100A, 100B along with the closing cover 25 and fixed sensor bodies 27*b*, 28*b* for detecting magnetism of the magnetic bodies 27*a*, 28*a* which are hall elements and the like. The magnetic bodies 27*a*, 28*a* of the two sensors 27, 28 are arranged in pin axes of the pin mechanisms 100A, 100B so as to have angle positions different from each other. The sensor bodies 27*b*, 28*b* of the two sensors 27, 28 are opposed to the corresponding magnetic bodies 27*a*, 28*b*, and arranged with the identical angle positions with respect to the pin axes of the pin mechanisms 100A, 100B. As described later in detail, providing the two sensors 27, 28 enables accurate detection of whether the closing cover 25 has been set at either the closed position or the open position and also enables prevention of erroneous determination of whether the closing cover 25 has been set at either the closed position or the open position even if failure of at least one of the sensors 27, 28 is occurred.

When the closing cover 25 is at the closed position as shown in FIG. 8C, the sensor 27 becomes an ON state where the magnetic body 27*a* and the sensor body 27*b* are at the closest positions to each other. When the closing cover 25 is at the open position as shown in FIG. 8B, the sensor 27 becomes an OFF state where the magnetic body 27*a* and the sensor body 27*b* are separated. Contrarily to this, when the closing cover 25 is at the open position as shown in FIG. 8B, the sensor becomes the ON state where the magnetic body 28*a* and the sensor body 28*b* are at the closest positions to each other. When the closing cover 25 is at the closed position as shown in FIG. 8C, the sensor becomes the OFF state where the magnetic body 28*a* and the sensor body 28*b* are separated. The configurations of the sensors 27, 28 are not limited to this example and any configurations may be employed so long as one sensor comes into the ON state when the closing cover 25 is at the closed position and comes into the OFF state when the closing cover 25 is at the open position, and the other sensor comes into the OFF state when the closing cover is at the closed position and comes into the ON state when the closing cover is at the open position.

Figure 8A:
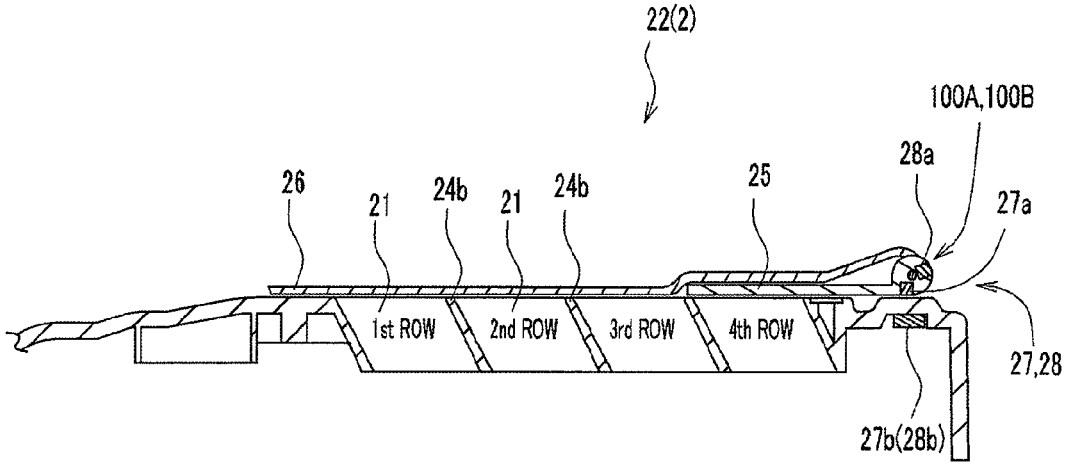
FIG. 8A is a partially sectional view of the tablet supply unit with a closing cover and a protection cover closed.
Figure 8B:
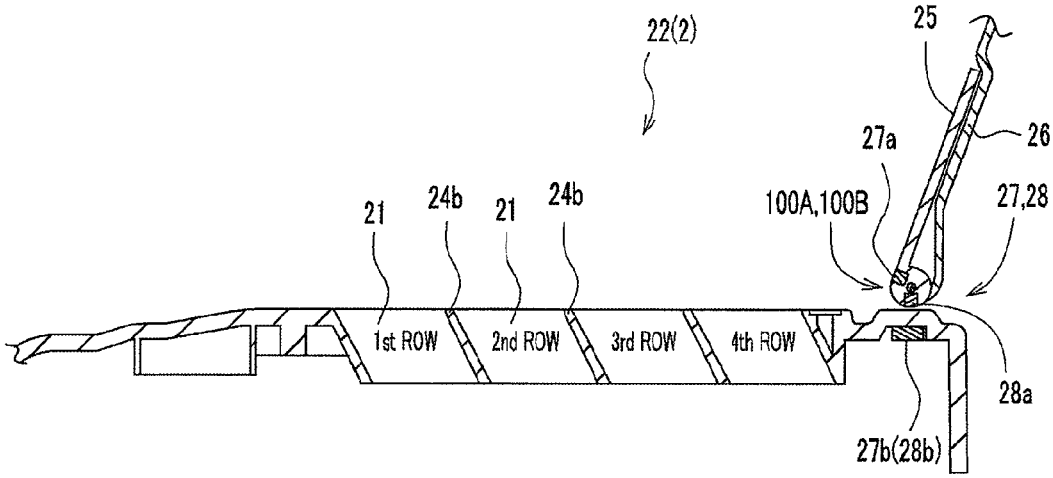
FIG. 8B is a partially sectional view of the tablet supply unit with the closing cover opened.
Figure 8C:
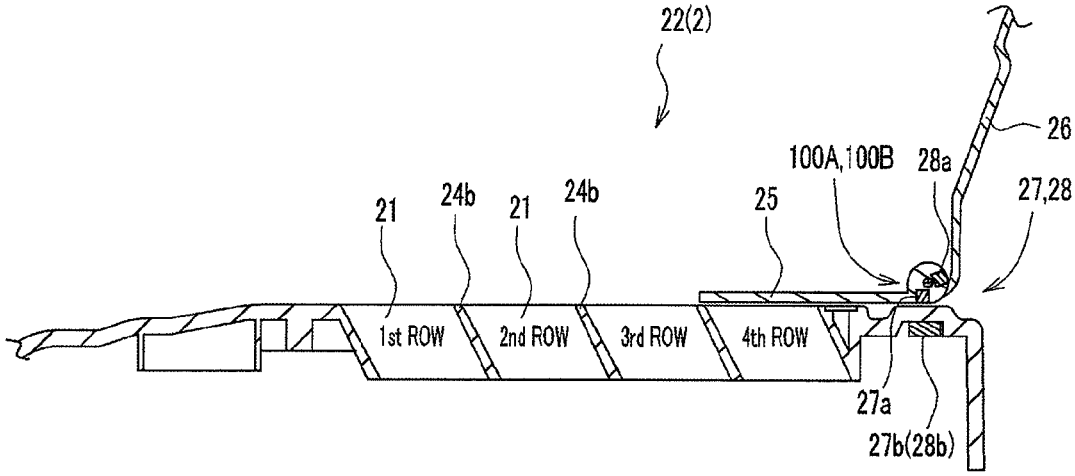
FIG. 8C is a partially sectional view of the tablet supply unit with the closing cover closed.
Figure 8D:
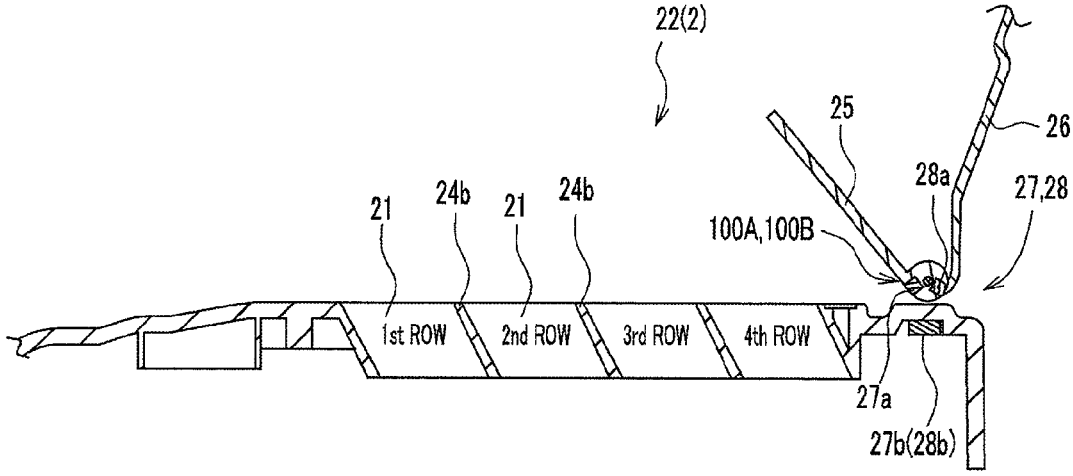
FIG. 8D is a partially sectional view of the tablet supply unit with the closing cover half-opened.
Figure 9A:
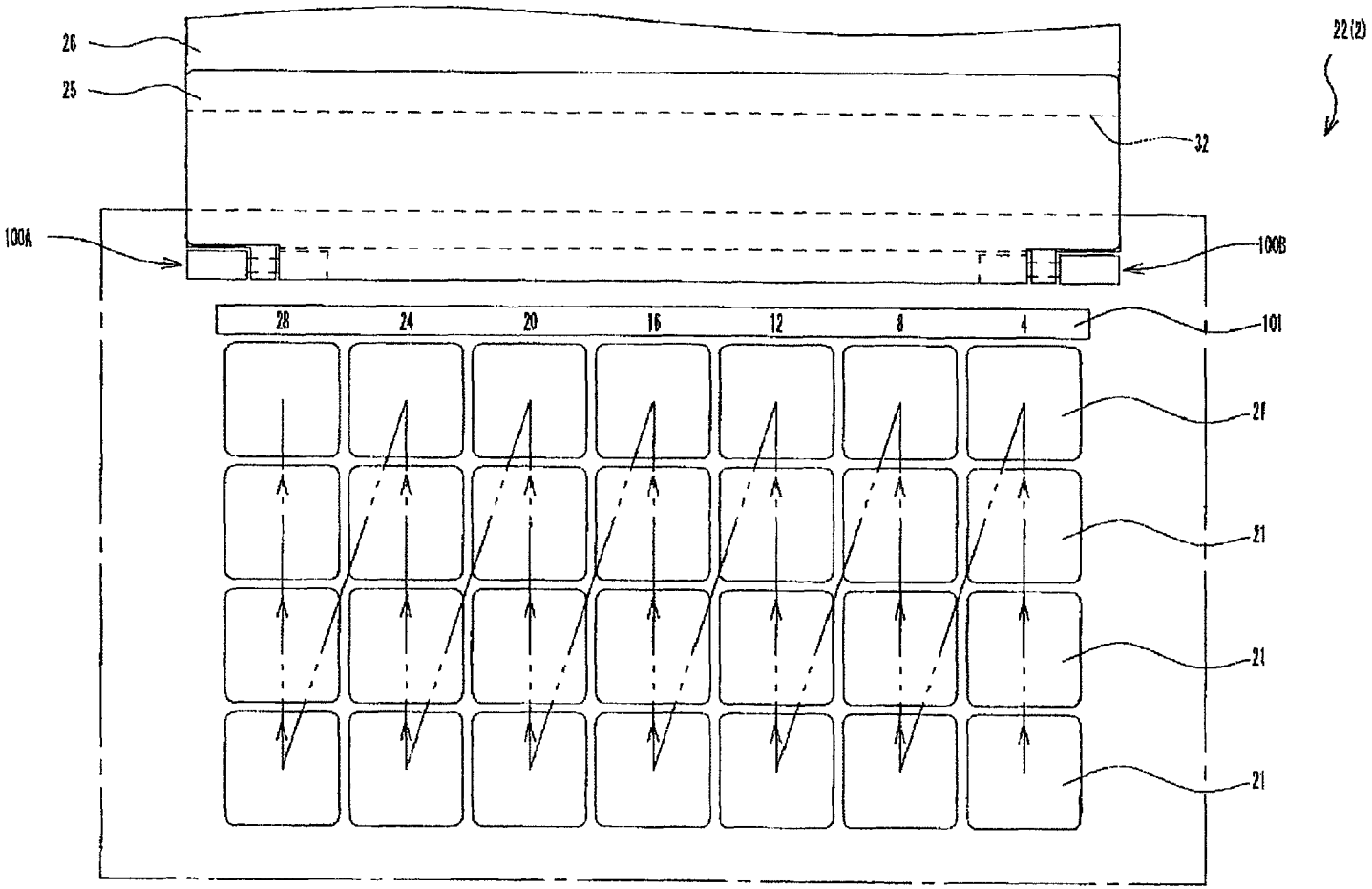
FIG. 9A is a plan view showing the tablet supply unit with the closing cover opened.
Figure 9B:
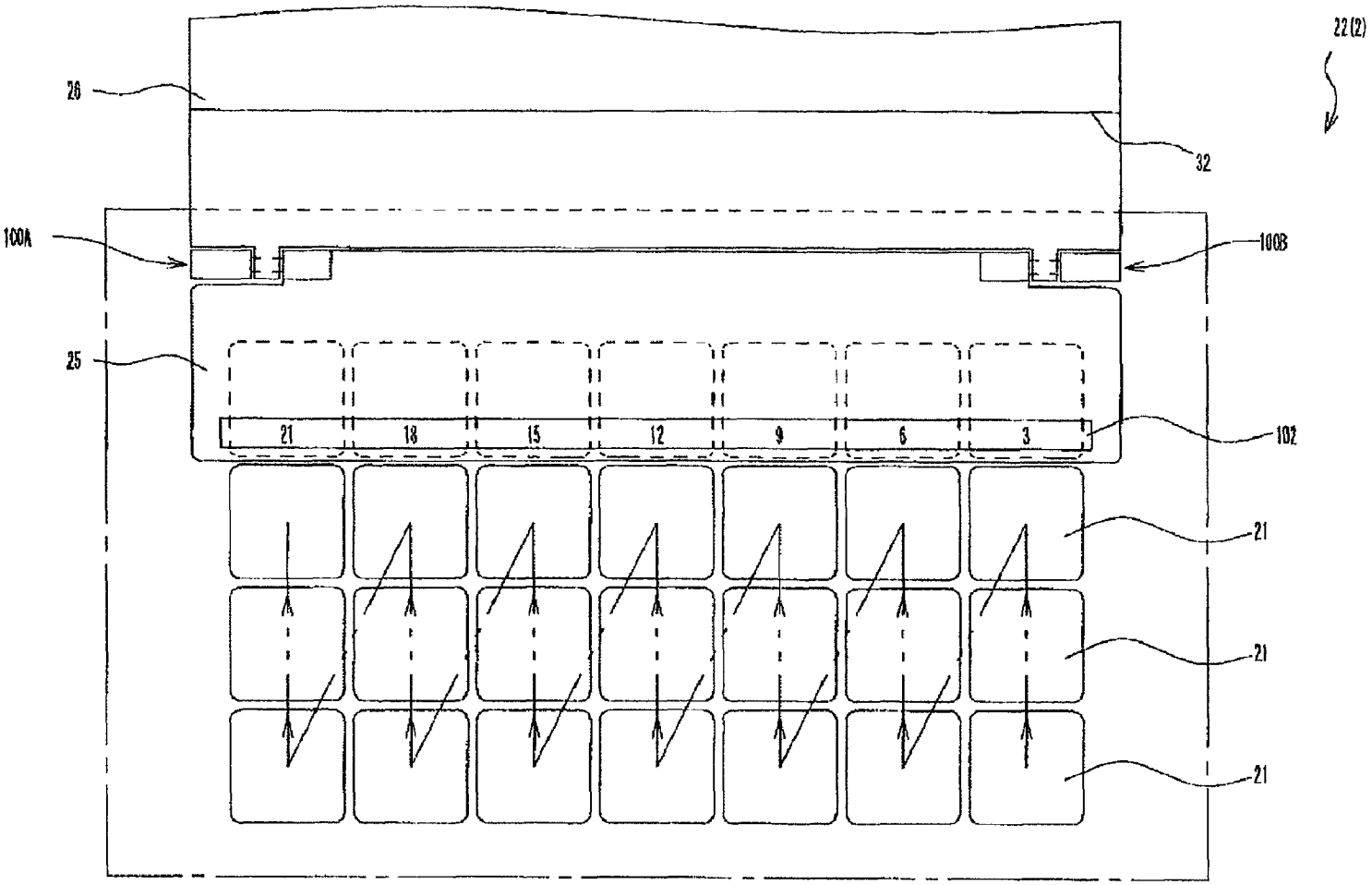
FIG. 9B is a plan view showing the tablet supply unit with the closing cover closed.
Figure 10:
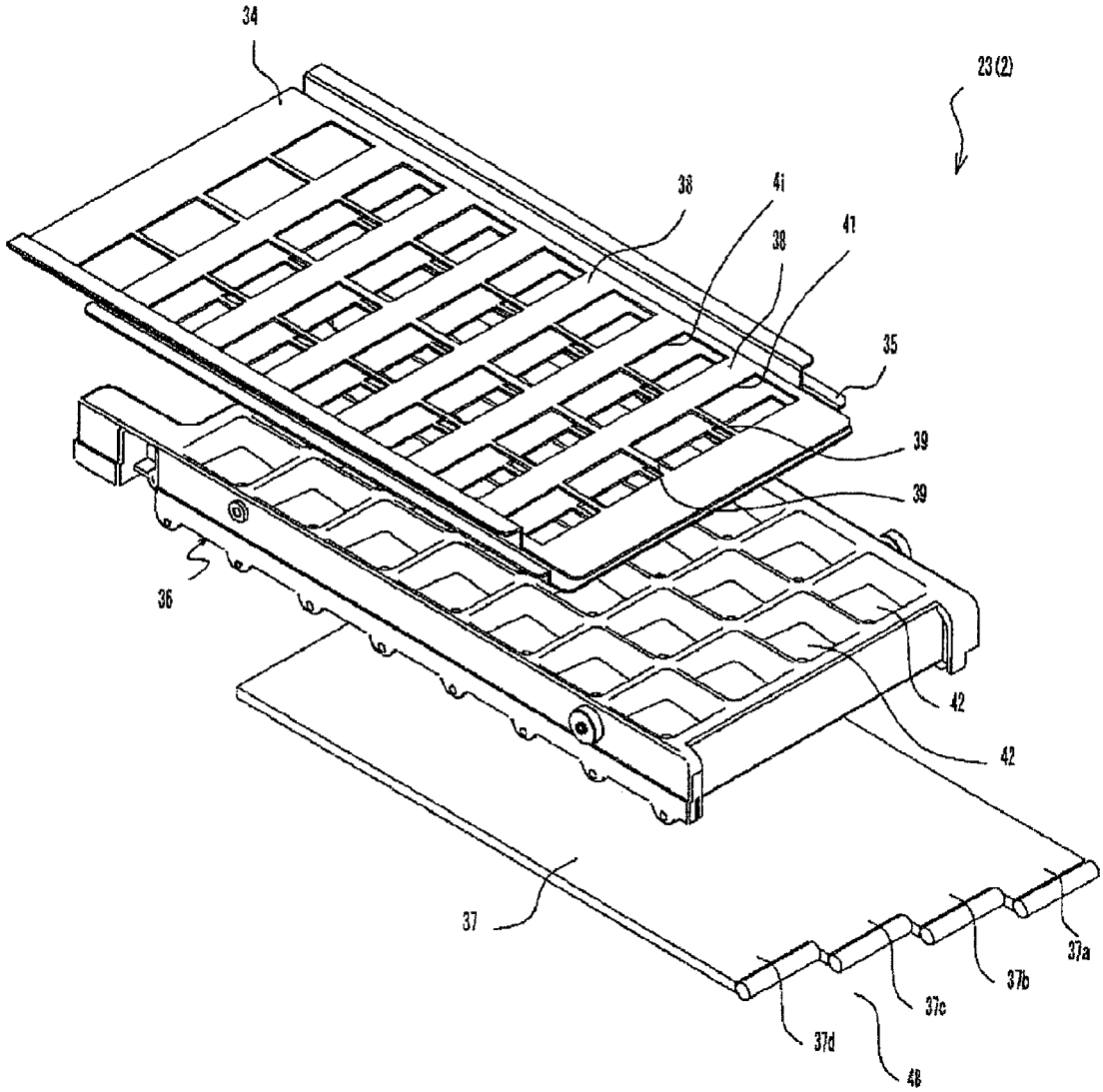
FIG. 10 is an exploded perspective view of a tablet discharging section.

With reference to FIGS. 8A and 8C, the protection cover 26 is settable at the open position (FIGS. 8B and 8C) and at the closed position (FIG. 8A) by being rotated around the pin mechanism 100A, 100B when the closing cover 25 is at the closed position. When the protection cover 26 is at the closed position, the upper end openings 21*a* of all of the tablet housing chambers 21 are covered by the protection cover 26. Therefore, when the tablet supply unit 2 is not used, the protection cover 26 is set at the closed position so as to reliably prevent approach of dust and the like to the tablet housing chambers 21.

With reference to FIGS. 1, 2, 9A and 9B, an inner surface of the protection cover 26 is provided with a display 32 for indicating the use of the tablet housing chamber 21 of all four rows. The display 32 is positioned so as to be hidden behind the closing cover 25 at the open position (FIG. 9A) and to be visible when the closing cover 25 is at the closed position (FIG. 9B). This facilitates that the operator visually checks whether the tablet housing chambers 21 of the tablet supply unit 2 are in a state corresponding to the "three times daily dosage" or in a state corresponding to the "two times daily dosage" or "four times daily dosage".

With reference to FIGS. 5A to 5C and FIG. 10, the tablet discharging section 23 of the tablet supply unit 2 includes an upper shutter plate 34 arranged under the tablet housing section 22, a lower shutter plate 35 arranged in a state of being mutually superimposed under the upper shutter plate 34, a movable discharging member 36 arranged under the lower shutter plate 35, and a fixing plate 37 arranged under the discharging member 36.

Figure 5A:
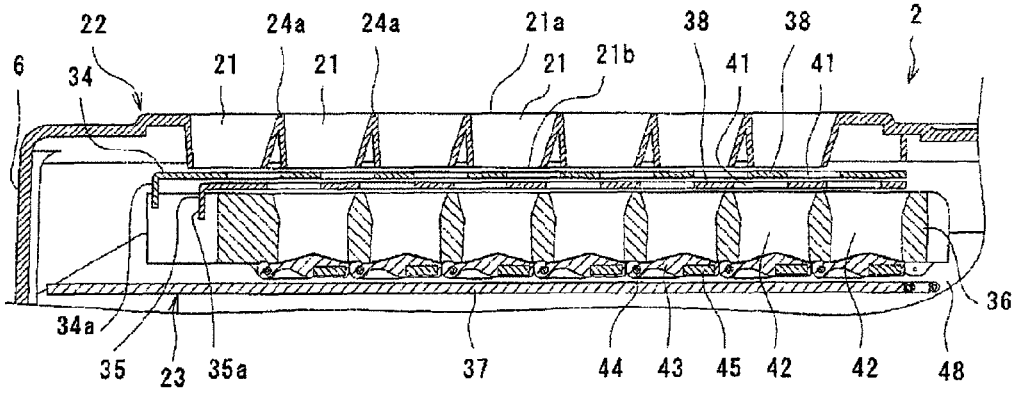
FIG. 5A is a partially sectional view of a tablet supply unit with a shutter closed.
Figure 5B:
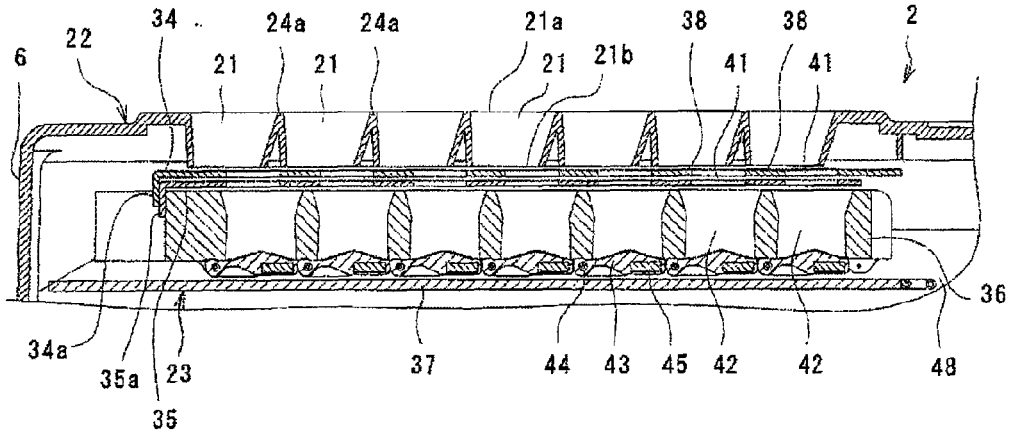
FIG. 5B is a partially sectional view of the tablet supply unit while the shutter being opened.
Figure 5C:
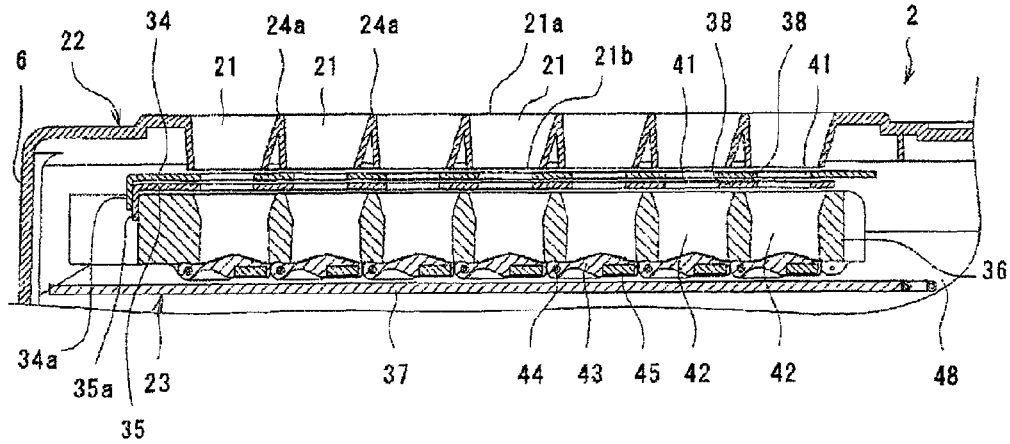
FIG. 5C is a partially sectional view of the tablet supply unit with the shutter opened.

The upper and lower shutter plates 34, 35 are movable in the column direction of the arrangement of the tablet housing chambers 21, while holding the mutually superimposed state. In each of the upper and lower shutter plates 34, 35, a total of 28 tablet passage holes 41 are formed in four rows and seven rows. The tablet passage holes 41 are defined by first partition sections 38 extending in the row direction of the arrangement of the tablet housing chambers 21 and second partition sections 39 extending in the column direction of the arrangement of the tablet housing chambers 21 and respectively correspond to the tablet housing chambers 21. Further, the left-side ends of the upper and lower shutter plates 34, 35 in FIGS. 5A to 5C are provided with downwardly folded engaging sections 34*a*, 35*a*. Moreover, the upper shutter plate 34 is connected to the tablet housing section 22 by a spring (not shown) so as to be elastically biased rightward in FIGS. 5A to 5C. Furthermore, the lower shutter plate 35 is connected to the upper shutter plate 34 by a spring (not shown) so as to be elastically biased rightward in FIGS. 5A to 5C. In an initial state where external force does not act upon the upper and lower shutter plates 34, 35, the upper and lower shutter plates 34, 35 are at positions shown in FIG. 5A.

The discharging member 36 is reciprocatingly movable in the column direction of the arrangement of the tablet housing chambers 21 by a driving device including a pinion-rack mechanism and a motor. The discharging member 36 is provided with a total of 28 tablet discharging chambers 42 in four rows and seven columns corresponding to the tablet housing chambers 21 of the tablet housing section 22. Both of the upper and lower ends of the tablet discharging chambers 42 are open. Openable and closable bottom plates 43 are arranged at the openings on the lower end side of the respective tablet discharging chambers 42. One end of the bottom plate 43 is rotatably supported by a pin 44 with respect to the discharging member 36 and has a weight 45 for opening embedded in the other end side.

The bottom plates 43 of the tablet discharging chambers 42 are placed on the upper surface of the fixing plate 37 and thereby the bottom plates 43 are held at a closed position. Further, the right-side end of the fixing plate 37 in FIGS. 5A to 5C and FIG. 10 is provided with stages 37*a* to 37*d* in identical number to the number of rows of the tablet housing chambers 21 and the tablet discharging chambers 42 (four rows in this embodiment). A Gap between the adjacent two of the stages 37*a* to 37*d* corresponds to a value obtained by dividing formation pitches in the column direction of the tablet housing chambers 21 and the tablet discharging chambers 42 by the number of rows of the tablet housing chambers 21 and the tablet discharging chambers 42.

Figure 11:
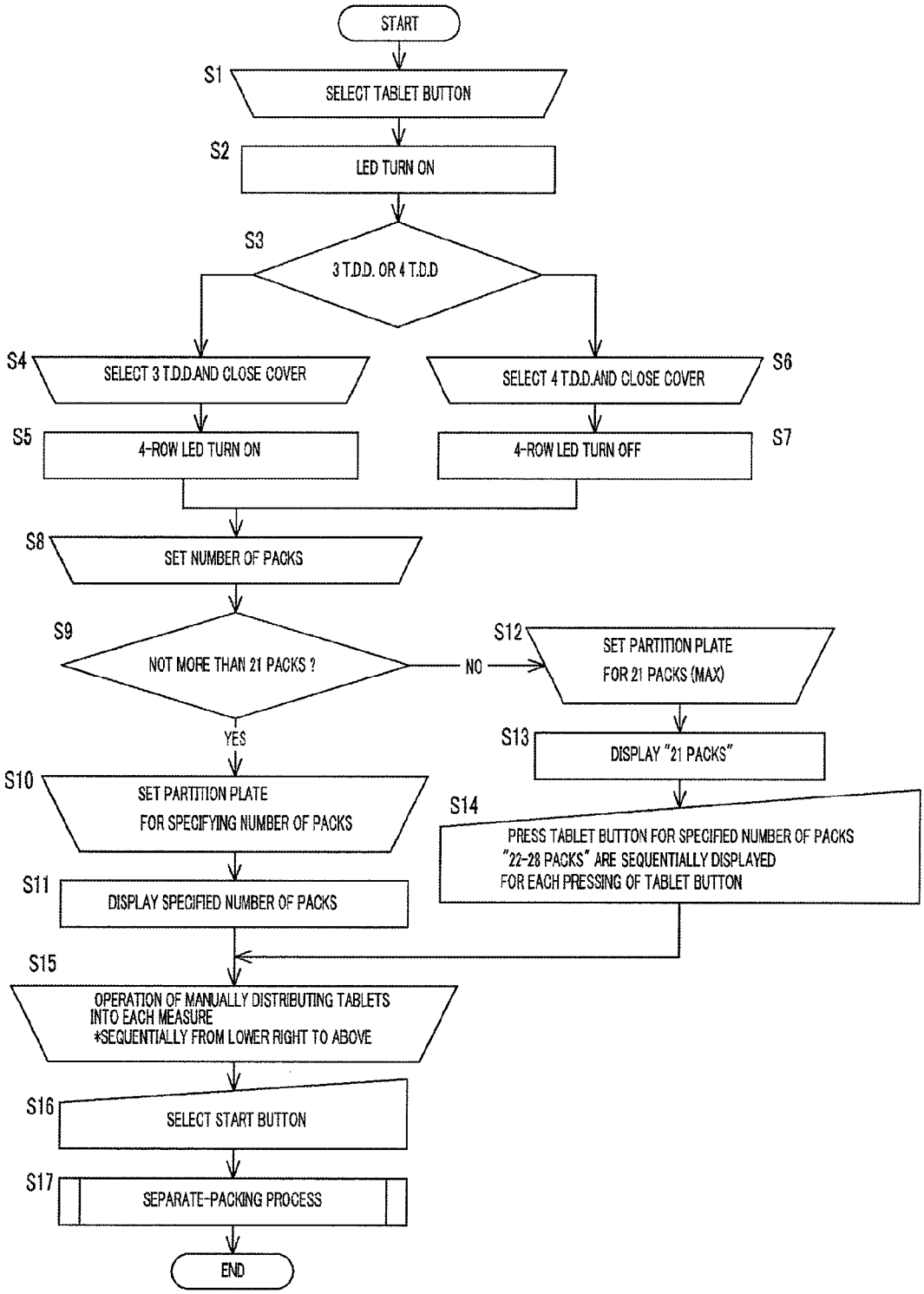
FIG. 11 is a flow chart for explaining the operation of the tablet supply unit.

Next, with reference to a flowchart of FIG. 11, the operation of the tablet supply unit 2 is described. First, in step S1, a tablet button 9*a* on the control panel 9 (hereinafter, refer to FIG. 3 in regard to buttons, LEDs, and the like) is selected, and in step S2, an LED corresponding to the tablet button 9*a* is turned on. Next, in step S3, either "three times daily dosage" or "four times daily dosage" is selected. Specifically, in a case of selecting the "three times daily dosage", in step S4, the closing cover 25 is manually set at the closed position (FIGS. 8C and 9B), and in step S5, an LED 9*b* indicating the use of the tablet housing chambers 21 of four rows is turned off. Further, in a case of selecting the "four times daily dosage", in step S6, the closing cover 25 is manually set at the open position (FIGS. 8B and 9A), and in step S6, the LED 9*b* is turned on.

Subsequently, in step S8, the number of packs is set, and in step S9, when the number of packs to be set is not larger than 21, partitioning plates 52 of a later-mentioned V-chamber 51 is moved to a position corresponding to the number of packs to be set. The positions of the partitioning plates 52 are detected by the sensor and outputted to the controller 11 of the tablet supply unit 2. The specified number of packs is indicated in a number-of-packs indicating section 9*c* of the control panel 9 in step S21. Meanwhile, in step S9, when the number of packs to be set is not smaller than 21, the number of packs in the partitioning plates 52 of the V-chamber 51 is set to 21 as the maximum value, and in step S13, "21" is indicated as the number of packs in the number-of-packs indicating section 9*c* of the control panel 9. In step S14, every time the tablet button 9*a* of the control panel 9 is pressed, the number of packs from "22" to "28" as the maximum number of packs of the tablet supply unit 2 is sequentially indicated as the number of packs at the number-of-packs indicating section 9*c*.

Next, in step S15, the tablets are fed from the upper end openings 21*a* by the manual distribution operation and the tablets are housed in the respective tablet housing chambers 21. At this time, the tablets are fed sequentially in the row direction from the tablet housing chamber 21 in the right-most-side column and the front-side (nearest-side) row toward the rear side (back side).

Upon completion of the manual distribution operation, when a start button 9*d* of the control panel 9 is selected in step S16, in step S17, the tablet discharging section 23 is operated to send the tablets supplied from the tablet housing section 22 to a hopper 67 of the packaging unit 4 through a carrier channel (not shown) one-by-one dose and separate packing processing is executed in the packaging unit 4.

In step S16, when detecting that the closing cover 25 is in an unstable state at the time of selection of the start button 9*d*, the controller 11 outputs an error sound and also inhibits the tablet discharging section 23 from starting its operation to stop supply of the tablet to the packaging unit 4. Specifically, when the one sensor 27 is in the ON state and the other sensor 28 is in the OFF state, the controller 11 determines that the closing cover 25 has been accurately set at the closed position (FIG. 8C), and operates the tablet discharging section 23. Further, when the one sensor 27 is in the OFF state and the other sensor 28 is in the ON state, the controller 11 determines that the closing cover 25 has been accurately set at the open position (FIG. 8B), and operates the tablet discharging section 23. However, when both of the two sensors 27, 28 are in the ON state or in the OFF state, the controller 11 determines that the closing cover 25 is in the unstable state of being neither at the closed position nor the open position (FIG. 8D) or that a failure has occurred in at least one of the sensors 27, 28, and thus inhibits the tablet discharging section 23 from starting its operation. When the closing cover 25 is in an unstable form, the tablet discharging section 23 is inhibited from starting its operation so as to reliably prevent the tablets housed in the respective tablet housing chambers 21 in inadequate manner from being erroneously packaged in the packaging unit 4.

In the following, the operation of the tablet discharging section 23 in the pack distribution processing in step S17 is described in detail. First, before selection of the start button 9*d*, namely during non-activation, the tablet discharging section 23 is in a state shown in FIG. 5A. Specifically, the upper and lower shutter plates 34, 35 are in a retaining position where lower end openings 21*b* of the respective tablet housing chambers 21 are closed by the first partition sections 38 of the upper shutter plate 34 and the first partition sections 38 of the lower shutter plate 35.

When the start button 9*d* is selected, the discharging member 36 moves in the left direction (row direction) in the figure as shown in FIG. 5B on the condition that the closing cover 25 has been accurately set at the closed position or the open position, that the closing cover 25 has not been set in the unstable state, and that no failure has occurred in the sensors 27, 28. One end of the discharging member 36 is hooked onto a engaging section 35*a* of the lower shutter plate 35, resulting in that the lower shutter plate 35 also moves in the left direction along with the discharging member 36. Further movement of the discharging member 36 in the left direction in the figure causes that the one end of the discharging member 36 is hooked onto a engaging section 34*a* of the upper shutter plate 34 through the engaging section 35*a* of the lower shutter plate 35, resulting in that the upper shutter plate 34 also moves in the left direction along with the discharging member 36.

With the move of the upper and lower shutter plates 34, 35 along with the discharging member 36, the tablet discharging section 23 becomes a state shown in FIG. 5C. Specifically, as for the upper and lower shutter plates 34, 35, the first partition sections 38 of the upper shutter plate 34 are receded to the lower side of the first partition walls 24*a* of the tablet housing section 22 and the first partition sections 38 of the lower shutter plate 35 are receded to the lower side of the first partition sections 38 of the upper shutter plate 34, resulting in that the tablet passage holes 41, 42 in the upper and lower shutter plates 34, 35 come to the open position where the holes are respectively opposed to the lower end openings 21*b* of the tablet housing chamber 21. Further, when the upper and lower shutter plates 34, 35 are at the open position, the openings on the upper end side of the tablet discharging chambers 42 of the discharging member 36 become a state of being respectively opposed to the respective lower end openings 21*b*. Therefore, the tablets for each one dose which are housed in the tablet housing chambers 21 are housed into the tablet discharging chambers 42 of the discharging member 36 passing through the tablet passage holes 41, 41.

Next, the discharging member 36 moves in the right direction in the figure, resulting in that the bottom plates 43 of the tablet discharging chambers 42 sequentially reach the dropping port 48 located ahead of the stages 37*a* to 37*d* starting from the tablet discharging chamber 42 on the front side in the moving direction so that support for the bottom plates 43 is eliminated and the bottom plates 43 are opened. As a result, the tablets inside the respective tablet discharging chambers 42 are sequentially supplied into the hopper 67. In the case of the "four times daily dosage", the discharging member 36 constantly moves intermittently in the right direction in an amount corresponding to the steps. However in the case of the "three times daily dosage", since no tablet is housed inside the tablet discharging chambers 42 corresponding to the uppermost-side row, the moving amount of the discharging member 36 is set to twice as large as the step in the next intermittent movement after each of the third, sixth, ninth, twelfth, fifteenth, . . . tablet discharging chambers 42 has reached the dropping port 48.

Since the lower end openings 21*b* are closed by the first partition sections 38 of the two shutter plates, namely the upper and lower shutter plates 34, 35, the widths of the first partition sections 38 of the respective upper and lower shutter plates 34, 35 can be set narrow. Thereby, the width of the first partition wall 24*a* of the tablet housing section 22, to which the first partition section 38 is receded at the open position, can be set narrow, resulting in reduction in the size of the tablet supply unit 2. By the reduction in the size of the tablet supply unit 2, reduction in size of the medicine packaging apparatus 1 as a whole can be achieved.

(Powdered Medicine Supply Unit)

The powdered medicine supply unit 3 is manually supplied with powdered medicines, automatically divides the powdered medicines for each dosage, and sequentially supplies the divided medicines to the packaging unit 4.

With reference to FIGS. 1 and 2, the powdered medicine supply unit 3 includes a long chamber that is open to the upper surface of the medicine discharge section 5 and has a roughly V-shaped cross section (V-chamber 51). The bottom section of the V-chamber 51 is openable and closable. Further, a plurality of dividing containers (not shown) is arranged below the V-chamber 51. When the bottom sections are opened, powdered medicines has been fed into the V-chambers 51 drop into the dividing containers to be divided into a predetermined amount. The bottom sections of the dividing containers are also openable and closable. By sequentially opening the bottom sections of the dividing containers, the powdered medicines inside the respective dividing containers drop into the hopper 67, and are supplied to the packaging unit 4 one-by-one dose. Further, a movable partitioning plate 52 for adjusting the number of powdered medicines to be divided are arranged.

The configuration of the powdered medicine supply unit 3 is not particularly limited so long as powdered medicines can be supplied to the packaging unit 4 one-by-one dose. For example, the powdered medicine supply unit 3 may have a distribution plate with an outer peripheral circular groove to which the powdered medicines are fed from a hopper. A scraping out apparatus sequentially scrapes out the powdered medicines one-by-one dose from outer peripheral circular groove to supply them to the packaging unit 4.

(Packaging Unit)

In the following, the packaging unit 4 is described with reference to FIGS. 12 to 23. The packaging unit 4 is provided with a sheet supply section 63, a unfolding guide 65, a hopper 67, a heat sealing section 68, and a printing section 69 on a holding frame 71. The sheet supply section 63 rolls out and feeds a long and narrow package sheet 61 previously folded into two parts along with the longitudinal direction from a roll 62 on which the package sheet 61 is wound. The unfolding guide 65 unfolds and opens the two-folded package sheet 61 fed from the sheet supply section 63. The hopper 67 has an inlet opening 67*b* into which medicine is fed from the tablet supply unit 2 and the powdered medicine supply unit 3 in its upper end, and is equipped with a nozzle section 67*a* which functions as a feed port for introducing the medicine into the opening of the two-folded package sheet 61 in its lower end. The heat sealing section 68 seals the package sheet 61 so as to enclose the introduced medicine, by which continuous medicine bags are prepared. The continuous medicine bags prepared by the heat sealing section 68 are cut off by a cutter mechanism 201 schematically shown only in FIGS. 32 and 33 so as to be divided into each dose. The printing section 69 is placed between the sheet supply section 63 and the unfolding guide 65 along the path of the package sheet 61 to print information including a name of patient, a medicine name, and directions for use, onto the package sheet 61. As mentioned above, the operation of the packaging unit 13 is controlled by the controller 13.

Figure 14:
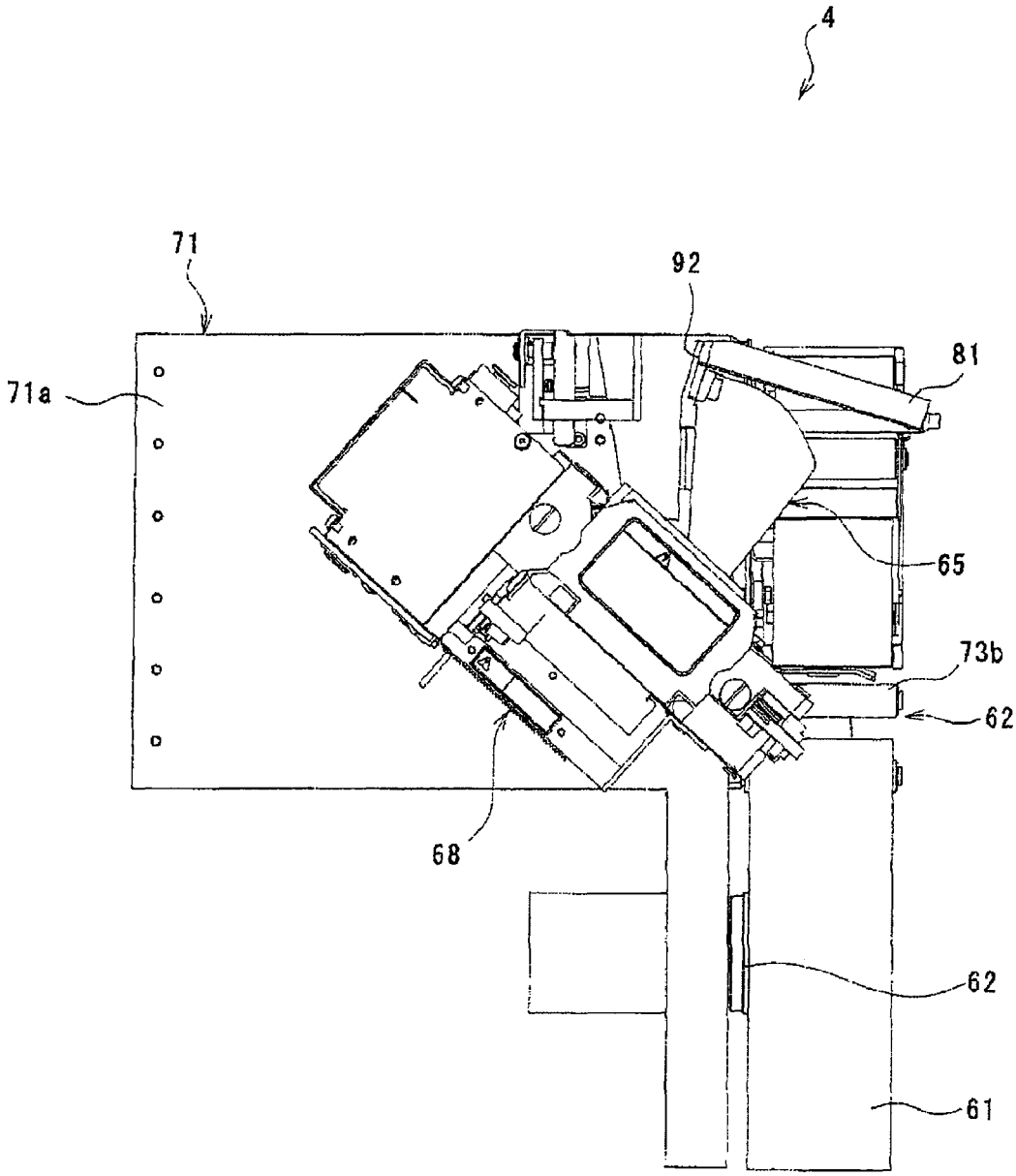
FIG. 14 is a front view of the packaging unit.

With reference to FIGS. 12 to 16, the packaging unit 4 is provided in a holding frame 71 arranged in the housing space 7 of the housing 6. The holding frame 71 includes a front holding section 71*a* extending on a front side of the housing 6, a side holding section 71*b* extending from a right side to a rear side seen from the front side of the front holding section 71*a*, and a hinge mechanism 72 rotatably connecting the side-end side on the left side seen from the front side of the front holding section 71*a* to the housing 6 (further refer to FIGS. 17 and 18). Such a configuration achieves favorable operability as described later in detail, while allowing a compact housing of the packaging unit 4 inside the housing 6. A base plate (not shown) is provided at a position immediately above the top of the holding frame 71 (refer to. FIG. 14), and the tablet supply unit 2 and the powdered medicine supply unit 3 are arranged on this base plate. As seen from the above, providing the packaging unit 4 on the holding frame 71 enables compact housing of the packaging unit 4 inside the housing 6 having a limited vertical space.

The roll 62 for the package sheet 61 is arranged in a lower region of the side holding section 71*b* of the holding frame 71. Further, the side holding section 71*b* of the holding frame 71 is provided with two guide rollers 73*a*, 73*b* that constitute part of the sheet supply section 63. A rotational center of the roll 62 and the guide rollers 73*a*, 73*b* extends in a direction substantially orthogonal to the side holding section 71*b* (direction in which the front holding section 71*a* extends). Further, the printing section 69 is arranged above the guide rollers 73*a*, 73*b* of the side holding section 71*b* of the holding frame 71. The package sheet 61 is wound off from the roll 62 to the rear side, horizontally folded by the one guide roller 73*a* to the front side, and further diverted upward by the other guide roller 73*b* to be guided to the printing section 69. A collar-like section may be provided at the tip of the guide rollers 73*a*, 73*b* for preventing meandering and fallout of the package sheet 61.

The printing section 69 includes a replaceable ink cartridge 76 having a winding-off roller and a winding-up roller for thermal transfer ink ribbon, a biasing roller 77 that adds stress to the ink ribbon 75, a thermal transfer head 78, and a backup roller 79 for closely contacting the package sheet 61 to the ink ribbon 75 in a portion of the thermal transfer head 78.

Figure 12:
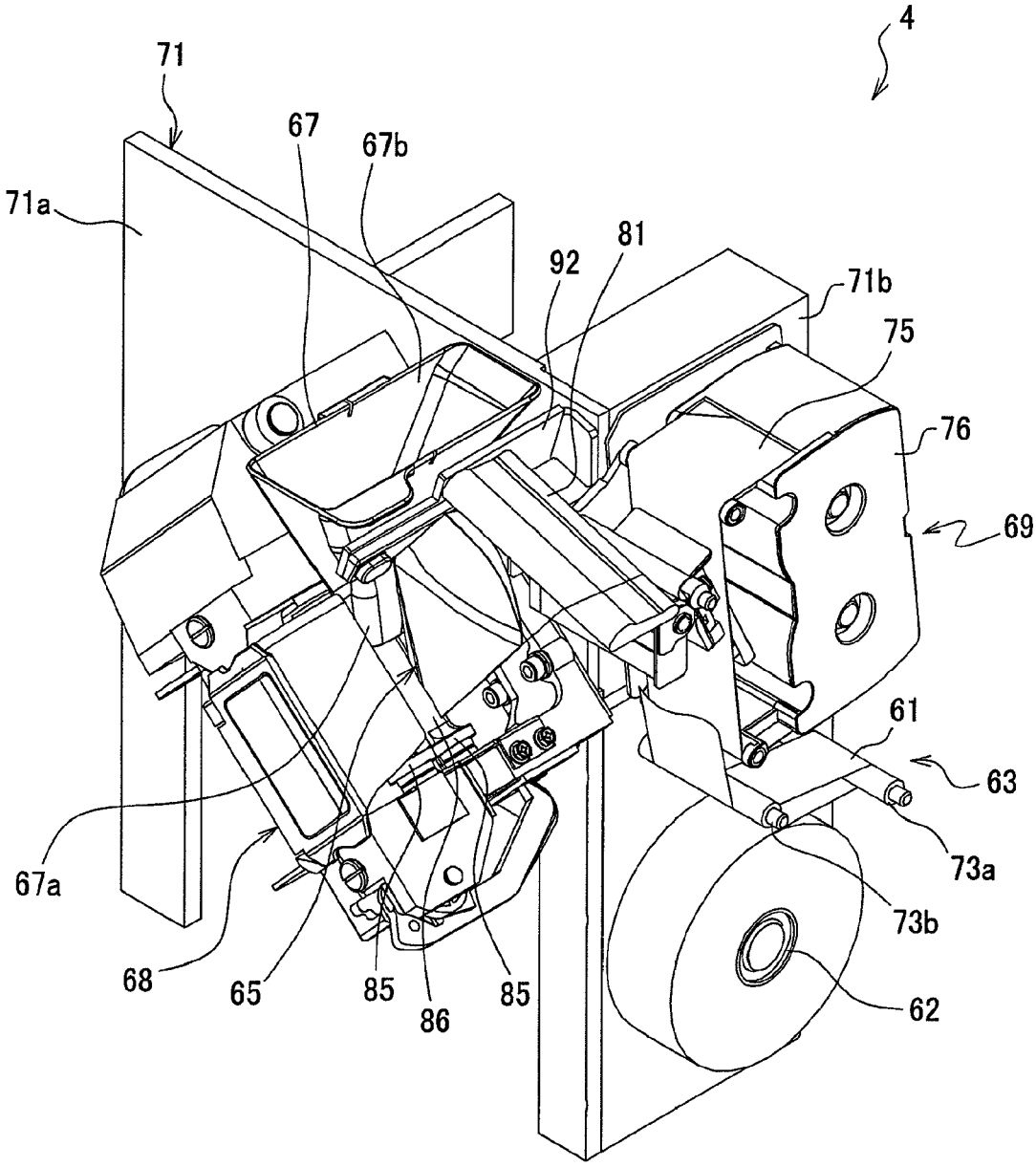
FIG. 12 is a perspective view for showing a packaging unit from the upper lateral side.
Figure 13:
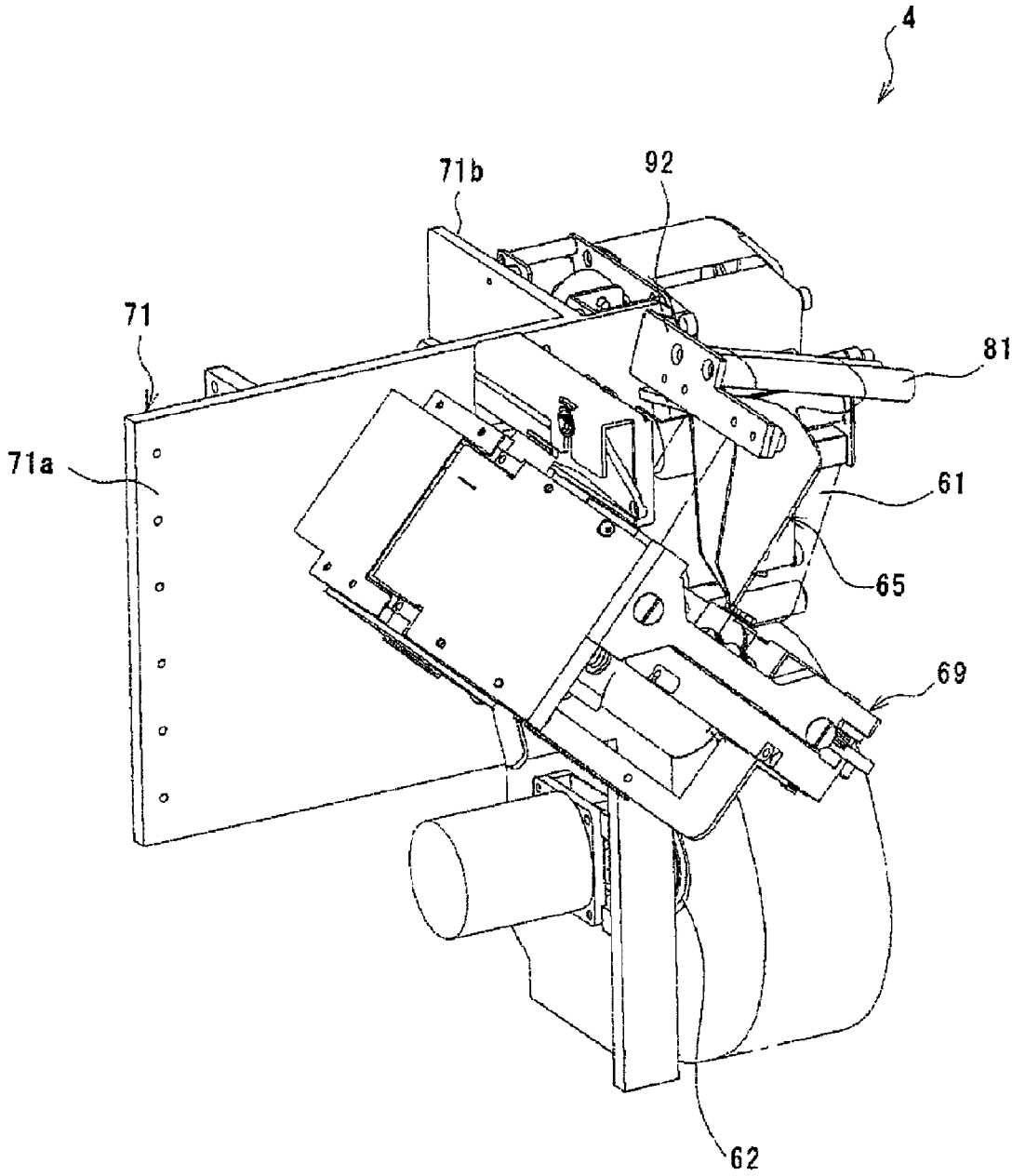
FIG. 13 is a perspective view for showing the packaging unit from the upper front side.

In a portion on the upper side of the front holding section 71*a* of the holding frame 71 and on the right end side seen from the front side, a fixed guide rod 81 (a curved guide constituting a part of the sheet supply section 63) is placed which curves the conveying direction of the package sheet 61 which passed the printing section 69 just before the unfolding guide 65 (see FIG. 12 in particular). More specifically, the guide rod 81 curves the conveying direction of the package sheet 61, which travels from the back side to the front side along with the side holding section 71*b*, toward the front side of the front holding section 71*a*, and guides the package sheet 61 to diagonally downward as seen from the front side of the front holding section 71*a*. The guide rod 81 extends from the front holding section 71*a* to the direction in which the front holding section 71*a* stretches and also to the direction slantingly downward. As most clearly shown in FIG. 12, the direction in which a side edge of the guide rods 81 extends on the downstream side of the conveying direction of the package sheet 61 is identical to the direction in which a later-described main ridge 94 of the unfolding guide 65 extends.

A unfolding guide 65 is placed on the front holding section 71*a* of the holding frame 71 on the left oblique downward side of the guide rod 81 as seen from the front (on the downstream side of the conveying direction of the package sheet 61). The unfolding guide 65 will be described in detail later. The hopper 67 is held on the front holding section 71*a* of the holding frame 71, and the nozzle section 67*a* on the lower end of the hopper 67 is positioned on the left oblique downward side of the unfolding guide 65 as seen from the front. Further on the front holding section 71*a* of the holding frame 71, the heat sealing section 68 is placed in an oblique downward position from the nozzle section 67*a* of the hopper 67 as seen from the front.

Figure 15:
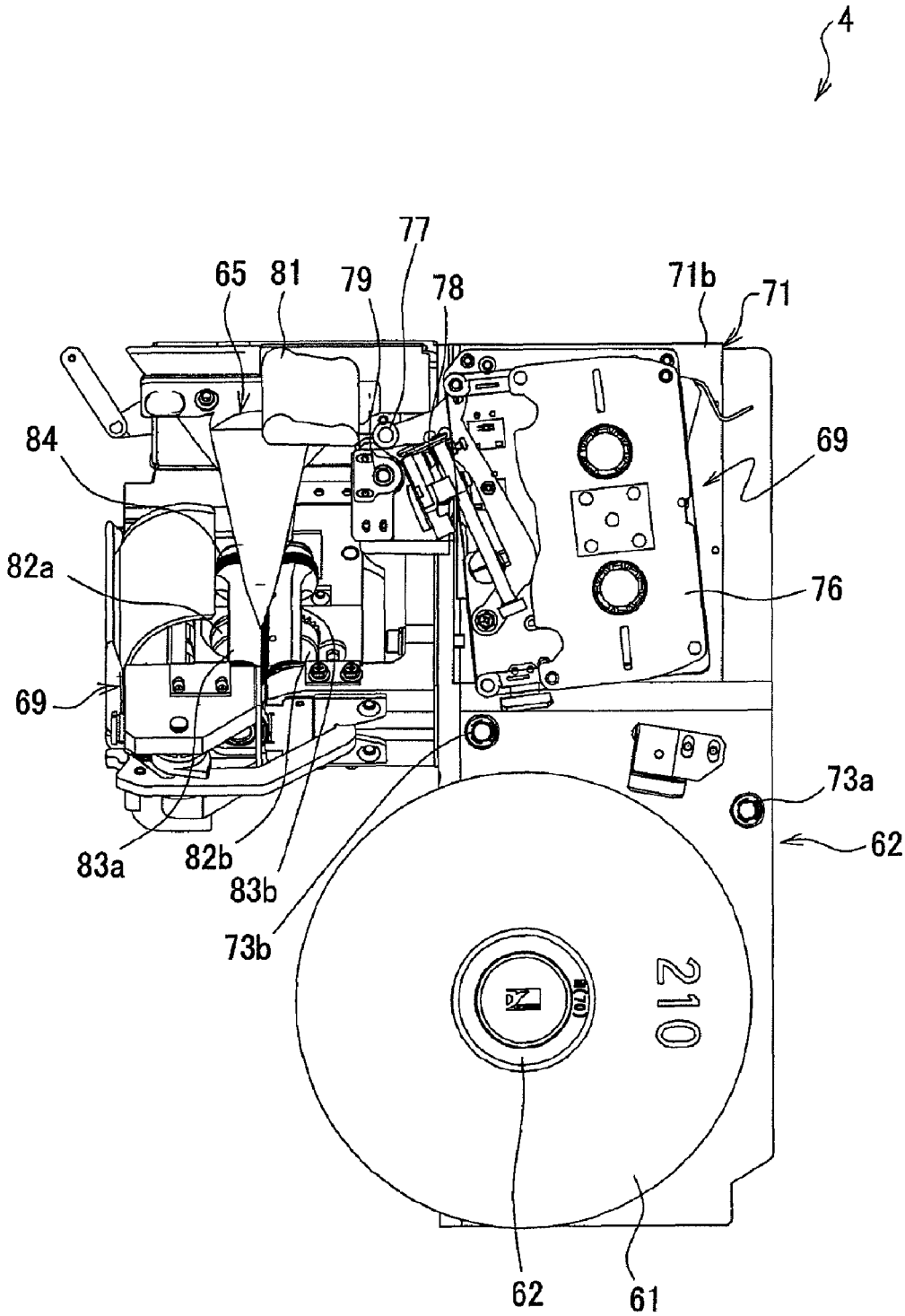
FIG. 15 is a side view of the packaging unit.
Figure 16:
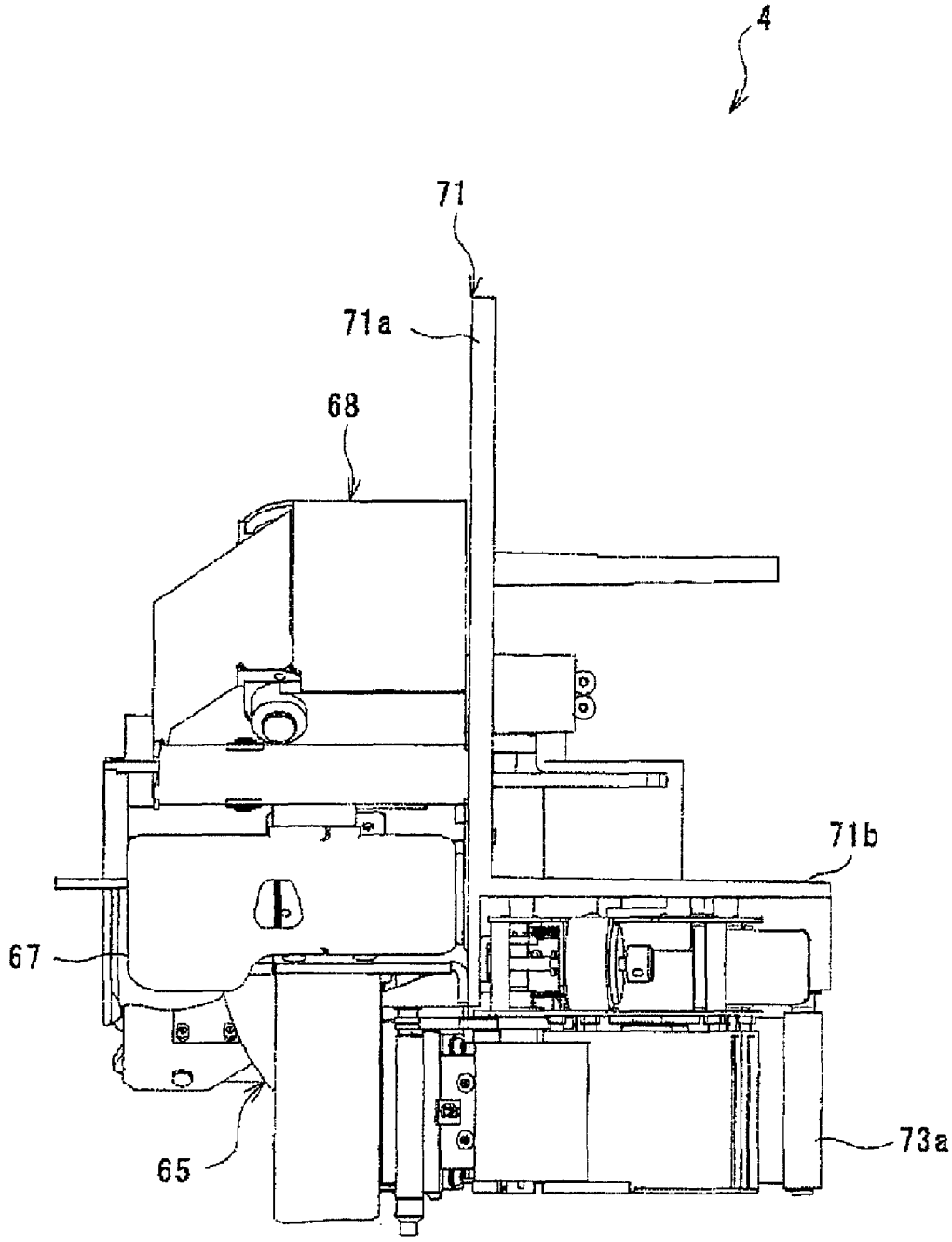
FIG. 16 is a plan view of the packaging unit.

With reference to FIGS. 12 and 15, the heat sealing section 68 includes a pair of feed rollers 82*a*, 82*b* which is intermittently rotatably driven by a driving mechanism (not shown) including a motor, a direct driven gear, an intermittent gear, and the like. The package sheet 61 is sandwiched between the feed rollers 82*a*, 82*b*, and carried by intermittent rotation of the feed rollers 82*a*, 82*b*. Further, a pair of heater rollers 83*a*, 83*b* is provided on the upstream side of the carrying direction of the package sheet 61 with respect to the feed rollers 82*a*, 82*b*. Each of the heater rollers 83*a*, 83*b* has: a disk-shaped feed heat sealing member 84; and a thin rectangular plate-shaped longitudinal heat sealing member 86 formed on the bottom integrally with a roller member 85 having the same diameter as that of the feed heat sealing member 84. The feed heat sealing members 84, 84 are rotatably driven by a driving mechanism (not shown) including the common motor with the motor for the feed rollers 82*a*, 82*b*. The longitudinal heat sealing members 86, 86 are rotatably driven by a driving mechanism different from the mechanism for the feed heat sealing members 84, 84. A longitudinal seal (horizontal seal) is formed at the side edge of the package sheet 61 between the feed heat sealing members 84, 84. A seal across the package sheet 61 (vertical seal) is formed by the longitudinal heat sealing members 86, 86 of the heater roller 83*a*, 83*b*.

Also with reference to FIGS. 19 to 24, the unfolding guide 65 will be described in detail. The unfolding guide 65 is provided with a guide main body 91 having a function to develop or unfold the two-folded package sheet 61 and to form an opening for inserting the nozzle section 67*a* of the hopper 67, and a long and narrow plate-shaped attaching section 93 for fixing the guide main body 91 to the front holding section 71*a* of the holding frame 71 via a bracket 92. The unfolding guide 65 is screwed to the bracket 92 with screws (not shown) inserted into through holes 93*a*, 93*b* of the attaching section 93, respectively.

The guide main body 91 of the unfolding guide 65 has a main ridge 94 extending along with the fold of the package sheet 61, a pair of unfolding guide surfaces 90*a*, 90*b* which are convex curved surfaces stretching from the main ridge 94 seen from the conveying direction (see arrow A in FIGS. 23 and 24) of the package sheet 61 and which are symmetrical with respect to the main ridge 94, a sub ridge 95 extending from an end section of the main ridge 94 on the upstream side of the conveying direction A of the package sheet 61 continuously from the main ridge 94, a pair of top surfaces 96*a*, 96*b* which are convex curved surfaces stretching from the sub ridge 95 seen from the upstream of the conveying direction A of the package sheet 61 and which are symmetrical with respect to the sub ridge 95, and rear end edges 97*a*, 97*b* of the unfolding guide surfaces 90*a*, 90*b* extending from an end section of the main ridge 94 on the downstream side of the conveying direction of the package sheet 61. As seen from the upstream of the conveying direction A of the package sheet 61, the guide main body 91 is generally a smooth curved surface which becomes narrower toward the downstream of the conveying direction A of the package sheet 61 (widened toward the upstream of the conveying direction A of the package sheet 61). Contrary to this, as seen from the downstream of the conveying direction A of the package sheet 61, the guide main body 91 has a recessed shape or a hollow shape, and this hollow is closed by a closing plate 98 schematically shown only in FIG. 20 so as to prevent medicine (powdered medicine in particular) from stagnating in the hollow.

Figure 21:
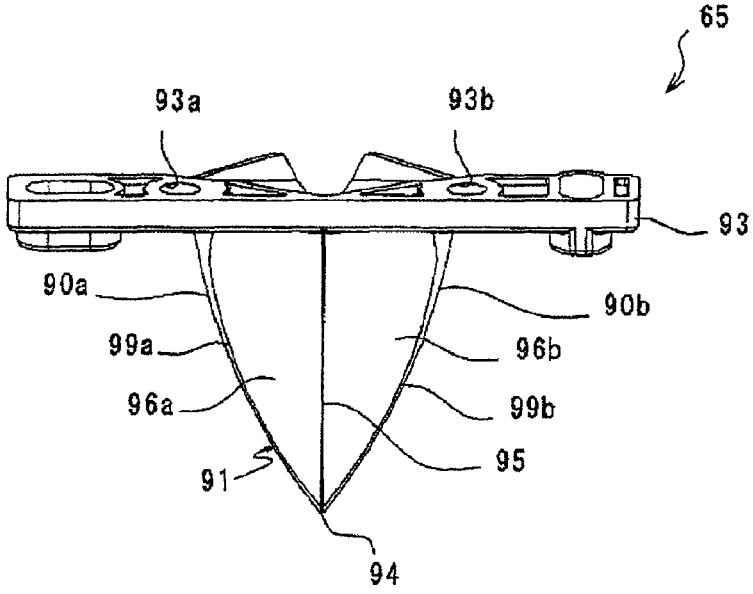
FIG. 21 is a plan view of the unfolding guide.
Figure 22:
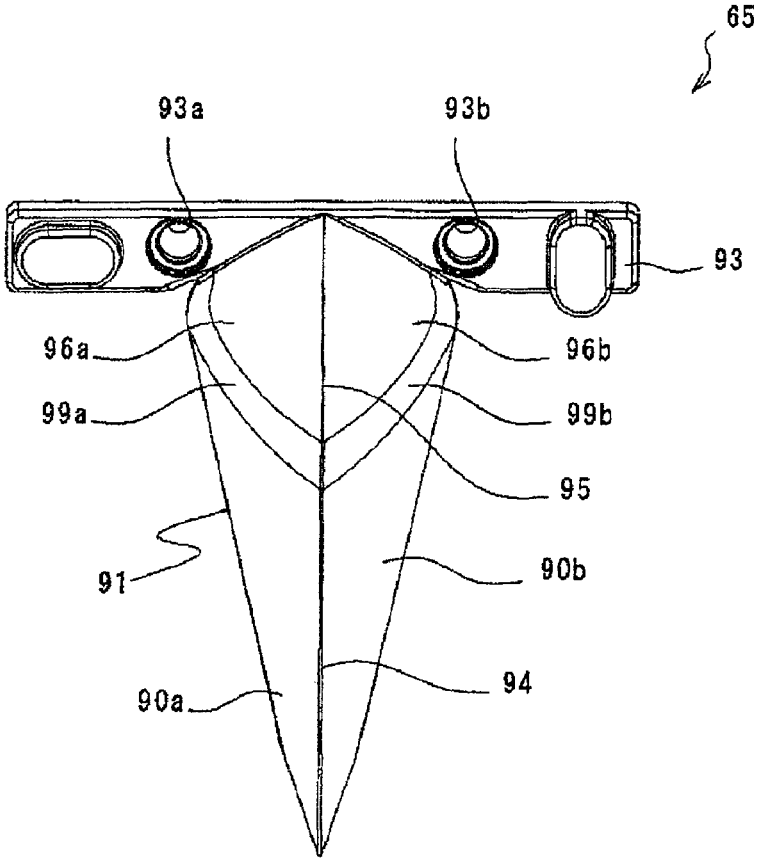
FIG. 22 is a front view of the unfolding guide.

As seen from the conveying direction A of the package sheet 61, the outline of the unfolding guide surfaces 90*a*, 90*b* is a convex curve, and a distance between a pair of the unfolding guide surfaces 90*a*, 90*b* is widened as they are farther away from the main ridge 94 (see FIG. 21). As seen from the direction orthogonal to the conveying direction A of the package sheet and facing the main ridge 94 (see arrow B in FIGS. 23 and 24), the outline of the unfolding guide surfaces 90*a*, 90*b* is linear or straight, and the distance between the unfolding guide surface 90*a*, 90*b* becomes narrower from the upstream to the downstream of the conveying direction A of the package sheet 61 (see FIG. 21).

Since the unfolding guide 65 has a pair of the unfolding guide surfaces 90*a*, 90*b* both of which are convex curved surfaces, and the direction in which the side edge of the guide rods 81 on the downstream side of the conveying direction of the package sheet 61 extends is made identical to the direction in which the main ridge 94 of the unfolding guide 65 extends, the two-folded package sheet 16 is guided with the curved surfaces and is thereby gently deformed or unfolded, so that tension can be equally applied to both the sides of the two-folded package sheet 61 while an opening can be formed. Therefore, even if the printing section 69 is placed in the vicinity of the unfolding guide 65 and the heat sealing section 68, it becomes possible to reliably prevent wrinkles from being generated on the package sheet 61 in the heat sealing section 68. In other words, the shape of the unfolding guide 65 can reduce the distance from the printing section 69 to the heat sealing section 68 without generating wrinkles on the package sheet 61. As a result, the length of the useless package sheet used only for routing upon the initial startup of the medicine packaging apparatus 1 or in replacement of the roll 62 and not for packing of medicine (the package sheet from the printing section to the heat sealing section) can be reduced to the minimum, and running cost reduction can be achieved thereby. Moreover, downsizing of the device can be attained by reducing the distance from the printing section 69 to the heat sealing section 68.

Figure 23:
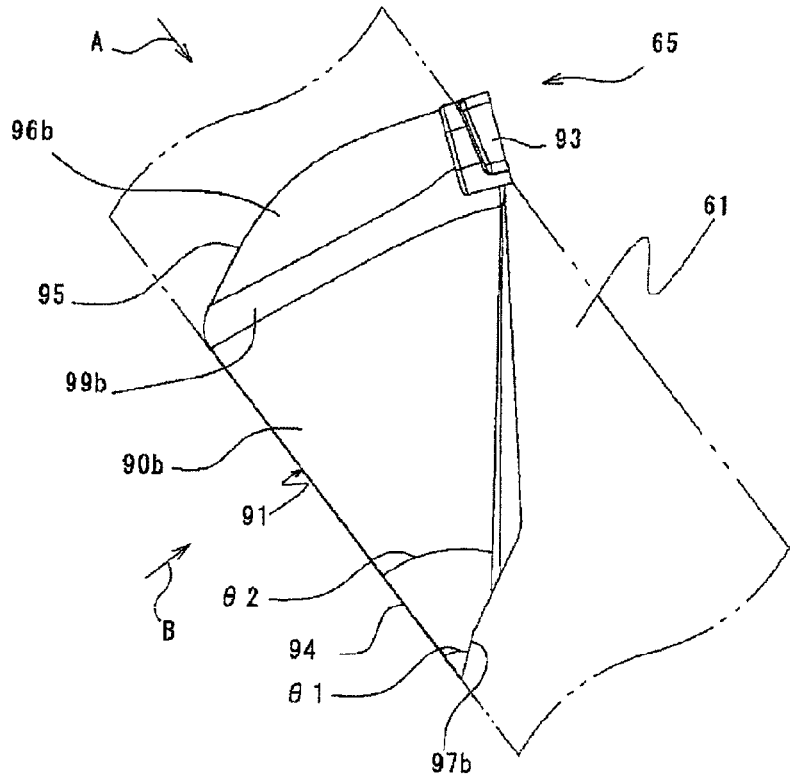
FIG. 23 is a side view showing the relation between the unfolding guide and the package sheet.
Figure 24:
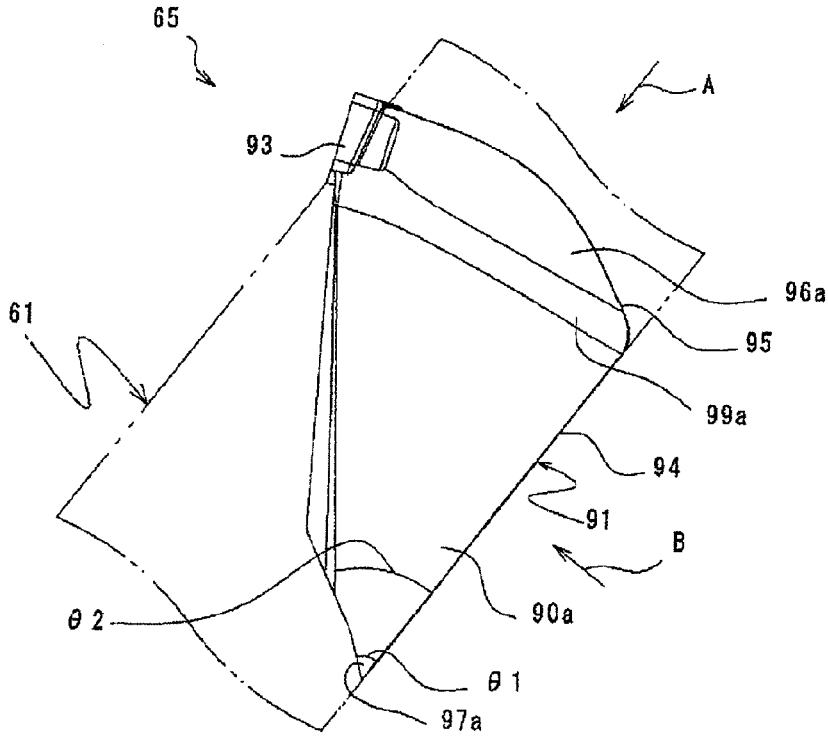
FIG. 24 is a side view showing the relation between the unfolding guide and the package sheet.

As most clearly shown in FIGS. 23 and 24, the above-mentioned rear end edges 97*a*, 97*b* of the unfolding guide 65 form a first angle θ1 (e.g., 50°), which is an acute angle, with the main ridge 94 at a joining position with the main ridge 94, whereas the rear end edges 97*a*, 97*b* form a second angle θ2 (e.g., 60°), which is larger than the first angle θ1, with the main ridge at regions other than the joining position with the main ridge 94.

With the shape of the rear end edges 97*a*, 97*b* of the unfolding guide surfaces 90*a*, 90*b*, it becomes possible to achieve both the prevention of stagnation of the medicine and reliable prevention of wrinkles generated on the package sheet 61. The first angle θ1 formed by the rear end edges 97*a*, 97*b* and the main ridge 94 at their joining position is set as small as possible, so that it becomes possible to prevent the medicine (powdered medicine in particular) introduced from the nozzle section 67*a* of the hopper 67 from being stagnated in the end section of the unfolding guide surfaces 90*a*, 90*b* on the downstream side of the conveying direction A of the package sheet 61. Since the angle between the rear end edges 97*a*, 97*b* and the main ridge 94 at the regions other than their joining position forms the second angle θ2 which is larger than the first angle θ1, the area of the unfolding guide surfaces 90*a*, 90*b* can be set wide enough to prevent wrinkles from being generated on the package sheet 61.

A portion of the unfolding guide 65 on the upstream side of the transportation direction A of the package sheet 61 has the sub ridge 95 extending continuously from the main ridge 94 as stated above, and a pair of the top surfaces 96*a*, 96*b* which are convex curved surfaces stretching symmetrically with respect to the sub ridge 95. The top surfaces 96*a*, 96*b* are each joined to the unfolding guide surfaces 90*a*, 90*b*, and shoulder sections 99*a*, 99*b* which are the curved surfaces continuing to the unfolding guide surfaces 90*a*, 90*b* and the top surfaces 96*a*, 96*b* are formed in the joining portions between the unfolding guide surfaces 90*a*, 90*b* and the top surfaces 96*a*, 96*b*. When the medicine (powdered medicine in particular) introduced from the nozzle section 67*a* of the hopper 67 descends to the top surfaces 96*a*, 96*b* of the unfolding guide due to blowing-up and the like, the medicine falls to the package sheet 61 without remaining on the top surfaces 96*a*, 96*b* since the top surfaces 96*a*, 96*b* are curved surfaces.

Figure 17:
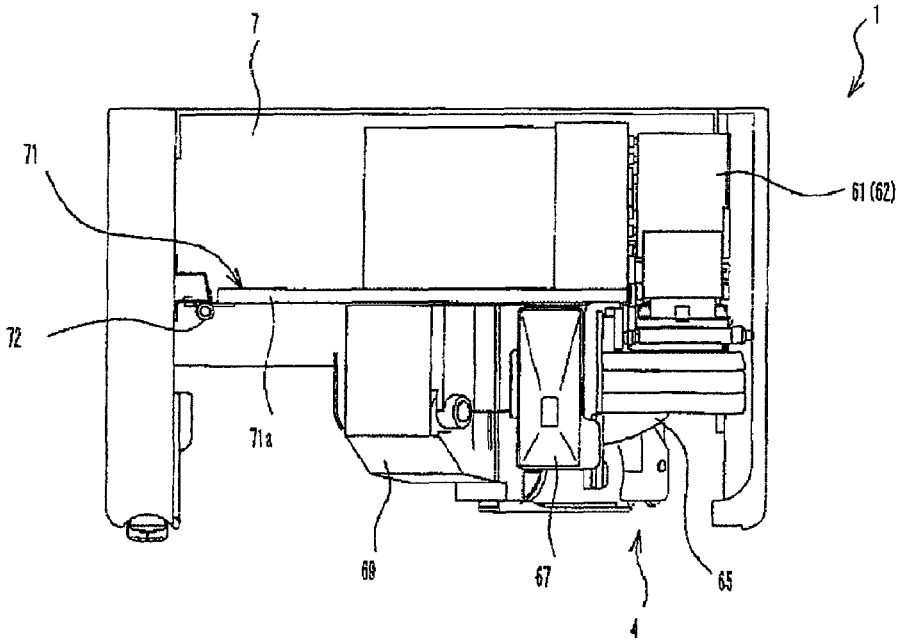
FIG. 17 is a cross sectional view showing the medicine packaging apparatus with the packaging unit at a housing position.
Figure 18:
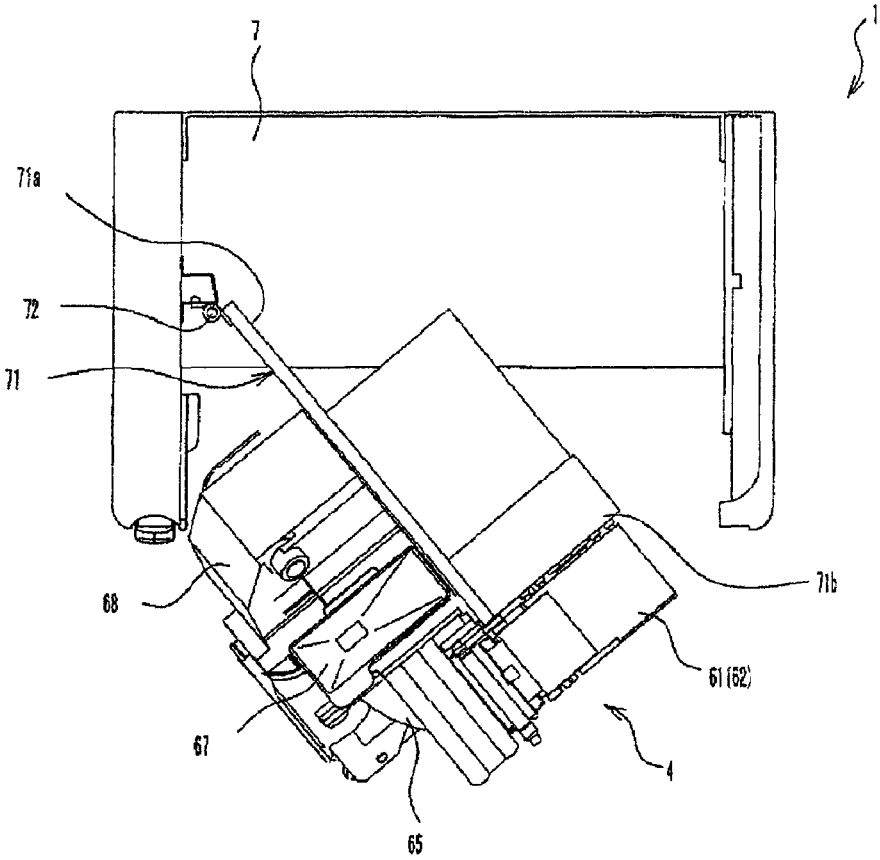
FIG. 18 is a cross sectional view showing the medicine packaging apparatus with the packaging unit at an ejection position.
Figure 19:
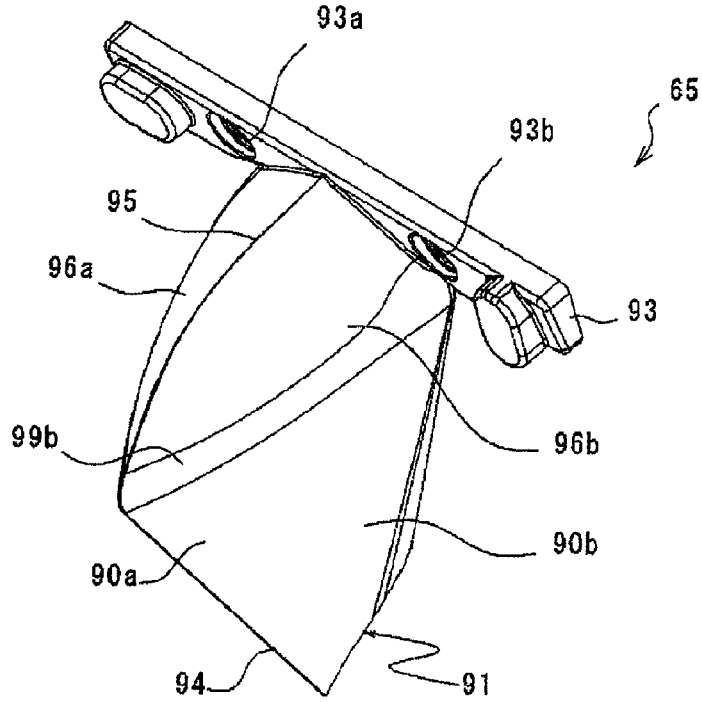
FIG. 19 is a perspective view for showing a unfolding guide from the upper side.
Figure 20:
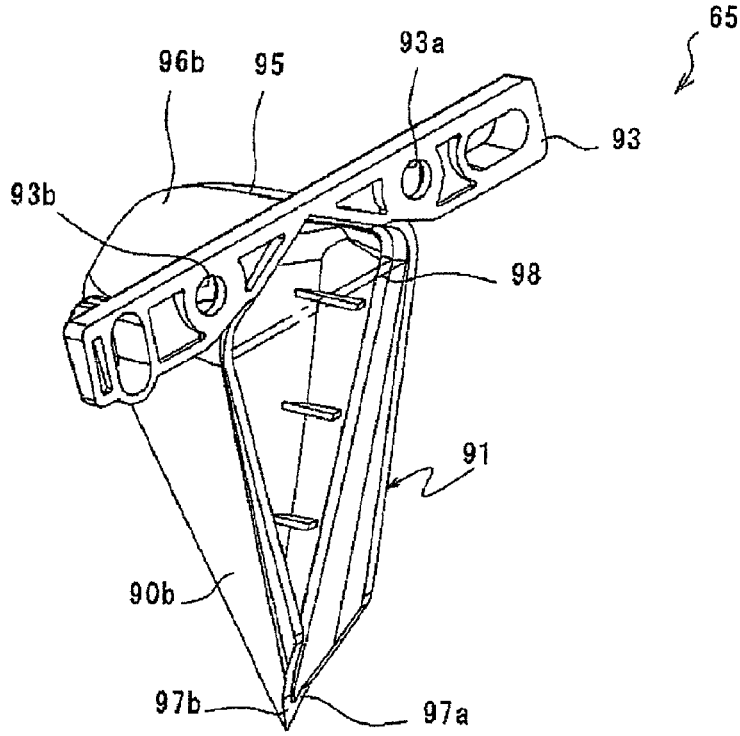
FIG. 20 is a perspective view for showing the unfolding guide from the rear side.

While the roll 62 of the package sheet 61, the guide rollers 73*a*, 73*b*, and the printing section 69 are placed on the side holding section 71*b* of the holding frame 71, the backup roller 79, the guide rod 81, the unfolding guide 65, the hopper 67, and the heat sealing section 68 are placed on the front holding section 71*a*. Therefore, as shown in FIG. 17, the roll 62 of the package sheet 61, the guide rollers 73*a*, 73*b*, the printing section 69, the backup roller 79, the guide rod 81, the unfolding guide 65, the hopper 67, and the heat sealing section 68 can be placed compactly, and the space in the housing space 7 of the housing 6 can be utilized. In other words, downsizing of the medicine packaging apparatus 1 can be achieved. If the holding frame 71 is rotated by the hinge mechanism 72 as shown in FIG. 18, almost all the packaging unit 4 is taken out from the housing 6, and the roll 62 of the package sheet 61 and the printing section 69 can be moved to the front side of the housing 6 to allow easy access and visual inspection from the outside, so that the workability of various works such as replacement of the roll 62 and maintenance of the printing section 69 including replacement of the ink ribbon cartridge 7 is enhanced.

Second Embodiment

In the following, the second embodiment of the present invention is described with reference to FIGS. 25 to 33. The second embodiment is similar to the first embodiment in the configuration and operation of the tablet supply unit 2, the powdered medicine supply unit 3, and the medicine discharge section 5 of the medicine packaging apparatuses 1, and is different only in the packaging unit 4.

The packaging unit 4 in the present embodiment has a mechanism for preventing the tablets fed from the tablet supply unit 2 to the hopper 67 as well as the powdered medicine fed from the powdered medicine supply unit 3 to the hopper 67 from adhering to the wall surface in the hopper 67 and remaining in the hopper 67 without being fed to the package sheet 61. More specifically, the packaging unit 4 in the present embodiment is provided with a hopper-side vibration applying mechanism 202 for applying vibration to the hopper 67 and a unfolding guide-side vibration applying mechanism 203 for applying vibration to the unfolding guide 65.

Figure 25:
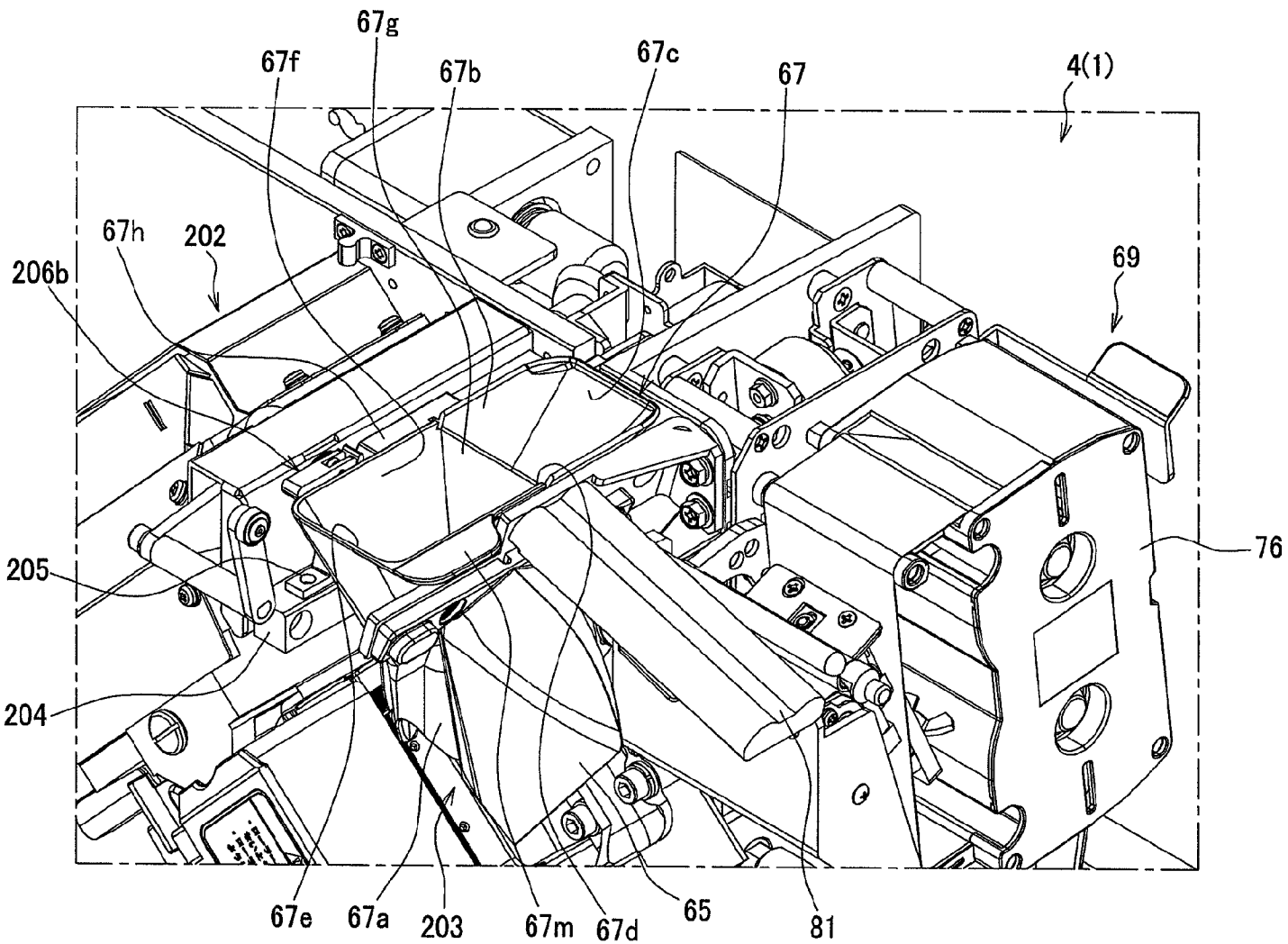
FIG. 25 is a partially perspective view showing a packaging unit of a medicine packaging apparatus according to a second embodiment of the invention.
Figure 26:
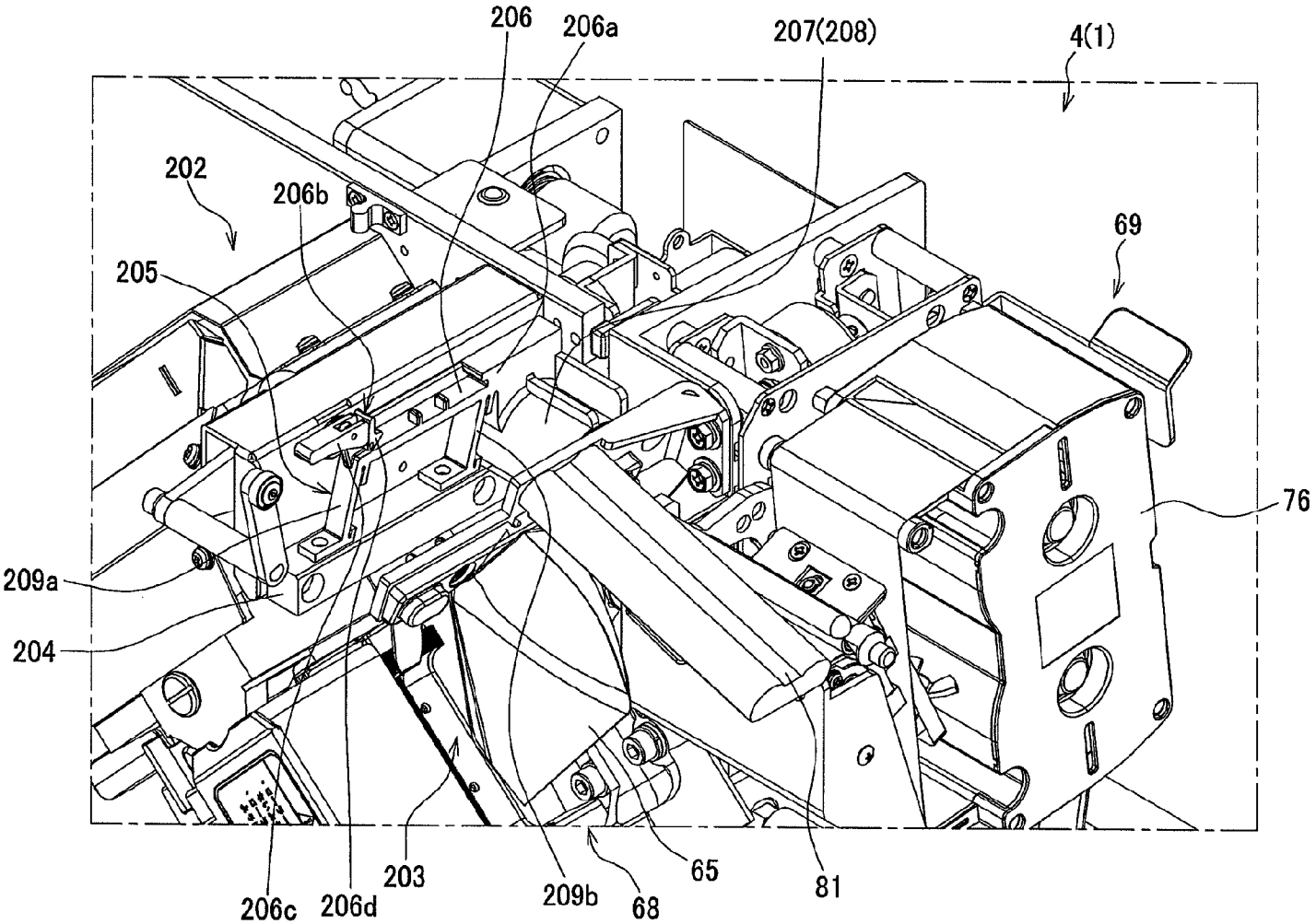
FIG. 26 is a partial perspective view showing the packaging unit with a hopper removed.
Figure 27:
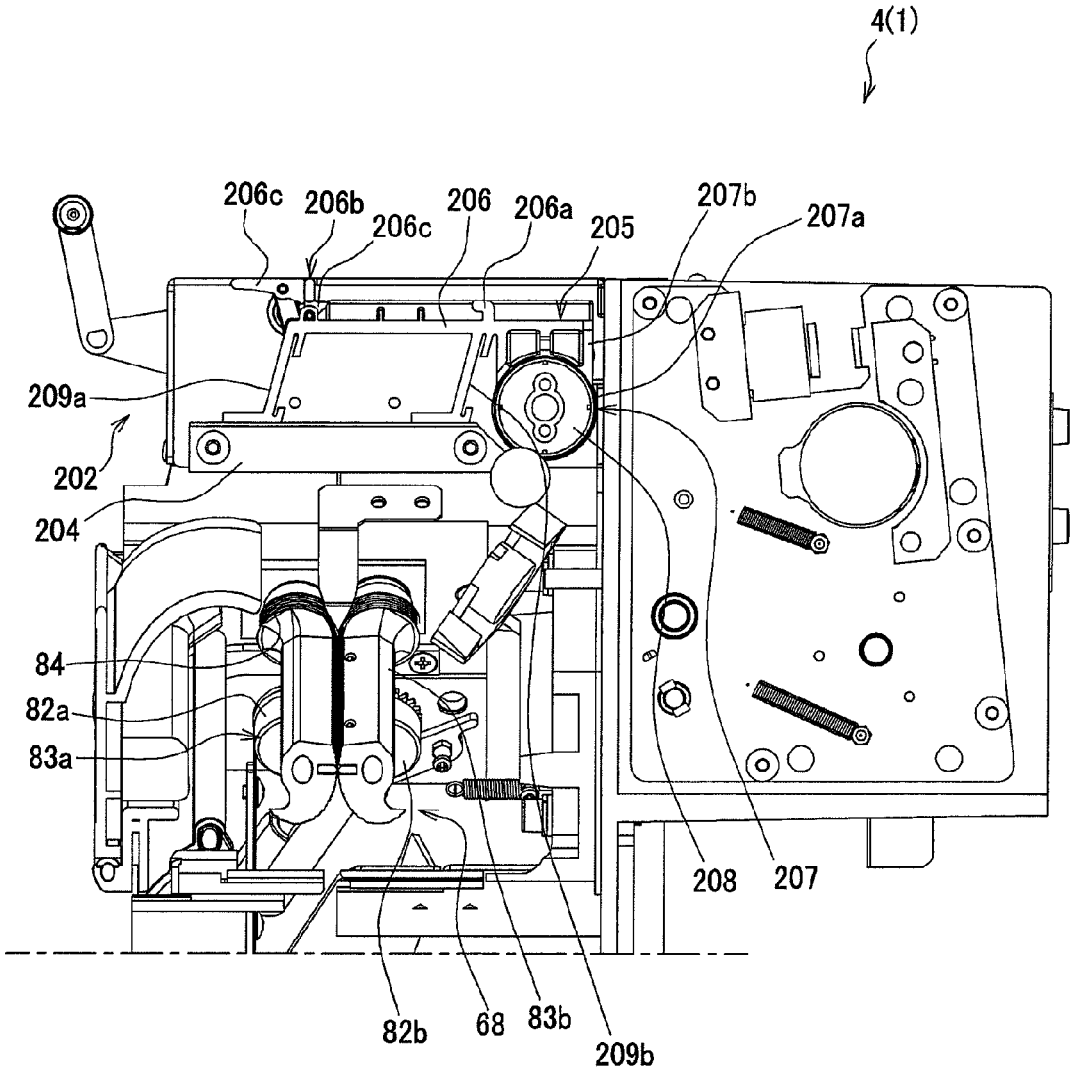
FIG. 27 is a partial front view showing the packaging unit with a hopper removed.
Figure 28:
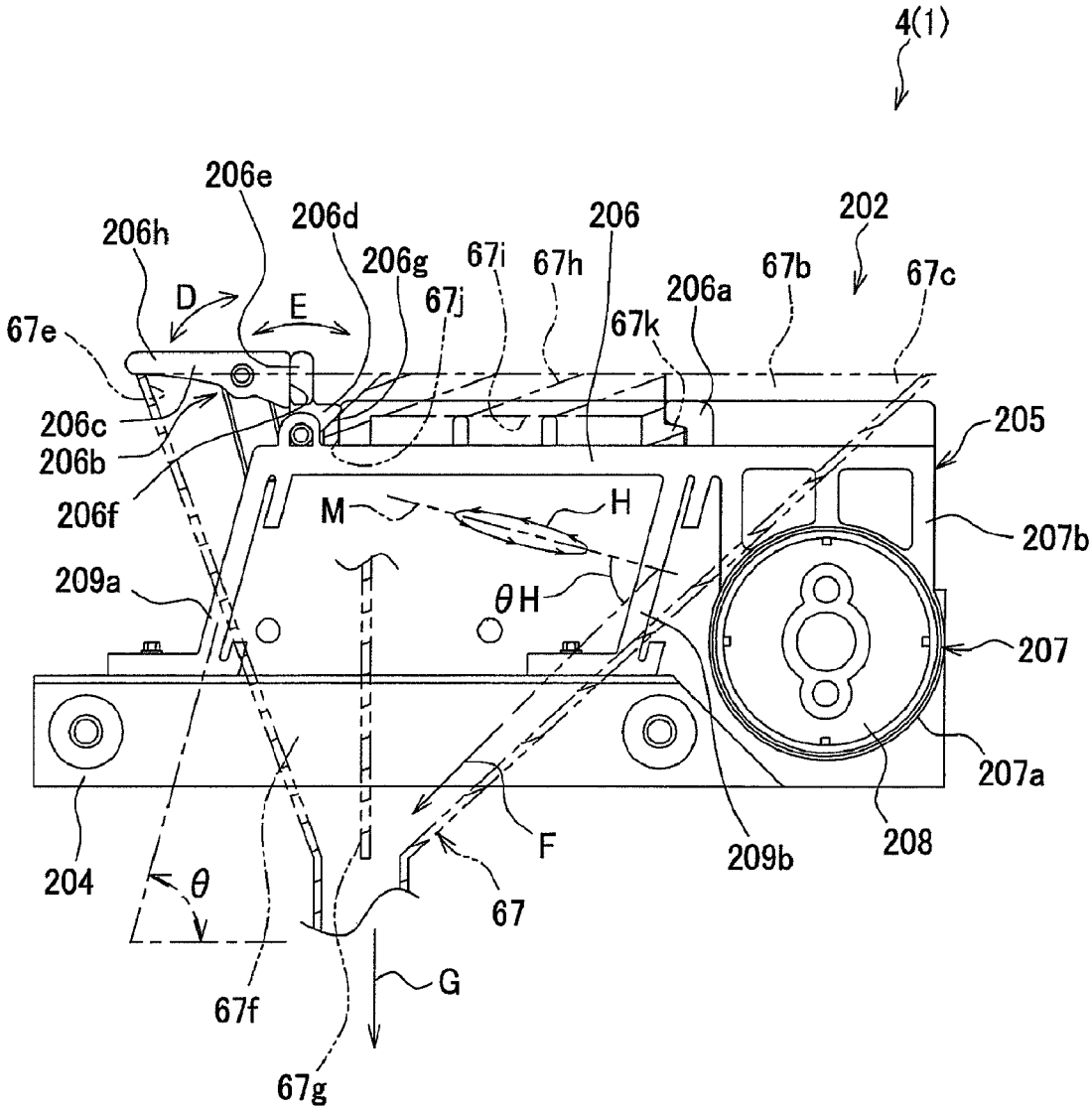
FIG. 28 is a schematic front view showing a hopper-side vibration applying mechanism.

With reference to FIGS. 25 and 28, the hopper 67 in the present embodiment has an inlet opening 67*b* in generally a rectangular shape in plan view, and has four inner inclined wall surfaces 67*c*, 67*d*, 67*e*, and 67*f* extending slantingly downward from the inlet opening 67*b* toward the nozzle section 67*a*. The space surrounded with the inner inclined wall surfaces 67*c* to 67*f* is divided by a partitioning plate section 67*g*. In FIG. 28, tablets are fed from the tablet supply unit 2 to the space on the left-hand side of the partitioning plate section 67*g*, while a powdered medicine is fed from the powdered medicine supply unit 3 to the space on the right-hand side. In order to secure a wider plan view area of the inlet opening 67*b* for receiving the powdered medicine from the powdered medicine supply unit 3, the inner inclined wall surface 67*c* on the right-hand side of the partitioning plate section 67*g* in FIG. 28 among the four inner inclined wall surfaces 67*c* to 67*f* is set to have an angle of gradient small than that of the three remaining inner inclined wall surfaces 67*d* to 67*f*. More specifically, the inner inclined wall surfaces 67*d* to 67*f* have an angle of gradient set at about 75 to 85°, whereas the inner inclined wall surface 67*c* has an angle of gradient set at about 35 to 40°. The inwardly inclined surface 67*e* has an angle of gradient set at about 64°.

The hopper 67 in the present embodiment has a held section 67*h* held by a later-described hopper holding section 206 of the hopper-side vibration applying mechanism 202. The held section 67*h* is provided near the inlet opening 67*b* outside the inner inclined wall surface 67*f*. The held section 67*h*, which is in the shape of a long and narrow block having a recess section 67*i* formed on its lower-end side, has an inclined held surface 67*j* formed in one end side (left-hand side in FIG. 28) and a projection 67*k* formed in the other end side. A knob 67*m* for the operator to grasp the hopper 67 is provided near the inlet opening 67*b* outside the inner inclined wall surface 67*d* facing the held section 67*h*.

With reference to FIGS. 25 to 28, the hopper-side vibration applying mechanism 202 has a holding structure 205 made of resin fixed to the holding frame 71 via a bracket 204. The holding structure 205 has a long and narrow hopper holding section 206 extending in the horizontal direction. The hopper 67 is held by the hopper holding section 206 in the posture that the longitudinal direction of the inlet opening 67*b* (direction in which upper edges of the inwardly inclined surfaces 67*d*, 67*f* extend) is identical to the longitudinal direction of the hopper holding section 206 in plan view. In order to removably hold the held section 67*h* of the hopper 67, the hopper holding section 206 has an inverse L-shaped hooking section 206*a* which projects upward in a section rather close to the center than the right end in FIG. 28, and has a locking mechanism 206*b* on the upper side near the left end. The locking mechanism 206*b* has a manipulation lever 206*c* rotatable around a horizontal shaft line (see arrow D). The locking mechanism 206*b* is placed closer to the center of the hopper holding section 206*a* than the manipulation lever 206*c*, and similarly has a locking lever 206*d* rotatable around the horizontal shaft line (see arrow E).

The held section 67*h* of the hopper 67 is removably fixed onto the hopper holding section 206. As shown in FIG. 28, when the hopper 67 is fixed to the hopper holding section 206, the projection 67*k* of the held section 67*h* fits into the lower side of the hooking section 206*a* of the hopper holding section 206, and the held surface 67*j* is pressed by a holding surface 206*g* of the locking lever 206*d*. The locking lever 206*d* is held in an unrotatable state by a fixed section 206*e* on the opposite side of the holding surface 206*g* being engaged with a fixing section 206*f* of the manipulation lever 206*c*. When a knob 206*h* of the manipulation lever 206*c* is operated and is rotated counterclockwise in FIG. 28, the fixing section 206*f* of the manipulation lever 206*c* is released from the fixed section 206*e* of the locking lever 206*d*. As a result, the locking lever 206*d* becomes rotatable and the held surface 67*j* is released from pressing by the holding surface 206*g*, by which the held section 67*h* of the hopper 67 becomes removable from the hopper holding section 206. The configuration for removably mounting the hopper 67 onto the hopper holding section 206 is not limited to the configuration of the present embodiment as long as the hopper 67 can firmly be fixed to the hopper holding section 206 to some degree. For example, the hopper 67 may be removably mounted on the hopper holding section 206 by fixation with magnets, screw clamps and the like.

A vibration motor holding section 207 is provided below a right end section of the hopper holding section 206 in FIG. 28. The vibration motor holding section 207 is provided with a cylindrical main body 207*a* for holding a vibration motor 208 inside and a coupling section 207*b* for coupling the main body 207*a* to the undersurface of the hopper holding section 206. The vibration motor 208 is held in a manner to be hung from the undersurface side of one end of the hopper holding section 206.

Any type of the vibration motor 208 may be used as long as operation start and stop can electrically be controlled at least. The vibration motor 208 used in the present embodiment is a type of the motor constituted of a weight fixed to the rotation shaft of a direct-current motor incorporated in a casing. A later-described vibration motor 211 is also of the same type as the vibration motor 208.

An upper end side of the holding structure 205 is coupled to the hopper holding section 206, while a lower end side has two leaf spring sections 209*a*, 209*b* fixed to the bracket with screws. In plan view, the leaf springs 209*a*, 209*b* extend right under the hopper holding section 206 (vertically downward). In side view, the leaf spring sections 209*a*, 209*b* extend slantingly downward from the hopper holding section 206 in parallel with each other so as to be farther away from the vibration motor holding section 207 (vibration motor 208) toward the lower end side, and are placed in the longitudinal direction of the hopper holding section 206 at an interval. An angle of gradient θ of the leaf spring sections 209*a*, 209*b* with respect to the horizontal direction is set at, for example, around 80°.

The leaf spring sections 209*a*, 209*b* sags like a cantilever with the lower end side being a fixed end while the upper end side being a free end, and upon displacement of the upper ends of the leaf spring sections 209*a*, 209*b* due to the sagging, the hopper holding section 206 is also displaced thereby.

Vibration generated by operation of the vibration motor 208 is transmitted to the hopper 67 via the holding structure 205. With the vibration, the tablets fed from the tablet supply unit 2 and the powdered medicine fed from the powdered medicine supply unit 3 promptly move from the inlet opening 67*b* to the nozzle section 67*a* without adhering to the inner inclined wall surfaces 67*c* to 67*f* of the hopper 67, and are introduced into the opening of the two-folded package sheet 61 unfolded by the unfolding guide 65. Therefore, contamination can be eliminated by effectively preventing medicine (especially powdered medicine) from adhering to and remaining in the hopper 67. As compared with the sound generated upon striking of the hopper with a solenoid and the like, the sound made by application of vibration is small in volume, does not make operators uncomfortable, nor cause false detection of failure by the operators.

As shown with arrow H in FIG. 28, in a plane (the plane of paper itself in FIG. 28) including a moving direction F and a gravity direction G of the powdered medicine which moves on the inner inclined wall surface 67*c* which has the mildest inclination, the above-constituted holding structure 205 in the present embodiment transmits the vibration generated by the vibration motor 208 to the hopper 67 so that the hopper 67 may vibrate with an elliptical orbit which is farther away from the inner inclined wall surface 67*c* toward an upper side. A major axis M of the elliptical orbit H of the vibration of the hopper 67 is perpendicular to the leaf spring sections 209*a*, 209*b* (angle of gradient θ), and an angle $\theta_H$ formed between the major axis M and the moving direction F of the powdered medicine which moves on the inwardly inclined surface 67*c* by its own weight is less than 90 degrees but is relatively large (about 45 degrees or more and less than 90 degrees). Application of the vibration with such elliptical orbit makes it possible to effectively move the powdered medicine on the inwardly inclined surface 67*c* having mild inclination from the inlet opening 67*b* to the nozzle section 67*a*, and to reliably prevent the residual medicine generated by adhesion. Since the vibration motor 208 is positioned in the vicinity of the upper end of the inwardly inclined surface 67*c*, vibration generated by the vibration motor 208 is efficiently transmitted to the inwardly inclined surface 67*c* and promotes movement of the medicine on the inwardly inclined surface 67*c*.

Figure 29:
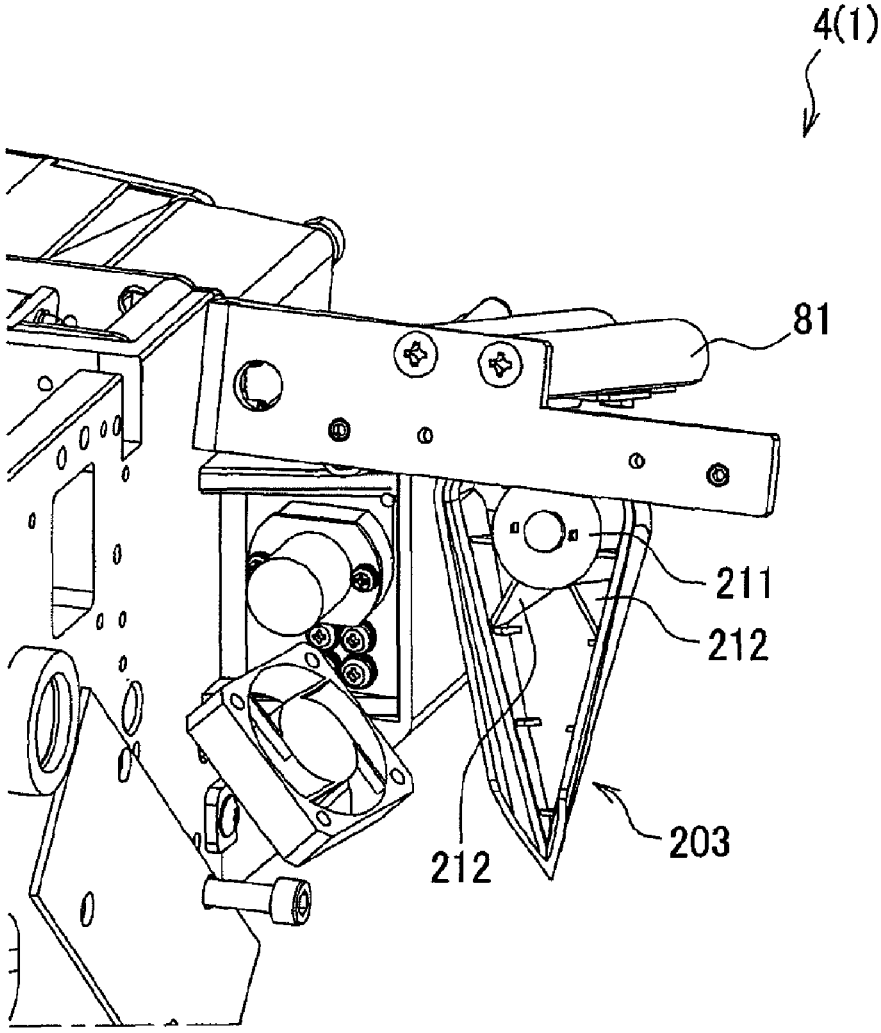
FIG. 29 is a partial perspective view showing a unfolding guide-side vibration applying mechanism.
Figure 30:
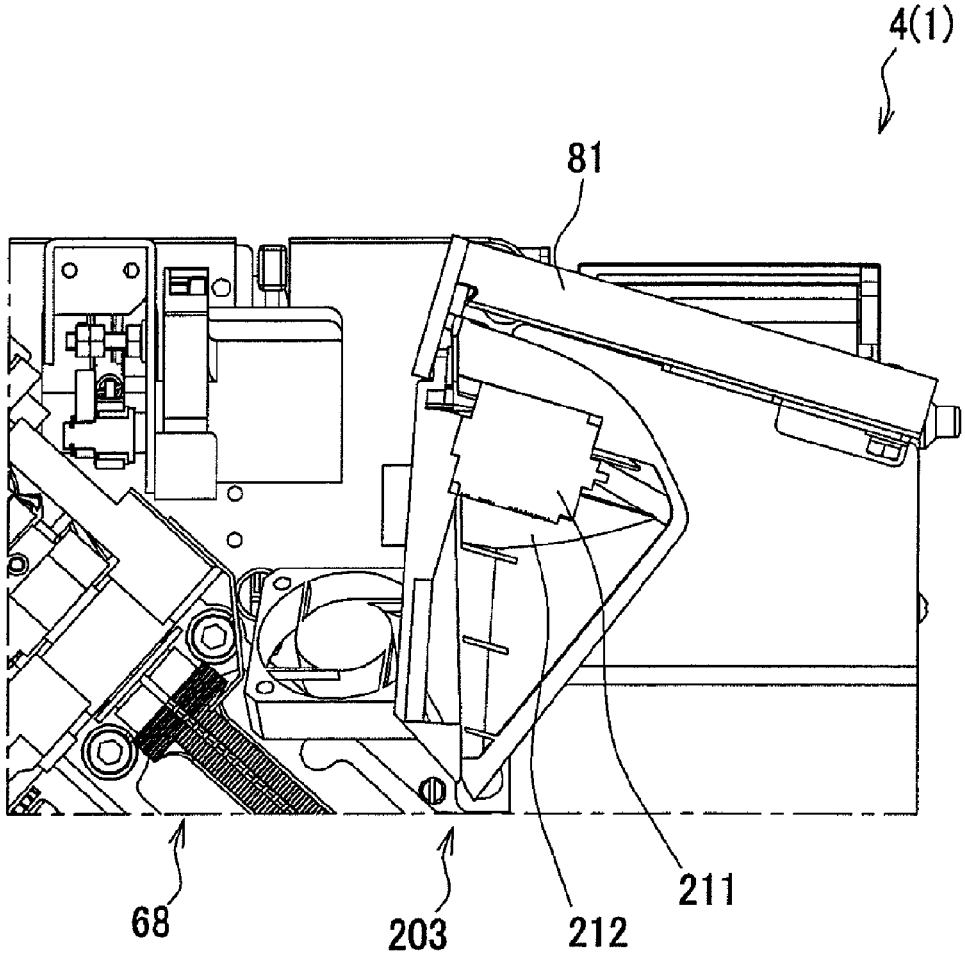
FIG. 30 is a partially sectional side view showing the unfolding guide-side vibration applying mechanism.

With reference to FIGS. 29 and 30, the unfolding guide-side vibration applying mechanism 203 is equipped with a vibration motor (second vibration source) 211 built in the unfolding guide 65. A plurality of radiantly extending ribs 212 are provided in the unfolding guide 65, and the vibration motor 211 is fixed to the unfolding guide 65 with these ribs 212. Therefore, vibration generated by the vibration motor 65 is directly transmitted to the unfolding guide 65. Since applying vibration not only to the hopper 67 but also to the unfolding guide 65 by the unfolding guide-side vibration applying mechanism 203 smoothes the movement or flow of the medicine (powdered medicine in particular) within the two-folded package sheet 61, it becomes possible to reliably prevent the medicine from adhering to and remaining in the hopper 67.

In the following, the control of hopper-side vibration applying mechanism 202 and the unfolding guide-side vibration applying mechanism 203 by the controller 11 is described. In the present embodiment, the hopper-side vibration applying mechanism 202 and the unfolding guide-side vibration applying mechanism 203 operate in synchronization, so that the hopper-side vibration applying mechanism 202 and the unfolding guide-side vibration applying mechanism 203 operate and stop simultaneously on a constant basis. However, the hopper-side vibration applying mechanism 202 and the unfolding guide-side vibration applying mechanism 203 may operate independently of each other. Unless otherwise required to be distinguished, the hopper-side vibration applying mechanism 202 and the unfolding guide-side vibration applying mechanism 203 are referred to as vibration applying mechanisms 202, 203 in the following description.

First, after the tips of the vertical heat sealing sections 86, 86 (see, e.g., FIGS. 12 and 15) of the heater rollers 83*a*, 83*b* are put in the state of pushing each other to hold the package sheet 61, that is, after the vertical heat sealing sections 86, 86 are put in a position to form vertical seals, the vibration applying mechanisms 202, 203 start operation after the elapse of a predetermined time. The operation duration of the vibration applying mechanisms 202, 203 is set in response to packing speed. The feed rate of the package sheet 61 with the feed rollers 82*a*, 82*b* (see, e.g., FIGS. 12 and 15) is faster in tablet packing than in powdered medicine packing, and therefore, a duration of time from the point that the vertical heat sealing sections 86, 86 are put in a position to form vertical seals until the start of operation of the vibration applying mechanisms 202, 203 is set shorter in tablet packing than in powdered medicine packing. For both the tablet packing and powdered medicine packing, the slower the feed rate of the package sheet 61 becomes, the longer the duration of time till the start of operation of the vibration applying mechanisms 202, 203 is set. In the case where both the powdered medicine and the tablet are included in one prescription (simultaneous packing of tablet and powdered medicine), operation timing and operation duration of the vibration applying mechanisms 202, 203 are set in conformity to the case of powdered medicine packing.

When one prescription includes both a medicine bag of tablets and a medicine bag of powdered medicine (mixed packing), the controller 11 operates the vibration applying mechanisms 202, 203 for the medicine bag of the powdered medicine with use of the timing and operation duration similar to powdered medicine packing, and operates the vibration applying mechanisms 202, 203 for the medicine bag of the tablet with use of the timing and operation duration similar to tablet packing. In order to surely prevent the powdered medicine adhering to and remaining in the hopper 67 from mixing into the medicine bag of the tablets, the controller 11 does not operate the vibration applying mechanisms 202, 203 but keep them in a stopped state during preparation of the medicine bag of the tablets once the medicine bag of the powdered medicine is completed during mixed packing. FIG. 31 schematically shows operation of the vibration applying mechanisms 202, 203 during mixed packing. In this example, 3 doses of medicine are prepared in which tablets are taken in the "morning" and the "noon", and powdered medicine is taken in the "evening." A symbol "O" shown below a schematically depicted medicine bag 215 indicates that the vibration applying mechanisms 202, 203 are operated, whereas a symbol "x" indicates that the vibration applying mechanisms 202, 203 are maintained in the stopped state. The first and second medicine bags 215 contain tablets, and powdered medicine is not yet packaged in the same prescription. Even though the first and second medicine bags 215 contain tablets, the vibration applying mechanisms 202, 203 are operated as in the case of the powdered medicine. The third medicine bag 215 is the first medicine bag which packs powdered medicine within the same prescription, and the vibration applying mechanisms 202, 203 are operated during preparation of the third medicine bag 215. During preparation of the fourth, fifth, seventh and eighth medicine bags 215 in which tablets are packed after the third medicine bag, the vibration applying mechanisms 202, 203 are maintained in the stopped state, whereas during preparation of the sixth and ninth medicine bags 215 in which a powdered medicine is packed, the vibration applying mechanisms 202, 203 are operated.

Figure 32:
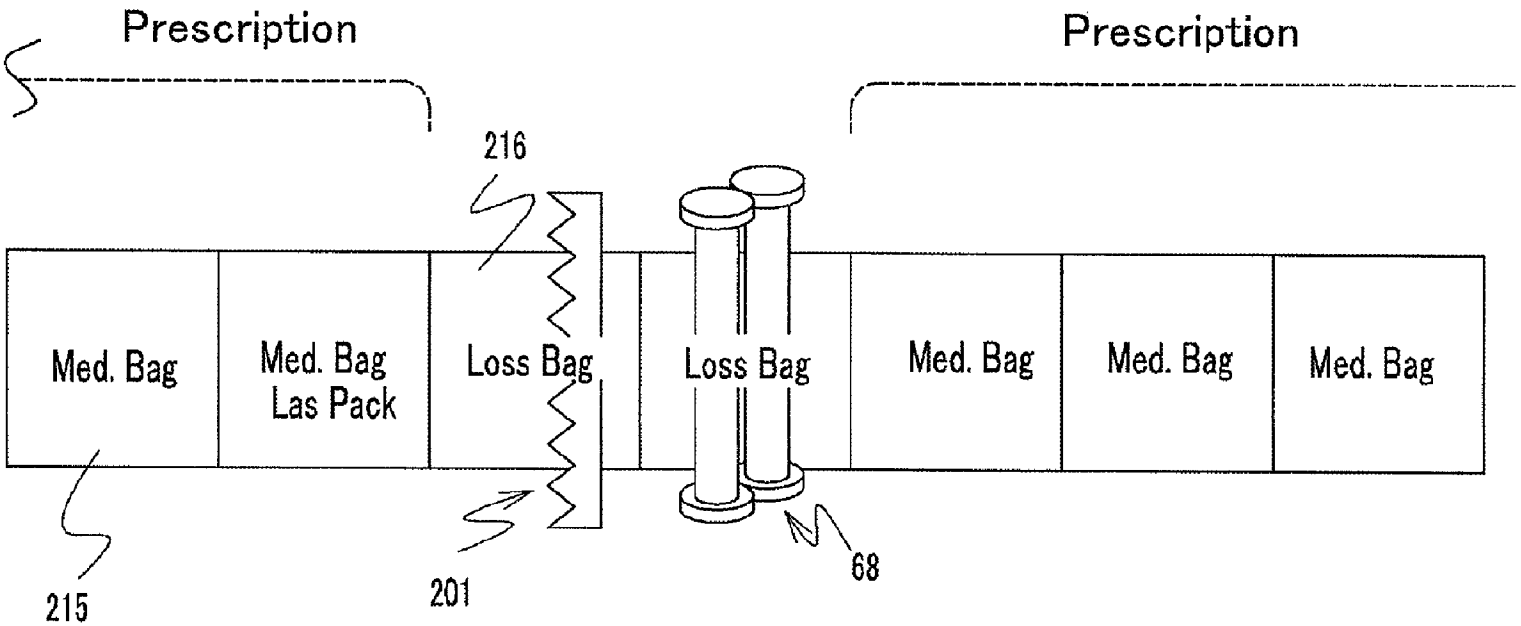
FIG. 32 is a schematic view for explaining the presence/absence of operation of the vibration applying mechanism in the case where two loss bags are present.
Figure 33:
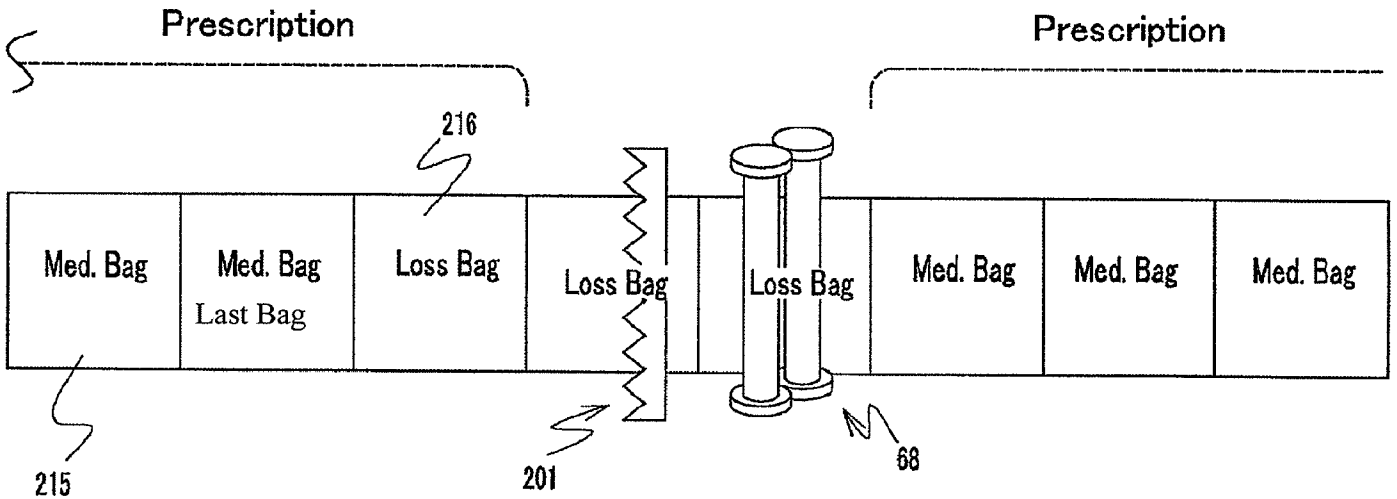
FIG. 33 is a schematic view for explaining the presence/absence of operation of the vibration applying mechanism in the case where three loss bags are present.
Figure 34:
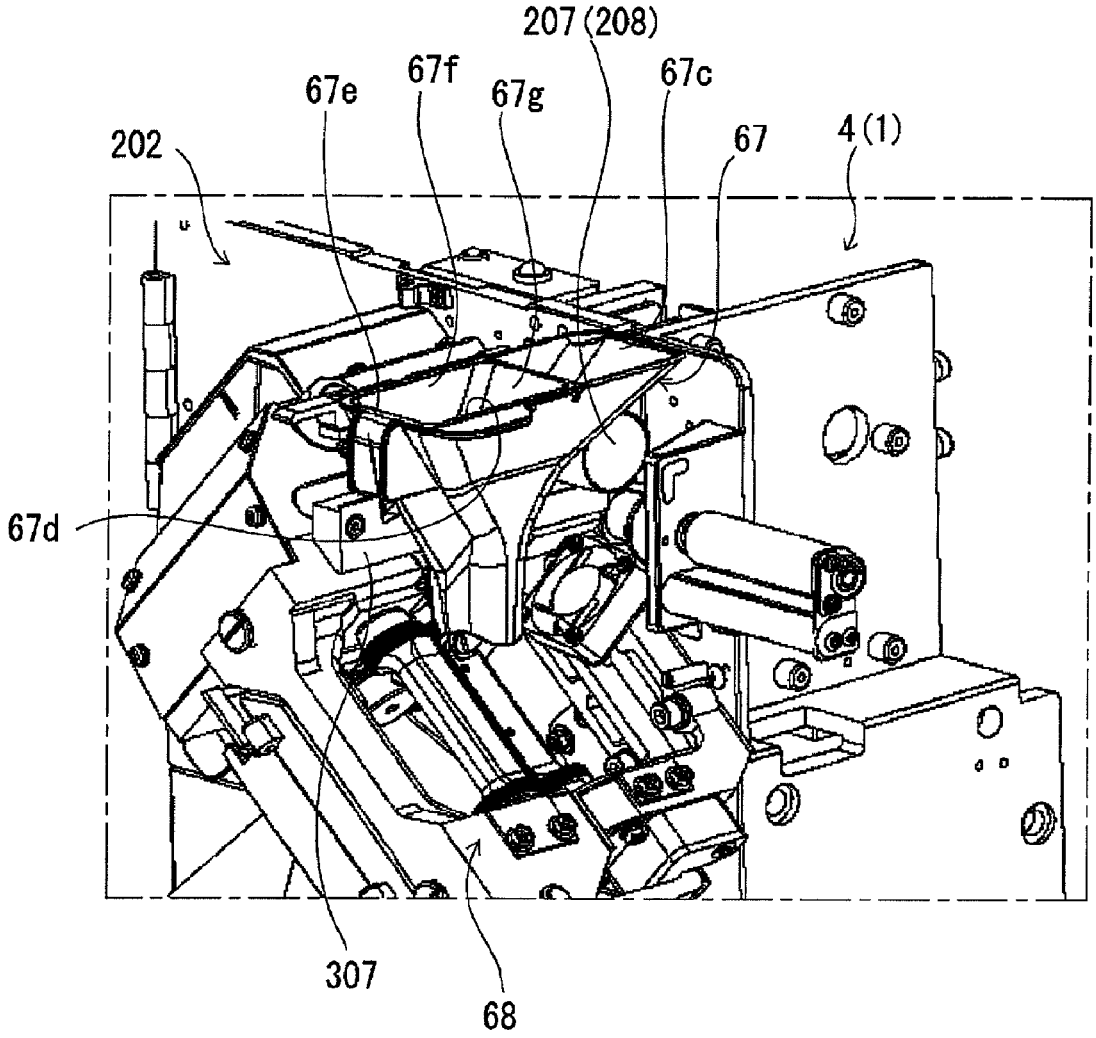
FIG. 34 is a partial perspective view showing a packaging unit of a medicine packaging apparatus according to a third embodiment of the invention (with a hopper mounted)
Figure 35:
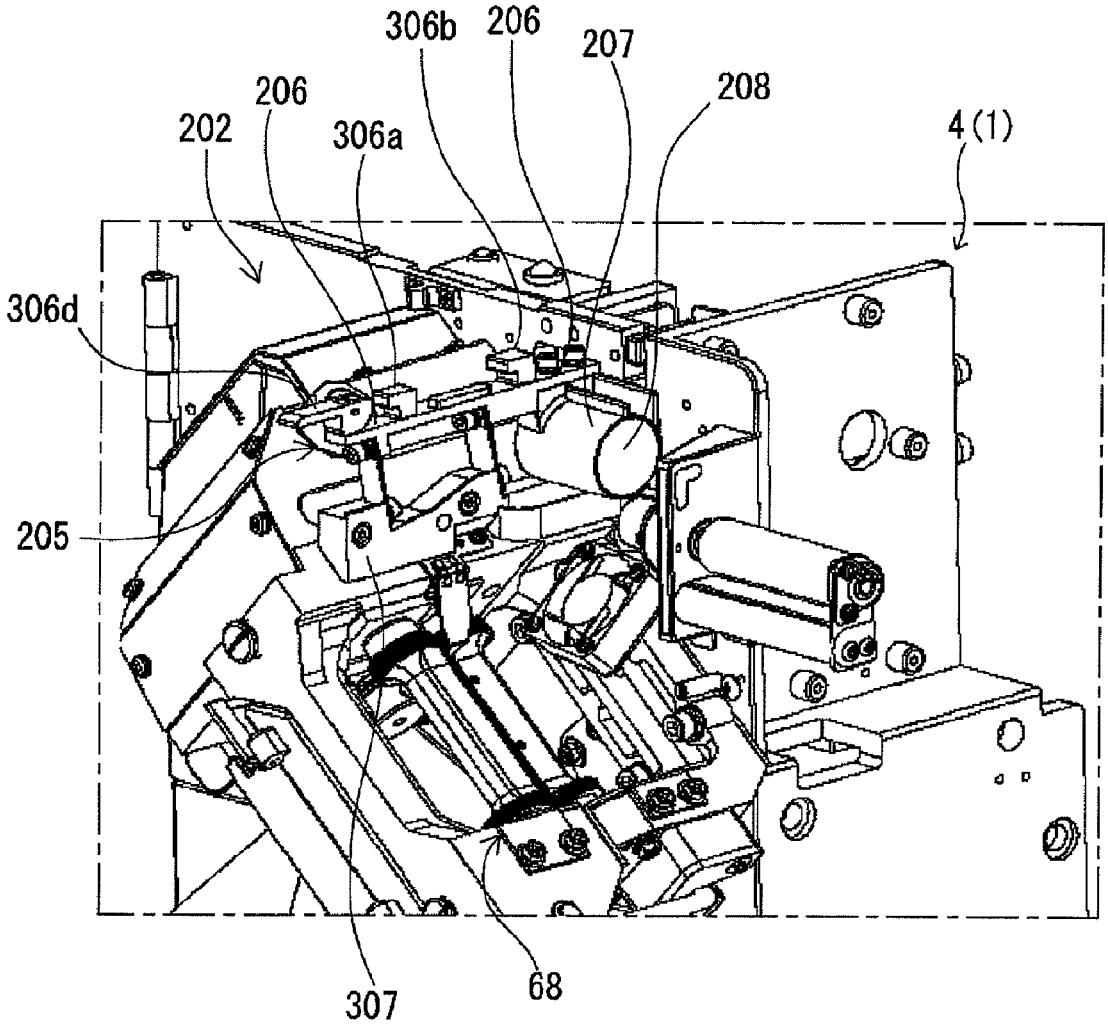
FIG. 35 is a partial perspective view showing the packaging unit of the medicine packaging apparatus according to the third embodiment of the invention (with the hopper removed)
Figure 36:
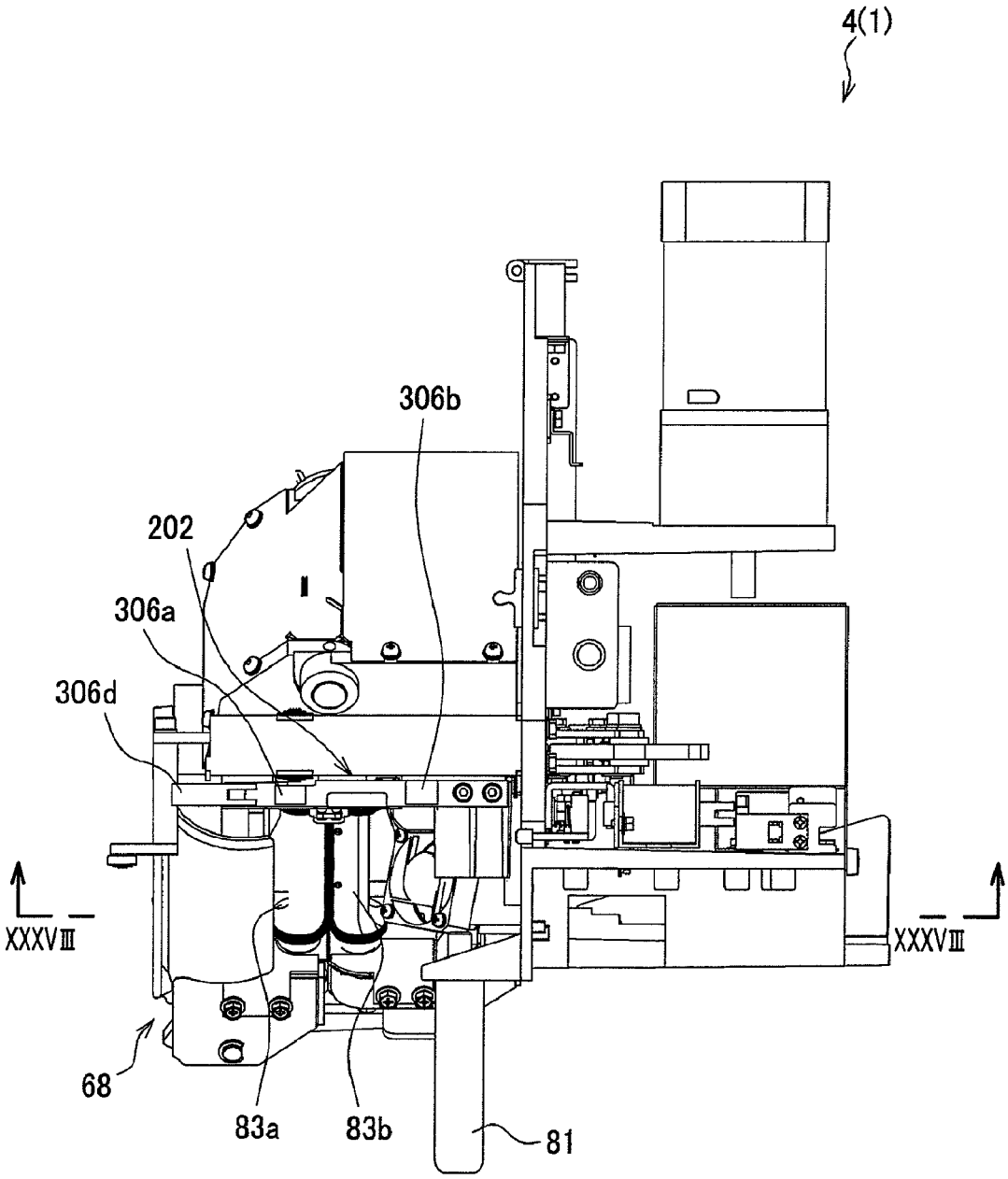
FIG. 36 is a plan view showing the packaging unit with the hopper removed.
Figure 37:
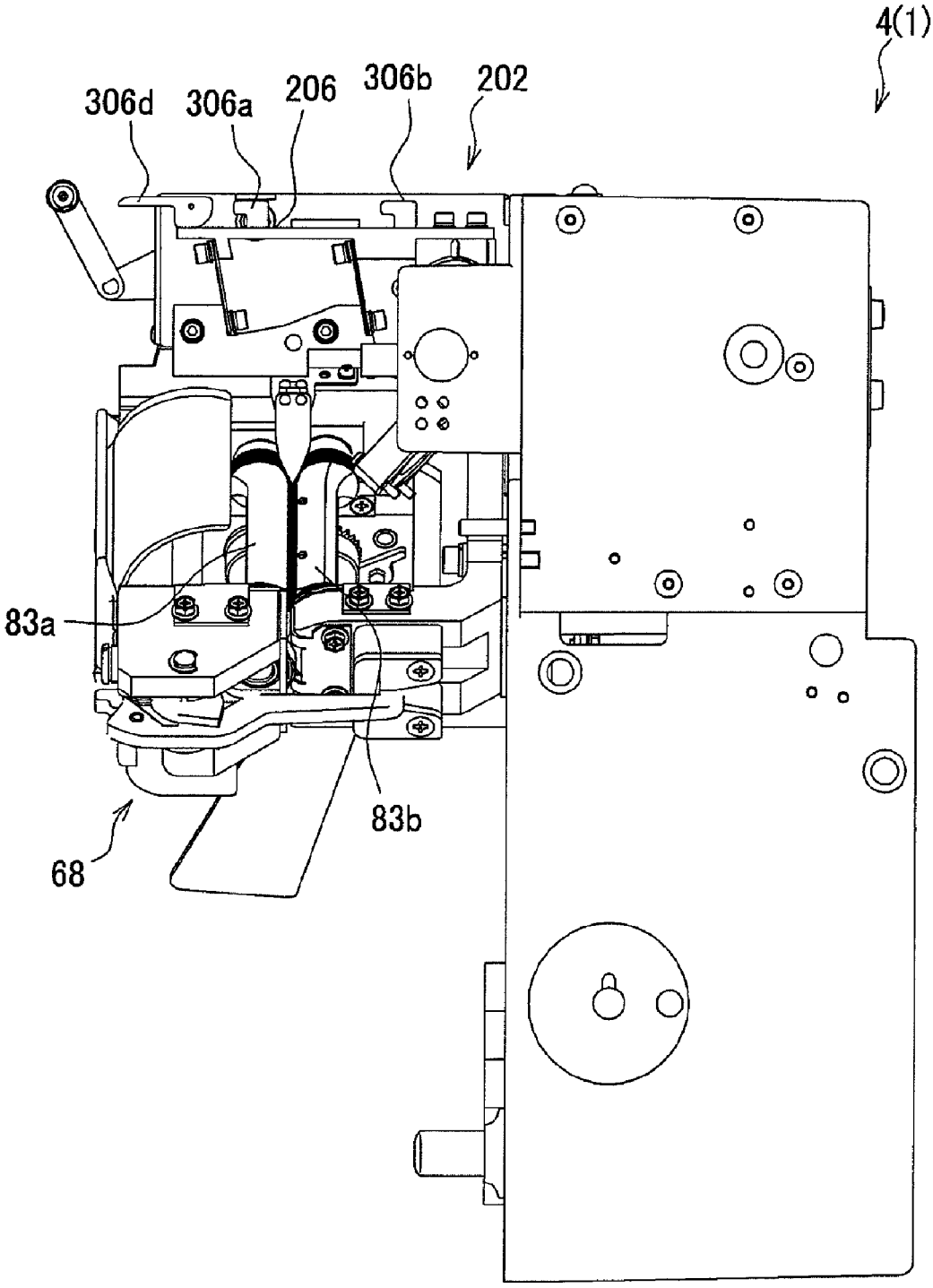
FIG. 37 is a right side view showing the packaging unit with the hopper removed.
Figure 38:
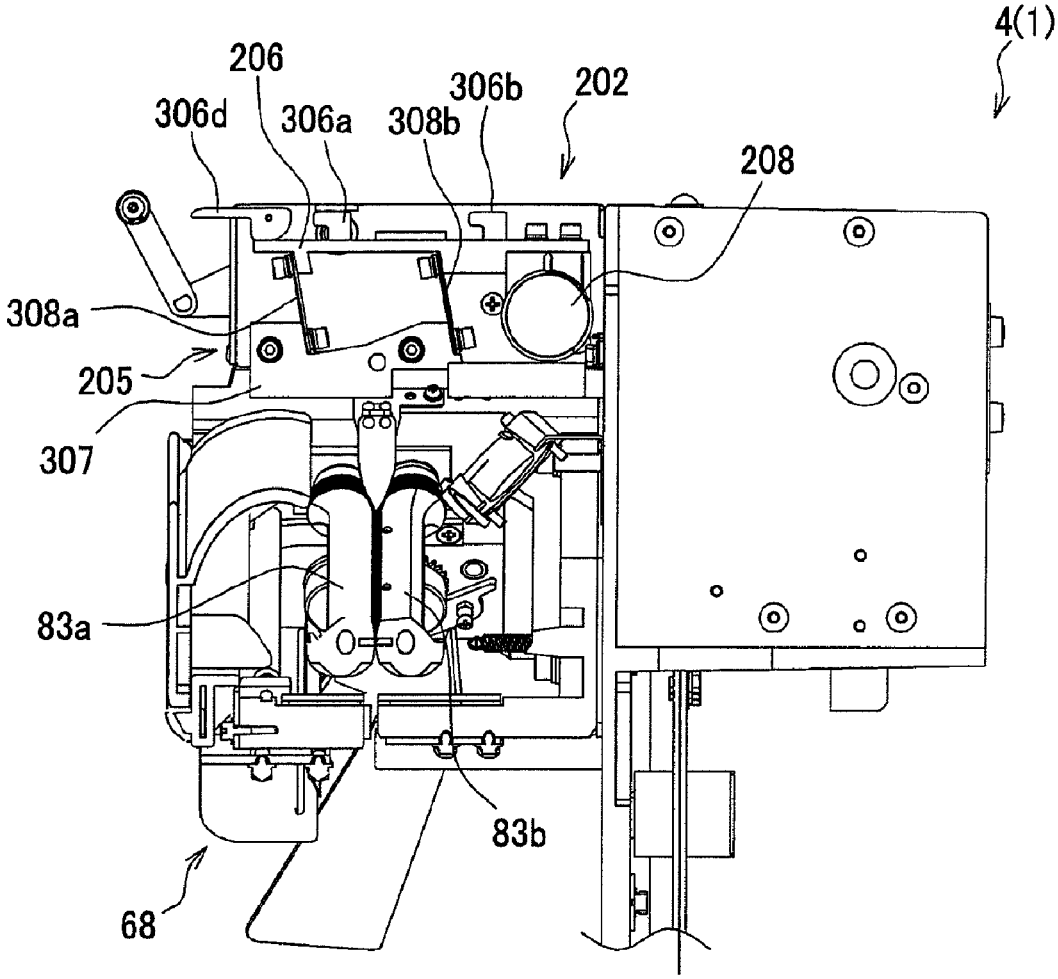
FIG. 38 is a cross sectional view taken along XXXVIII-XXXVIII line of FIG. 36.

With reference to FIGS. 32 and 33, empty medicine bags (loss bags 216) containing no medicine are provided in order to separate continuous medicine bags by prescription, and the loss bags 216 are cut by a cutter mechanism 201. If medicine (powdered medicine in particular) is mixed in the loss bag 216, the medicine mixed in the loss bag flow out into the apparatus upon cutting by the cutter mechanism 201, and thereby causes contamination. Therefore, once the controller 11 determines that a loss bag 216 is in preparation based on the inputted prescription data, the vibration applying mechanisms 202, 203 are maintained in the stopped state. Since the first loss bag 216 in the example of FIG. 32, and the second loss bag 216 in the example of FIG. 33 are subjected to cutting by the cutter mechanism 201, the vibration applying mechanisms 202, 203 are maintained in the stopped state during preparation of these loss bags 216.

Third Embodiment

In the following, the third embodiment of the present invention is described with reference to FIGS. 34 to 39. The third embodiment is different from the second embodiment in the held section 67*h* of the hopper 67, the hopper-side vibration applying mechanism 202 and the configuration of the same.

Figure 39:
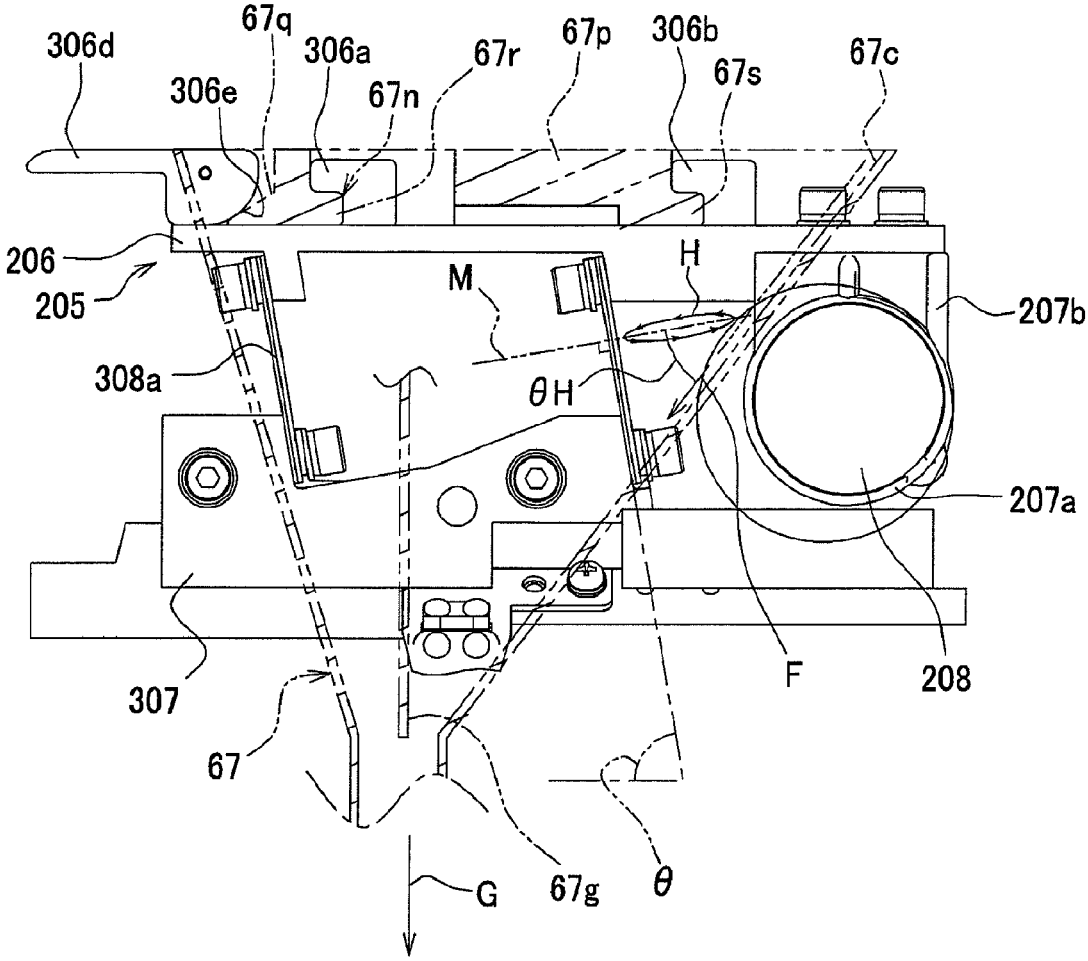
FIG. 39 is a partial perspective view showing a unfolding guide-side vibration applying mechanism.
Figure 40:
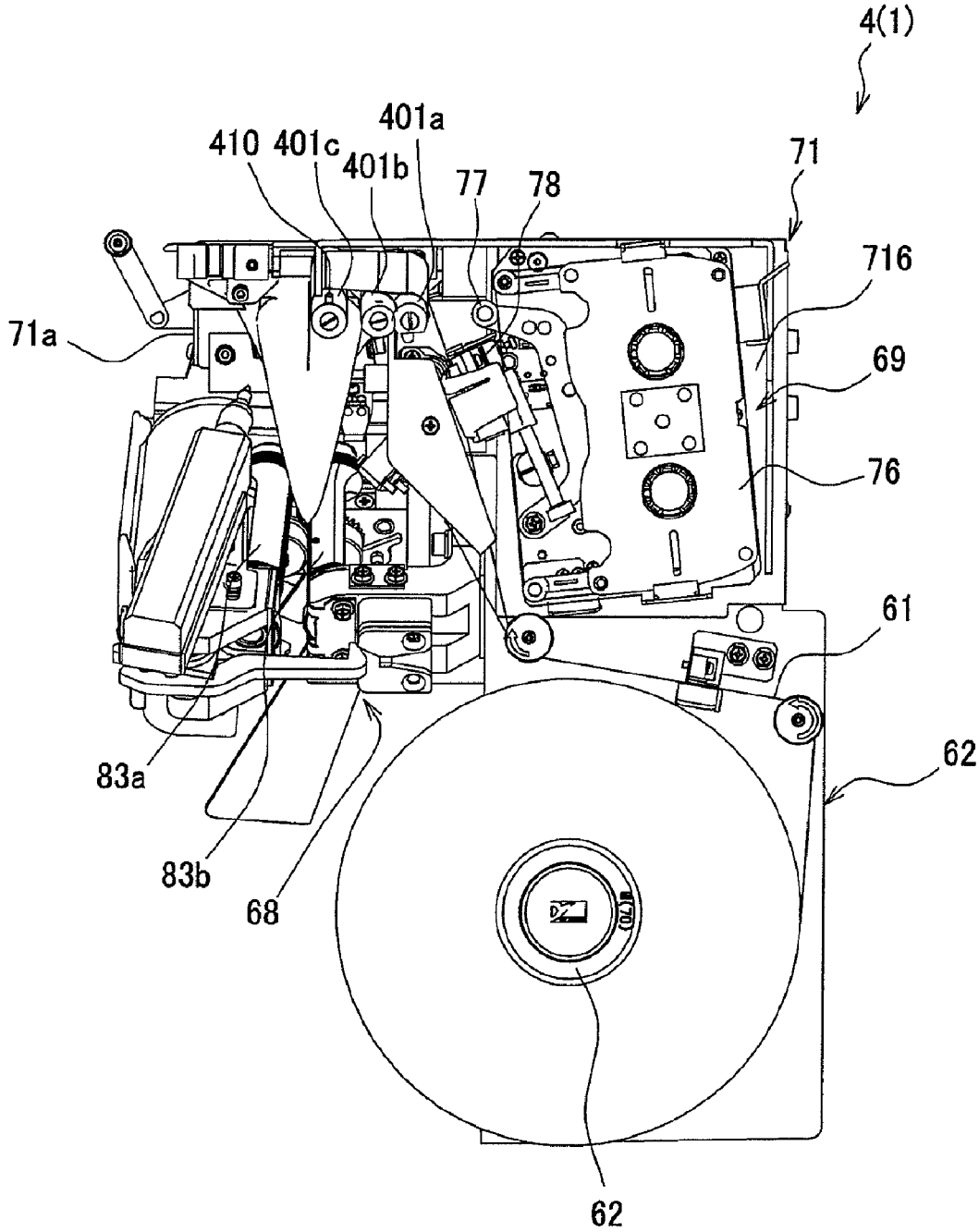
FIG. 40 is a right side view of a packaging unit included in a medicine packaging apparatus according to a fourth embodiment of the invention.
Figure 41:
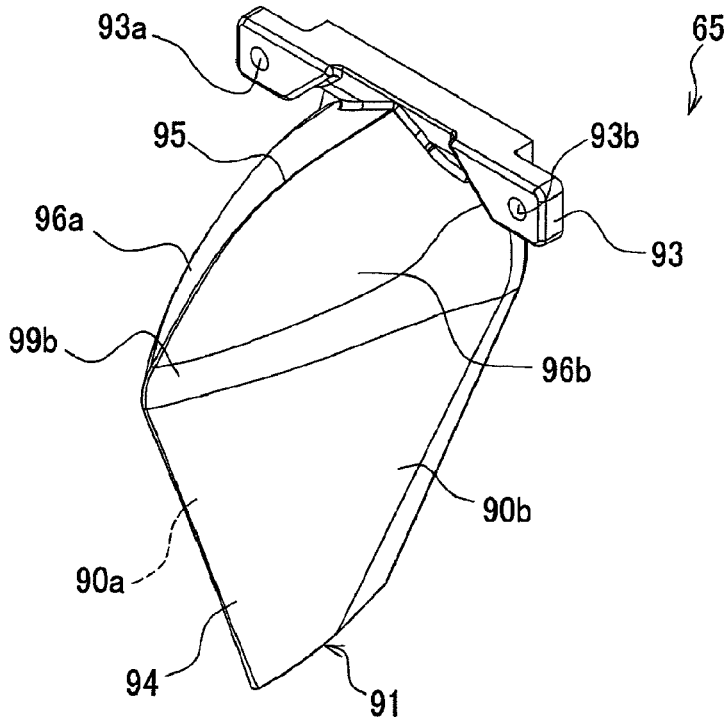
FIG. 41 is a perspective view for showing a unfolding guide from the upper side.

With reference to FIG. 39, the held section 67*h* of the hopper 67 in the present embodiment has block-shaped first and second portions 67*n*, 67*p* provided near the inlet opening 67*b* outside the inner inclined wall surface 67*f*. An inclined held surface 67*q* is formed in one end side (left-hand side in FIG. 39) of the first section 67*n*, while a projection 67*r* is formed in the other end side. A projection 67*s* is also provided in one end side (right-hand side in FIG. 39) of the second portion 67*p*.

The holding structure 205 included in the hopper maintaining structure 202 of the present embodiment has a base 307 independent of the hopper holding section 206. The hopper holding section 206 and the base 307 are coupled to each other with independent leaf springs 308*a*, 308*b* having both upper and lower ends screwed shut. In plan view, the leaf springs 308*a*, 308*b* extend right under the hopper holding section 206 (vertically downward). In side view, the leaf springs 308*a*, 308*b* extend slantingly downward from the hopper holding section 206 in parallel with each other so as to be closer to the vibration motor holding section 207 (vibration motor 208) toward the lower end side, and are placed in the longitudinal direction of the hopper holding section 206 at an interval. An angle of gradient θ of the leaf springs 308*a*, 308*b* with respect to the horizontal direction is set at, for example, approximately 80°. The leaf springs 308*a*, 308*b* is deflected like a cantilever with the lower end side being a fixed end while the upper end side being a free end, and upon displacement of the upper ends of the leaf springs 308*a*, 308*b* due to the deflection, the hopper holding section 206 is also displaced thereby.

As shown with arrow H in FIG. 39, in a plane (the plane of paper itself in FIG. 28) including a moving direction F and a gravity direction G of the powdered medicine which moves on the inwardly inclined surface 67*c* which has the mildest inclination, the above-constituted holding structure 205 in the present embodiment transmits the vibration generated by the vibration motor 208 to the hopper 67 so that the hopper 67 may vibrate with an elliptical orbit which is farther away from the inwardly inclined surface 67*c* toward an upper side. A major axis M of the elliptical orbit H of the vibration of the hopper 67 is perpendicular to the leaf springs 308*a*, 308*b* (angle of gradient θ), and an angle $\theta_H$ formed between the major axis H and the moving direction F of the powdered medicine which moves on the inwardly inclined surface 67*c* by its own weight is an acute angle sufficiently smaller than 45 degrees (about 5° to 15°). Application of the vibration with such elliptical orbit makes it possible to effectively move the powdered medicine on the inwardly inclined surface 67*c* having mild inclination from the inlet opening 67*b* to the nozzle section 67*a*, and to reliably prevent the residual medicine generated by adhesion. As compared with the case where the angle $\theta_H$ is a relatively obtuse angle as in the second embodiment, setting the angle $\theta_H$ to be sufficiently small acute angle makes it possible to enhance the movement speed of the powdered medicine on the inwardly inclined surface 67*c*. Since the vibration motor 208 is positioned in the vicinity of the upper end of the inwardly inclined surface 67*c*, vibration generated by the vibration motor 208 is efficiently transmitted to the inwardly inclined surface 67*c* and promotes movement of the medicine on the inwardly inclined surface 67*c*.

The hopper holding section 206 in the present embodiment has hooking sections 306*a*, 306*b* having a reverse L shape protruding upward. The hopper holding section 206 is equipped with a rotatable lever 306*d* which functions as a locking mechanism 306*c*. As shown in FIG. 39, when the hopper 67 is fixed to the hopper holding section 306, projections 67*r*, 67*s* of the held section 67*h* fit into the lower side of the hooking sections 306*a*, 306*b*, and the held surface 67*q* is pressed by a holding surface 306*e* of the locking lever 306*d*. When the lever 306*d* is rotated clockwise in FIG. 39, the holding surface 306*e* of the lever 306*d* is released from the held surface 67*q*, and the hopper 67 becomes removable from the hopper holding section 206.

Other configurational and operational aspects of the third embodiment are similar to those of the second embodiment. In employing the hopper-side vibration applying mechanism 202 and the unfolding guide-side vibration applying mechanism 203 of the first and third embodiments, the feeding configuration of the package sheet 61 is not particularly limited. More specifically, the package sheet 61 may be held in the state of being wound around the roll 62 without being folded into two, and may be folded into two parts after being rolled out from the roll 62. Although not shown in FIGS. 25 to 33, a unfolding guide-side vibration applying mechanism is accommodated in the unfolding guide 65 as in the second embodiment.

Fourth Embodiment

In the following, fourth embodiment of the present invention is described with reference to FIGS. 40 to 44. The fourth embodiment is different from the first to third embodiments in the configuration of the unfolding guide 65 included in the packaging unit 4 of the medicine packaging apparatus 1. In the fourth embodiment, the guide rod 81 is replaced by three guide rollers 401*a*, 401*b*, 401*c*, and the conveying direction of the package sheet 61 is curved just before the unfolding guide 65 with these guide rollers 401*a* to 401*c*. A projection 410 in a small-diameter cylinder shape protruding upward is provided on the upper top section of the guide roller 401*a* which is closest to the unfolding guide 65 among three guide rollers

401*a* to 401*c*. The projection 410 has the function to prevent meandering and fallout of the package sheet 61. Since the conveying direction of the package sheet 61 curves slantingly downward in a portion of the guide roller 401*a*, the projection 410 can effectively prevent meandering and fallout of the package sheet 61. Since the peripheral surface of the small-diameter cylinder shape of the projection 410 comes into contact with the package sheet 61, the contact resistance to the package sheet 61 is very small.

Figure 42:
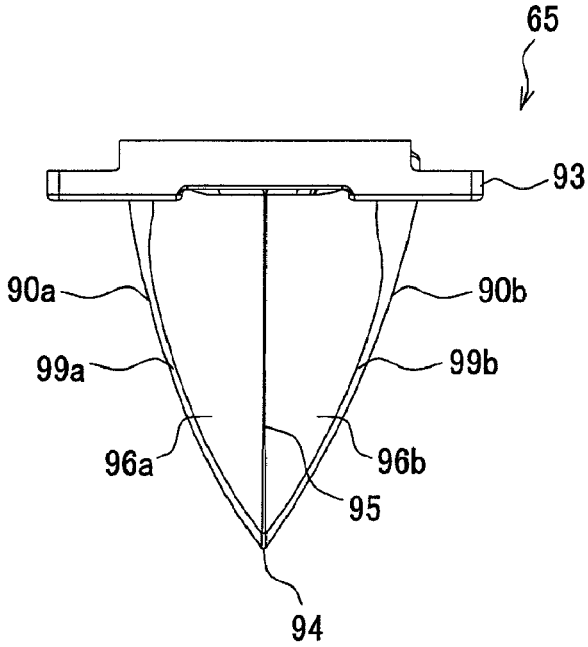
FIG. 42 is a plan view of the unfolding guide.
Figure 43:
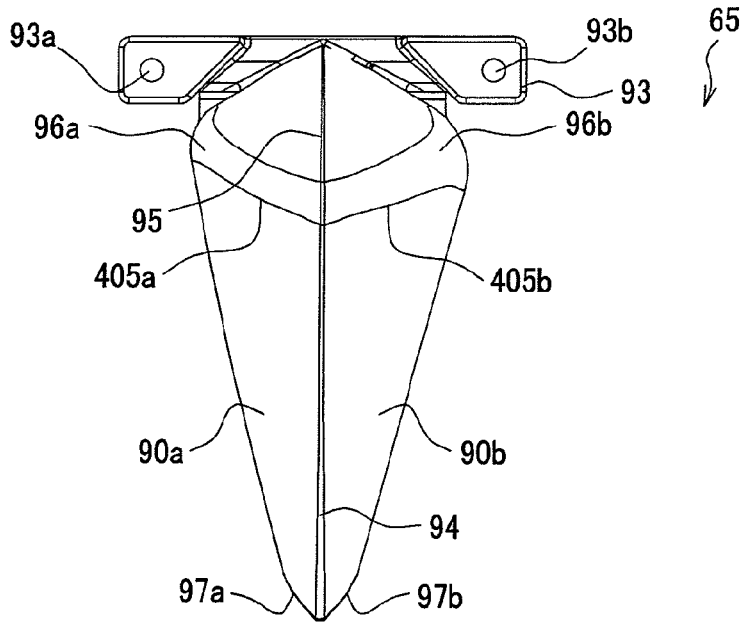
FIG. 43 is a front view of the unfolding guide.
Figure 44:
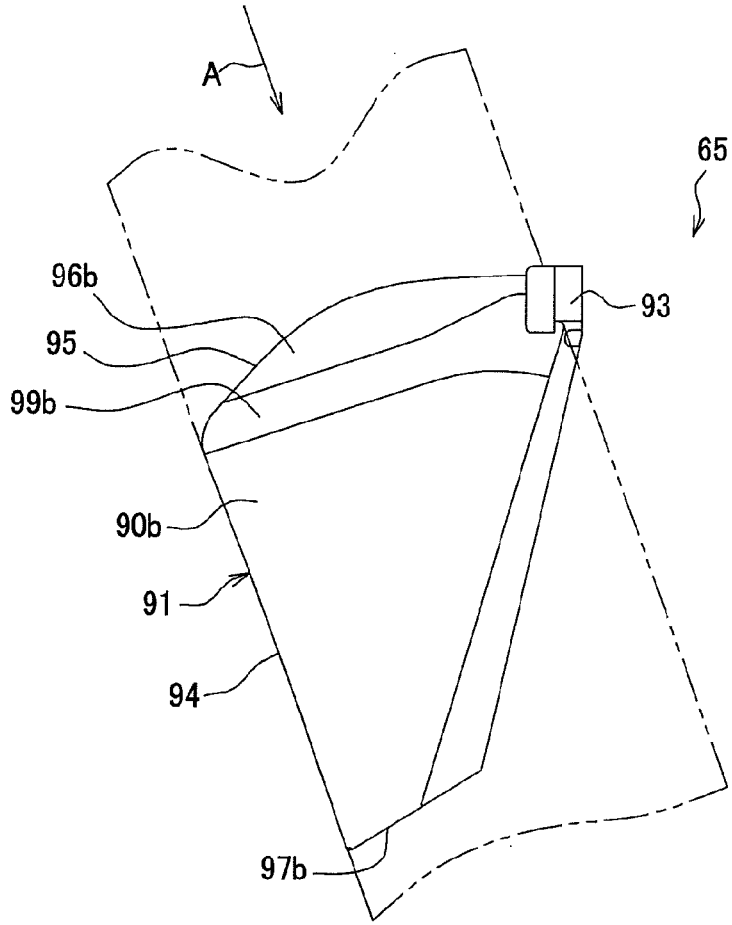
FIG. 44 is a side view of the unfolding guide.
Figure 45:
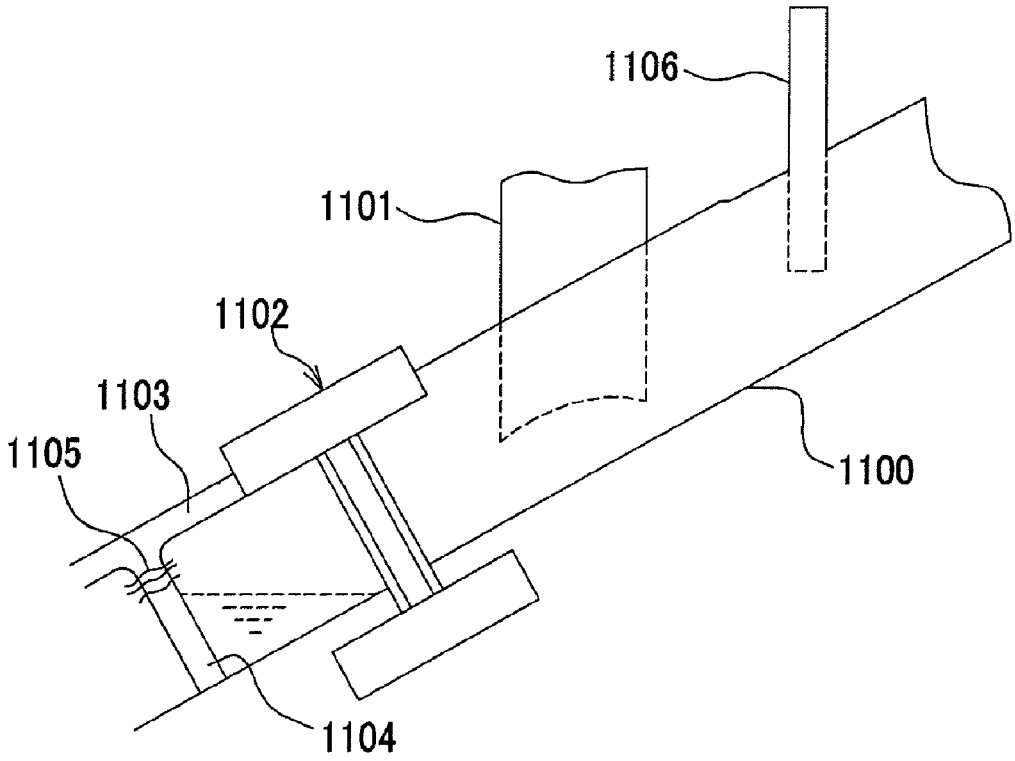
FIG. 45 is a schematic view showing the structure around a unfolding guide in a conventional medicine packaging apparatus.
Figure 46:
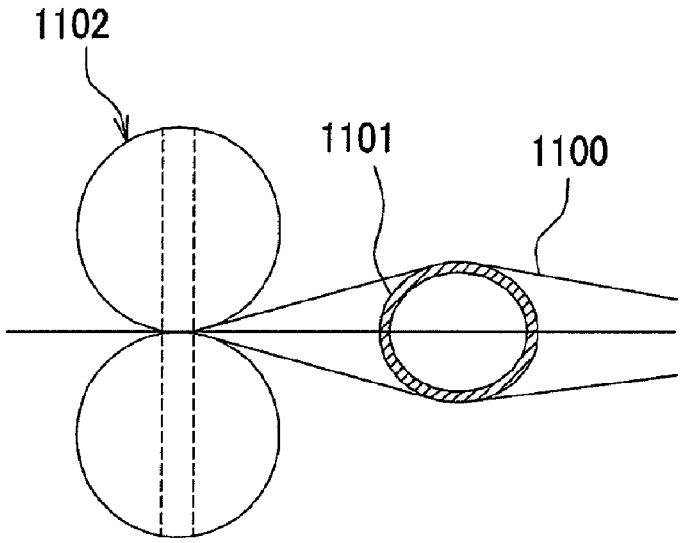
FIG. 46 is a schematic plan view showing the structure around the nozzle section of a hopper in the conventional medicine packaging apparatus.

As most clearly shown in FIG. 42, in the present embodiment, a shoulder section 99*b*, out of a pair of shoulder sections 99*a*, 99*b* included in the unfolding guide 65, which is on the inner side of the curve in the conveying direction of the package sheet 61 with respect to the main ridge 94 (on the rear side when the front holding section 71 is seen from the front) is bulged with respect to the main ridge 94 more than the shoulder section 99*a* which is on the outer side of the curve with respect to the main ridge 94 (on the near side when the front holding section 71 is seen from the front) by approximately 2 to 4 mm (approximately 3 mm in the present embodiment). Thus, since the shoulder section 99*b* is bulged, the unfolding guide surface 90*b* and the top surface 96*b* on the rear side which continue to the shoulder section 99*b* are also bulged more than the unfolding guide surface 90*a* and the top surface 96*a* on the near side. A joining position 405*b* between the shoulder section 99*b* and the unfolding guide surface 90*b* on the rear side is positioned closer to the rear end edges 97*a*, 97*b* than a joining position 405*a* between the shoulder section 99*a* and the unfolding guide surface 90*a* on the near side. However, an angle γb formed by the unfolding guide surface 90*b* on the rear side with the main ridge 94 in the rear end edges 97*a*, 97*b* is almost identical to an angle γa formed by the unfolding guide surface 90*a* on the near side with the main ridge 94. In other words, in the rear end area of the main ridge 94, the symmetric property of the shape of the unfolding guide 91 is secured.

While the conveying direction of the two-folded package sheet 61 is curved with the guide rollers 401*a* to 401*b*, the tension applied to the package sheet 61 (one side of the two-folded sheet) on the inner side of the curve (on the rear side when the front holding section 71 is seen from the front) tends to be weaker than the tension applied to the package sheet 61 (the other side of the two-folded sheet) on the outer side of the curve (on the near side when the front holding section 71 is seen from the front) in the area on the downstream side of the curved portion. This imbalance of the tension between the inner side and the outer side tends to make the package sheet 61 inside the curve slack, and this slacking causes misaligned state (so-called "edge displacement") of both the edges (so-called "edges") of the two-folded package sheet 61. The contact resistance of such members as the heat transfer head 78 of the printing section 69 positioned in the upstream from the unfolding guide 91 and the guide rollers 401*a* to 401*c* tends to promote the imbalance of the tension between the inner side of the package sheet 61 and the outer side of the package sheet 61.

However, in the unfolding guide 91 of the present embodiment, the shoulder section 99*b*, the unfolding guide surface 90*b*, and the top surface 90*b* on the rear side are in the shape bulging more than the shoulder section 99*a*, the unfolding guide surface 90*a*, and the top surface 90*a* on the near side, so that the tension applied to the package sheet 61 in the sections where the main ridge 94, both the shoulder sections 99*a*, 99*b*, and both the unfolding guide surfaces 90*a*, 90*b* come into contact with the package sheet 61 is balanced. Particularly, since three sections, the shoulder sections 99*a*, 99*b* and a rear end area of the main ridge 94, come into contact with the package sheet 61, the tension applied to the package sheet 61 is balanced. As a result, the tension uniformly acts on both the sides of the two-folded package sheet 61, and therefore the package sheet 61 can be unfolded by the unfolding guide 91 with both the edges aligned (in the state of so-called "edge aligned" state), so that generation of winkles can be prevented more reliably.

Other configurational and operational aspects of the fourth embodiment are similar to those of the third embodiment. Although not shown in FIGS. 40 to 44, a unfolding guide-side vibration applying mechanism is accommodated in the unfolding guide 65 as in the second embodiment.

The invention claimed is:

1. A medicine packaging apparatus, comprising:

a sheet supply section for unrolling and feeding an elongated package sheet from a roll on which the package sheet is wound, the package sheet previously being folded along its longitudinal direction into two parts;

a unfolding guide for unfolding and opening the package sheet fed by the sheet supply section;

a medicine introducing section for introducing a medicine into an opening of the package sheet;

a heat sealing section for sealing the package sheet so as to enclose the introduced medicine; and a printing section for making a print on the package sheet arranged between the sheet supply section and the unfolding guide along a path of the package sheet, wherein the unfolding guide comprises:

a main ridge extending along with a crease of the package sheet; and a pair of unfolding guide surfaces which are convex curved surfaces stretching from the main ridge and which are symmetrical to each other with respect to the main ridge.

2. The medicine packaging apparatus according to claim 1, wherein, as seen from a conveying direction of the package sheet, outlines of the unfolding guide surfaces are convex curves and a distance between the pair of the unfolding guide surfaces increases as the unfolding guide surfaces are farther away from the main ridge, and wherein, as seen from a direction orthogonal to the conveying direction of the package sheet and facing the main ridge, the outlines of the unfolding guide surfaces are straight and a distance between the unfolding guide surfaces become narrower from an upstream to a downstream of the conveying direction of the package sheet.

3. The medicine packaging apparatus according to claim 1, wherein the unfolding guide surface of the unfolding guide has a rear end edge extending from an end section of the main ridge on a downstream side of the conveying direction of the package sheet, and wherein the rear end edge forms a first angle which is an acute angle with the main ridge at a joining position with the main ridge and a second angle which is larger than the first angle with the main ridge at regions other than the joining position with the main ridge.

4. The medicine packaging apparatus according to claim 1, wherein a portion of the unfolding guide on an upstream side of the conveying direction of the package sheet comprises a sub ridge extending continuously from the main ridge and a pair of top surfaces which are convex curved surfaces stretching symmetrically with respect to the sub ridge and which are joined to the unfolding guide surfaces, and wherein a pair of shoulder sections joining the unfolding guide surfaces and the top surfaces and constituted of curved surfaces continuing to the unfolding guide surfaces and the top surfaces.

5. The medicine packaging apparatus according to claim 4, wherein the sheet supply section has a curved guide for curving the conveying direction of the package sheet immediately before the unfolding guide, and wherein the unfolding guide is formed so that one shoulder section on an inner side of a curvature of the conveying direction with respect to the main ridge is more bulged with respect to the main ridge than the other shoulder section on an outer side of the curve with respect to the main ridge.

6. The medicine packaging apparatus according to claim 1, wherein the heat sealing section has a pair of rotatable heater rollers.

7. The medicine packaging apparatus according to claim 1, wherein the medicine introducing section is provided with a hopper having an inlet opening on an upper side and a nozzle section inserted into the opening of the two-folded package sheet for introducing the medicine into the package sheet on a lower side, and wherein the medicine packaging apparatus further comprises a first vibration applying mechanism for applying vibration to the hopper.

8. The medicine packaging apparatus according to claim 1, further comprising a holding frame accommodated in a housing space within an apparatus main frame and having a front holding section stretching to a front side of the apparatus main frame, a side holding section extending from one lateral edge side of the front holding section to a rear side, and a rotatable coupling section for rotatably coupling the other lateral edge side of the front holding section to the apparatus main frame, wherein the sheet supply section comprises a sheet guide mechanism for guiding the package sheet unrolled from the roll, wherein the roll, the printing section, and a part of the sheet guide mechanism are arranged on the side holding section of the holding frame, and wherein remaining parts of the sheet guide mechanism, the unfolding guide, the medicine introducing section, and the heat sealing section are arranged on the front holding section of the holding frame.

9. A medicine packaging apparatus, comprising:

a sheet supply section for unrolling and feeding an elongated package sheet from a roll on which the package sheet is wound, the package sheet previously being folded along its longitudinal direction into two parts;

an unfolding guide for unfolding and opening the package sheet fed by the sheet supply section;

a medicine introducing section for introducing a medicine into an opening of the package sheet;

a heat sealing section for sealing the package sheet so as to enclose the introduced medicine; and a printing section for making a print on the package sheet arranged between the sheet supply section and the unfolding guide along a path of the package sheet, wherein the unfolding guide comprises:

a main ridge extending along with a crease of the package sheet; and a pair of unfolding guide surfaces which are convex curved surfaces stretching from the main ridge and which are symmetrical to each other with respect to at least a portion of the main ridge including a rear end thereof.

* * * * *